US005305066A

United States Patent [19]

Koh et al.

[11] Patent Number: 5,305,066

[45] Date of Patent: Apr. 19, 1994

[54] IMAGE HEATING DEVICE EMPLOYING ENDLESS BELT

[75] Inventors: Shokyo Koh, Kawasaki; Koki Kuroda, Tokyo; Tamotsu Okada, Kawasaki; Hironobu Nakai; Takehito Utsunomiya, both of Yokohama, all of Japan

[73] Assignee: Canon Kabushiki Kaisha, Tokyo, Japan

[21] Appl. No.: 925,499

[22] Filed: Aug. 5, 1992

[30] Foreign Application Priority Data

| | | | |
|---|---|---|---|
| Aug. 6, 1991 | [JP] | Japan | 3-220957 |
| Aug. 6, 1991 | [JP] | Japan | 3-220958 |
| Aug. 6, 1991 | [JP] | Japan | 3-220959 |
| Aug. 6, 1991 | [JP] | Japan | 3-220960 |
| Oct. 4, 1991 | [JP] | Japan | 3-285570 |
| Oct. 4, 1991 | [JP] | Japan | 3-285572 |
| Oct. 4, 1991 | [JP] | Japan | 3-285575 |
| Nov. 20, 1991 | [JP] | Japan | 3-332537 |

[51] Int. Cl.[5] ..... G03G 15/20

[52] U.S. Cl. ..... 355/289; 198/806; 198/810; 355/208; 355/282; 355/285; 355/290

[58] Field of Search ..... 355/282, 285, 289, 290, 355/295, 203, 204, 208; 219/216; 198/806, 807, 810; 474/102-108

[56] References Cited

U.S. PATENT DOCUMENTS

| | | | |
|---|---|---|---|
| 4,429,985 | 2/1984 | Yokota | 474/106 X |
| 4,462,676 | 7/1984 | Shimura et al. | 198/806 X |
| 4,959,040 | 9/1990 | Gardner et al. | 474/103 |
| 5,027,160 | 6/1991 | Okada et al. . | |
| 5,118,920 | 6/1992 | Tanabe et al. | 355/290 X |
| 5,132,744 | 7/1992 | Maruta et al. | 355/282 |
| 5,149,941 | 9/1992 | Hirabayashi et al. . | |
| 5,153,655 | 10/1992 | Suzuki et al. . | |
| 5,157,444 | 10/1992 | Mori et al. | 355/282 |
| 5,171,969 | 12/1992 | Nishimura et al. | 355/285 X |

*Primary Examiner*—Matthew S. Smith

*Attorney, Agent, or Firm*—Fitzpatrick, Cella, Harper & Scinto

[57] ABSTRACT

An image heating device includes a heater; an endless belt movable together with a recording material carrying an image; wherein the image carried upon the recording material is heated through the endless belt by heat from the heater; a lateral shift controller for controlling the endless belt to shift laterally in the alternating directions within a predetermined range; and a lateral shifting range controller for controlling the range by the lateral shift controller.

20 Claims, 73 Drawing Sheets

IMAGE HEATING DEVICE EMPLOYING ENDLESS BELT

FIELD OF THE INVENTION AND RELATED ART

This invention relates to an-image heating device for heating an image carried on recording material, by the heat from a heater, through the medium of an endless belt.

An image heating device represented by a thermal fixing device is employed in an image forming apparatus such as a copying machine, printer, or facsimile machine, which employs electrophotography, an electrostatic recording system, a magnetic recording system, or the like.

U.S. Ser. No. 206,767, now U.S. Pat. No. 5,149,941, which has been assigned to the assignee of this application, proposes, as this type of image heating device, a film heating system comprising a heater having a small thermal capacity and quick heat rising response, and a thin piece of heating film.

This film type heating system can accomplish the object of reducing the wait time and the power consumption, since it can concentrate the heat on the film side, in particular, within a nip.

When an endless belt of film is employed in such a film type heating system as the above, lateral film shift occurs, in other words, the endless belt shifts laterally.

Therefore, an image heating device, in which the lateral shift of the endless belt is controlled, is proposed in U.S. Ser. No. 446,449.

In this U.S. Ser. No. 446,449, now U.S. Pat. No. 5,027,160, a device is proposed in which a bidirectional lateral shifting force is applied to the endless belt, and the direction of this force is alternated to make the endless belt shift back and forth in the lateral direction within a predetermined range.

If the film speed suddenly increases while this type of endless belt of film is laterally shifted back and forth within the predetermined range, the frequency of the repetitive lateral film shifts in the alternate directions naturally increases, causing problems such as film position detection errors, film damage, or wrinkles. Also, it is liable that in the event a driving means such as solenoid is used to displace the film driving rollers, about which the film is stretched, the solenoid driving frequency increases; therefore, the temperature of the solenoid itself unnecessarily rises. It is possible to optimize these pertinent conditions through adjustments, depending on the component accuracy at the time of initialization, but the above mentioned lateral shift speed of the film changes after prolonged usage.

Since it is different in that the film is used as a component of the heating device rather than being used as an ordinary conveying (belt) component, the film temperature reaches as high as 150° C. to 200° C.; therefore, it must be taken into consideration that the friction coefficients of the film conveying means and the heater surface become different from those in the normal temperature condition, and further, the initial conditions for lateral film shift may change due to the thermal expansion of the components themselves, such as the driving rollers around which the film is stretched.

It is also known that in the heating device employing the film type heating system, the film is slidably conveyed against the fixedly supported heater; therefore, heat-resistant fluorinated grease is coated as a lubricant on the inner film surface of the endless belt. However, the viscosity of this type grease is very temperature dependent, which is also the cause of unstable lateral film shift conditions.

It must also be considered that if the film is made to shift back and forth in the lateral direction always within the same region, the wear of the heater surface, heater supporting member, and film conveying means will be accelerated.

SUMMARY OF THE INVENTION

An object of the present invention is to provide an image heating device in which the endless belt is prevented from being damaged or being subjected to the occurrence of wrinkles.

Another object of the present invention is to provide an image heating device in which errors in detecting the endless belt position are prevented.

A further object of the present invention is to provide an image heating device capable of regulating the reciprocal, laterally shifting movement of the endless belt.

A further object of the present invention is to provide an image heating device capable of controlling the lateral shift speed of the endless belt.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 3:
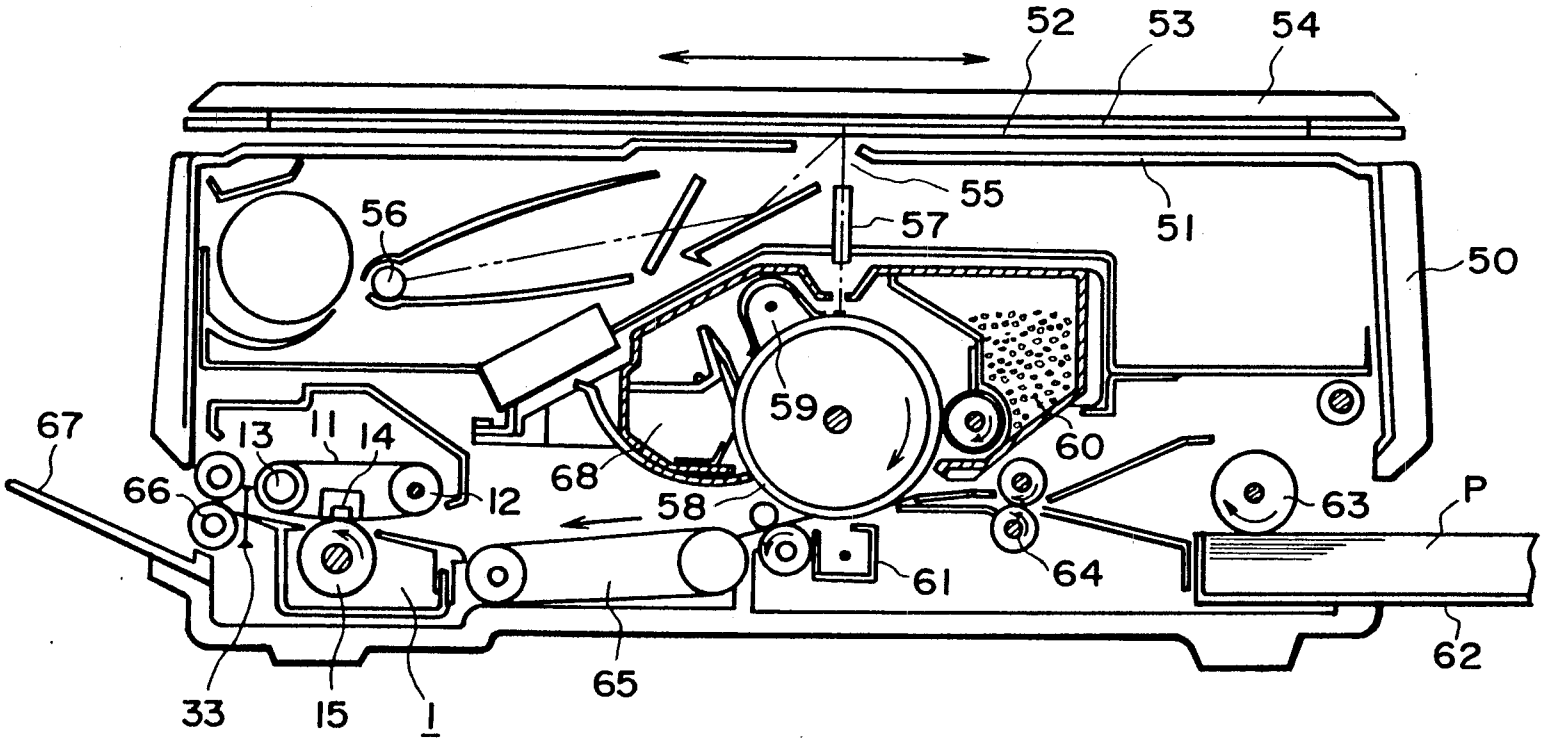
FIG. 3 is a sectional view of an image forming apparatus employing this heating device as a fixing device.

FIG. 3 is a sectional view-of an image forming apparatus employing, as a fixing device, the heating device in accordance with the preferred embodiment of the present invention.

The image forming device shown in FIG. 3 is a transfer type electrophotographic copying machine employing a reciprocating table for the original document and a rotating drum. Since the structure, image forming process, and the like of a copying machine of this type are in the public domain, they will be only briefly described.

Reference numeral 59 refers to a reciprocating type document table glass provided on an upper surface plate 51 of a copying machine case 50, and is driven to reciprocate side to side in this figure by an unshown driving mechanism. At a predetermined location on the upper surface of this document table glass 52, original document 53 is placed, with its image to be copied facing downward, and is pressed down by pressing plate 54 to be prepared for the copying operation.

The surface of the downward facing image of the original document, being made ready in the above mentioned manner, passes an illuminating section 55 while it moves either forward or backward in a continuing movement, thereby being scanned by a slit of illumination. Reference numeral 56 refers to an illumination source.

The slit of beam reflected from the surface of the downward facing original document is projected and focused, by an imaging lens 57 (array of imaging elements with a short focal point), on the surface of a photosensitive drum 58 which rotates synchronously with the scanning of the original document image, thereby sequentially exposing the surface of the photosensitive drum 58 to the image.

The photosensitive drum 58 which has been uniformly charged to a positive or negative polarity by a charger 59 is exposed to the image light in the above mentioned manner, thereby sequentially forming an electrostatic latent image, which corresponds to the original document image, on its circumferential surface.

Next, the surface of the photosensitive drum 58 where this latent image is formed sequentially passes by a development device 60, where the latent image is sequentially developed. Then, the developed image carried on the surface of the photosensitive drum 58 is delivered to the location of a transfer discharger 61 by the continuing rotation of the photosensitive drum.

Meanwhile, transfer material P is fed piece by piece into the copying machine from within a transfer material cassette 62 by a feed roller 63, and is put on standby, with its tip prefed in the nip section between a pair of register rollers 64, which are stationary at this time. Then, the photosensitive drum 58 and the pair of register rollers 64 begin to be rotated with their rotations synchronized to each other, whereby the transfer material P is conveyed toward the photosensitive drum 58 while being guided by a guide member, and is then introduced into the transfer section between the photosensitive drum 58 and the transfer charger 61, where the developed image carried on the surface of the photosensitive drum 58 is sequentially transferred onto the transfer material P.

The transfer material P on which the image is transferred is sequentially separated from the surface of the photosensitive drum 58 by an unshown separating means; introduced by a conveying device 65 into a fixing device 1, where the image is fixed; and is discharged, as a copy, into an external discharge tray 67 by a discharge roller 66.

After the image transfer process, the surface of the photosensitive drum 58 is cleaned by a cleaning device 68 and is repeatedly used for the image forming process.

Next, the image heating device in accordance with the embodiment of the present invention is described in detail.

Figure 1:
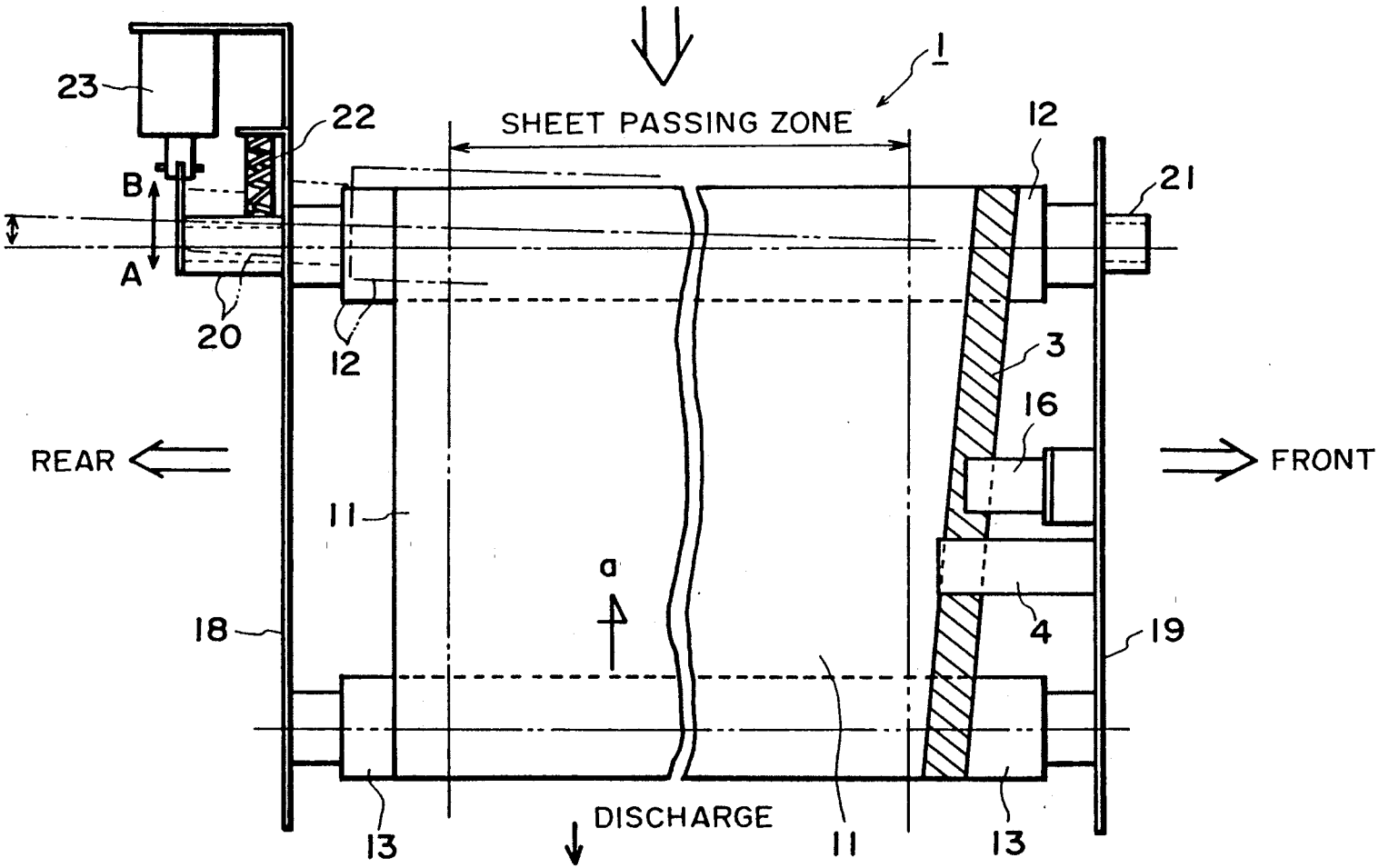
FIG. 1 is a partial plan view of an embodiment of the heating device in accordance with the present invention.
Figure 2:
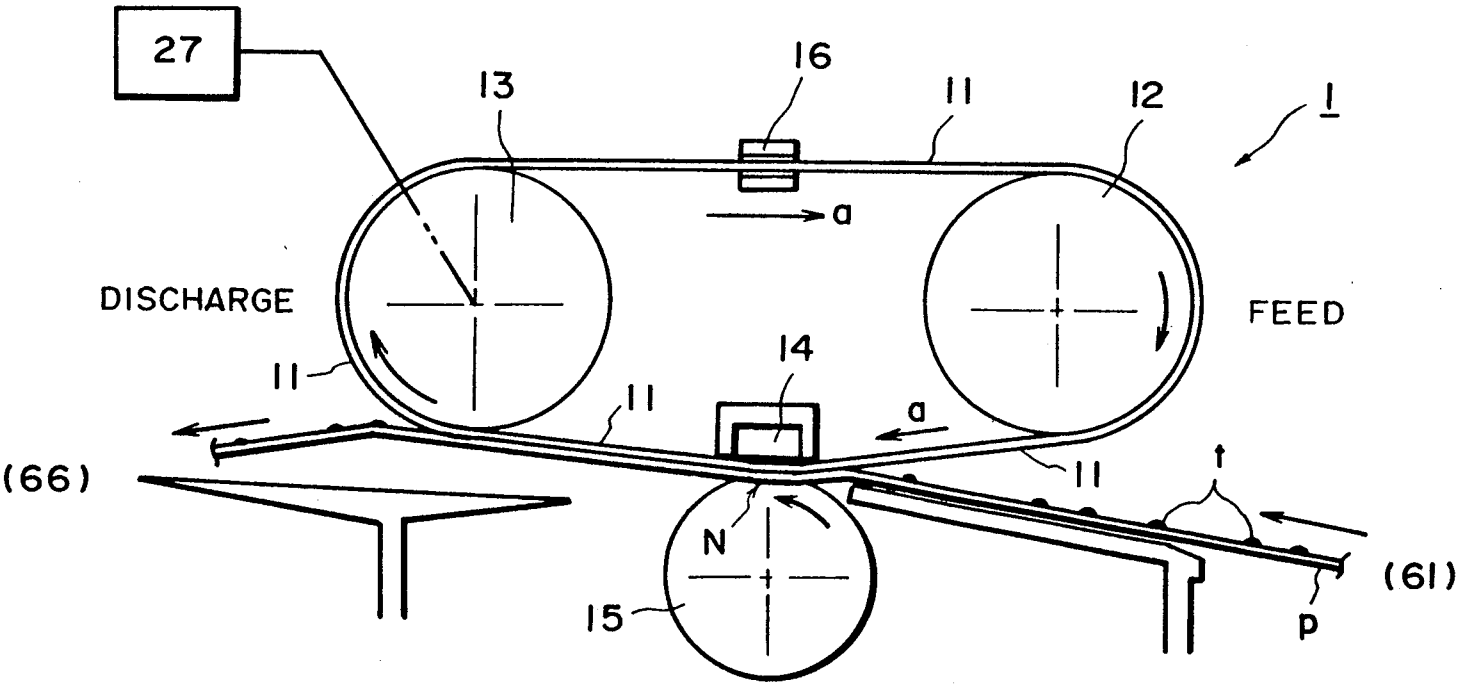
FIG. 2 is a sectional view of the embodiment shown in FIG. 1.

FIG. 1 is a partial plan view of the image heating device, and FIG. 2 is a sectional view of the same.

In FIGS. 1 and 2, reference numerals 13 and 12 refer to a pair of rollers mounted approximately in parallel: endless film driving roller, left, and follower roller, which also works as a tensioning roller, right, respectively. Reference numeral 11 refers to an endless film stretched about these two rollers 13 and 12, and it is driven to move in the clockwise direction indicated by an arrow (a), at a predetermined peripheral speed, as the driving roller 13 is driven by a driving mechanism, which includes a driving motor 27, to rotate in the clockwise direction indicated by the arrow.

The film 11 is heat-resistant film with an overall thickness of 100 $\mu$, preferably 40 $\mu$ or less. In the case of this embodiment, it is an approximately 20 $\mu$ thick endless film comprising a piece of base film of heat-resistant resin, such as polyimide, polyetherimide, PES, or the like, and an approximately 10 $\mu$ thick parting layer of PTFE, PFA, or the like, which is coated on the image facing surface of the base film.

Reference numeral 14 refers to a heater fixedly mounted (fixedly supported on the fixing device) on the inner side of the above mentioned endless film 11. This heater is a low heat capacity linear heater mounted perpendicular to the moving direction of the film 11, that is, in the film width direction, and generates heat due to electrical current flow.

Reference numeral 15 refers to a pressing roller having an elastic layer of rubber with excellent parting properties, such as silicon rubber, and it compresses the endless film 11, that is, the film section which is rotating on the lower side of the loop, against the above mentioned heater 14, with overall contact pressure of, for example, 4 kg to 5 kg generated by an unshown urging means. It rotates at a peripheral speed approximately the same as the traveling speed of the film, in the same direction.

The transfer material P carrying the unfixed toner image t (thermally fusible toner) on its upper surface is conveyed by the conveying device 65 from the transfer section 61 (FIG. 3) to the fixing device 1; is introduced in between the film 11 and the pressing roller 15 of a compression section N (fixing nip section) formed by the heater 14, pressing roller 15, and the endless film 11 interposed between the preceding two, where the unfixed image surface is compressed against the surface of the film 11, which is moving, while forming a flat surface, at approximately the same speed and in the same direction as the transfer material P; and passes through the fixing nip, as if being laminated with the film 11, while being subjected to the compressing force. In this process, the toner image carrying surface of the transfer material P is heated by being subjected, through the film 11, to the heat of the heater 14, whereby at least the surface layer of the toner image t is completely softened and fused, in other words, thermally fixed on the surface of the transfer material P. After passing the fixing nip section N, the transfer material P passes by the film driving roller 13, where it is separated from the surface of the film 11 due to the curvature of the film 11 which follows the contour of the roller 13.

When a piece of film constituting an endless belt is employed as a heating film as in the above, a lateral film shift occurs.

Figure 4:
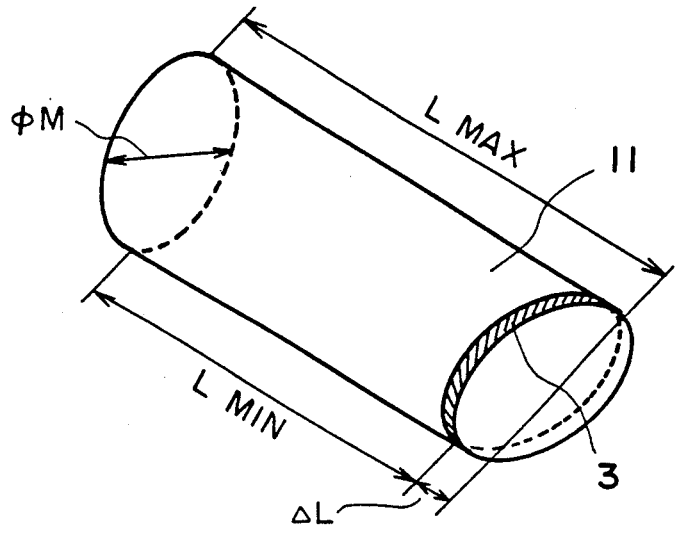
FIG. 4 is an external view of the endless film.
Figure 5:
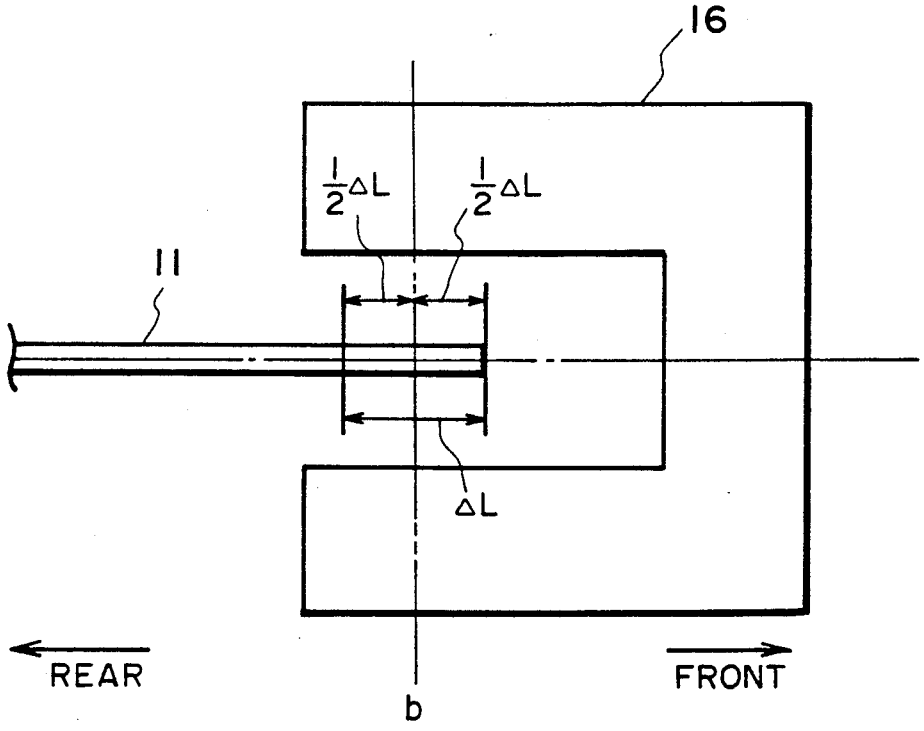
FIG. 5 is a schematic diagram showing the relation between the film sensor and the film position.
Figure 6:
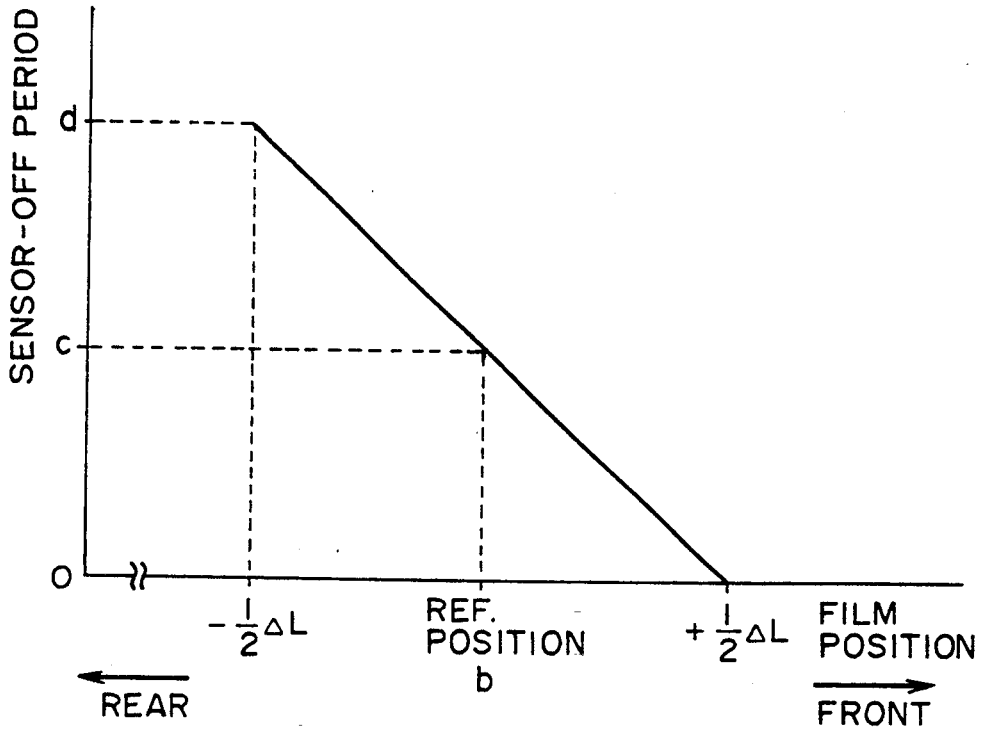
FIG. 6 is a graph showing the relation between the film position and the film sensor output.

Next, the preferred embodiments of the present invention, that is, mechanisms for controlling the lateral shift of the endless film, are described, referring to FIGS. 4 to 6.

The driving roller 13 and the follower roller 12 for the endless film 11 are mounted, with use of bearings, between a front side plate 19 and a rear side plate 18 in the fixing device 1, as shown in FIG. 1. Reference numerals 21 and 22 refer to the front bearing and the rear bearing, respectively, for the follower roller 12.

When the driving roller 13 is driven to rotate the film 11 in the arrow direction designated by a, this film 11 shifts side to side in the longitudinal direction of the rollers 13 and 12, that is, in the film width direction, from its initial location outlined by the solid line in FIG. 1, due to the tripartite positional relation (variance in each of X, Y, and Z axes) among three components, in other words, the rollers 13 and 12, about which the film 11 is stretched, and the heater 14, unless the accuracy in parallelism (in X, Y and Z axes directions) among the driving roller 13, follower roller 12, heater 14, and pressing roller 15 is high enough to have +0 error; therefore, the ends of the film may rub against the side plate 18 or side plate 19 and break.

Therefore, in this preferred embodiment, the rear side bearing 20 of the follower roller 12 is supported on the side plate 18 in a manner so as to have a predetermined amount of play in the forward or backward direction indicated by the arrows A and B, and is normally positioned at the first position outlined by the solid line, being held by a stopper (not illustrated) while being urged in the forward direction A by a compression spring 22. This bearing 20 is also connected to a plunger of a solenoid 23, whereby it is pulled against the compression spring 22 in the backward direction B, to be displaced to the second position outlined by the two-dot chain line, when the power to this solenoid 23 is turned on.

That is, it is arranged so that the parallelism of the follower roller 12 to the driving roller 13 or the heater 14 can be adjusted by turning on or off the power supply to the solenoid 23.

In the case of this embodiment, when the solenoid 23 is turned off and the bearing 20 is at the first position outlined by the solid line, the whole body of the film 11 shifts to the left, in the film width direction, that is, in the longitudinal direction of the stretching and suspending members 13, 12, and 14, while it travels between and rotates about them; and when the solenoid is turned on and the bearing 20 is at the second position outlined by the two-dot chain line, the rotating film 11 shifts, conversely to the above, to the right, in the film width direction, that is, toward the front side of the rollers 13 and 12.

Reference numeral 16 is a photosensor for detecting the positional status of the film as it laterally shifts. As shown in FIG. 1, such masking as indicated by the solidus is applied to the entire circumference of the film 11 at its front end portion to cut off the beam of the photosensor 16.

In this preferred embodiment, a photointerruptor is employed as the photosensor 16, but if, instead, a reflective type photosensor is employed, the end portion 3 of the film 11 must be given a reflective member so as to reflect the beam. Also, the positional status may be read by the photosensor, through a moving member which moves with the end of the film 11.

In this preferred embodiment, the treatment such as masking is applied to only one end portion of the film 11, but needless to say, it may be applied over the entire film.

Reference numeral 4 refers to a cleaning member for the film end portion, which continuously cleans the film end portion to prevent misreading caused by blots and such on the film end portion when, for example, a reflection type sensor is employed. In this preferred embodiment, felt material is employed, but any material is acceptable as long as it is effective in cleaning.

FIG. 4 shows the external shape of the film 11. This film is an endless belt, as was described previously. Its diameter is $\phi M$. Also, as shown in the figure, one of the end portions of the film 11 (end portion on the front side) is diagonally cut. Let the length of the longest section be Lmax and the shortest be Lmin. Then, the measurement of the diagonally cut portion of the film 11 is obtained by Lmax−Lmin, which is expressed here as $\Delta L$ (amount of diagonal film cut). This diagonally cut portion is arranged as shown in FIG. 1 so that the position of the film 11 is detected by the photosensor 16 positioned on the front side of this fixing device.

FIG. 5 is a detail drawing showing the positional relation between the photosensor 16 and the film 11. In this preferred embodiment, a transmission type photointerruptor is employed as the photosensor 16, and its sensing location is indicated by reference b. In this arrangement, if the film 11 is on the rear side relative to the position b, the photosensor 16 is turned on, and if it is on the front side, it is turned off. Also, it is structured so that the diagonally cut portion of the film 11 faces this position b for detection.

That is, as the film 11 rotatively moves in the direction of the arrow a shown in FIG. 2, the photosensor 16 is repeatedly turned on and off, whereby the on/off periodic ratio (duty ratio) varies depending on the film position (position where the film laterally shifts).

The film position presented in FIG. 5 is the reference position where the detection position b of the photosensor 16 coincides with the mid-point of the diagonally cut portion of the film 11. FIG. 6 is a graph showing the relation between the film position, relative to this reference position, and the OFF period of the photosensor 16.

As is shown in FIG. 6, when the film 11 is at the reference position b, the OFF period of the photosensor 16 is c seconds, and when the film 11 is located to the front side of the reference position b by more than $\Delta L/2$, the OFF period of the photosensor 16 is 0 seconds.

Conversely, if the film 11 is positioned to the rear side of the reference position b by more than $\Delta L/2$, the photosensor 16 remains turned off.

Now then, when the film 11 is positioned at the location beyond which the above mentioned photosensor 16 remains turned off, the OFF period is d seconds, which is considered to be approximately equal to the time it takes for the film 11 to finish one cycle of rotation. Also, since the OFF period of c seconds at the reference position b corresponds to the mid-point of the diagonally cut portion of the film, it amounts to be approximately half the time of the above mentioned OFF period of d seconds.

Figure 7:
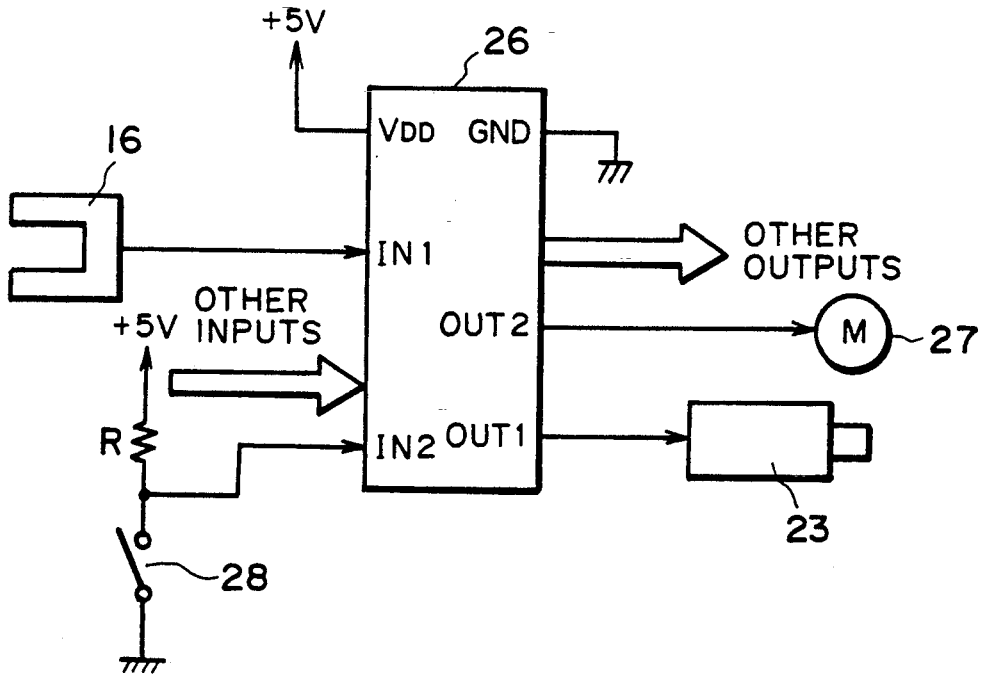
FIG. 7 is a schematic diagram of the control system.
Figure 8:
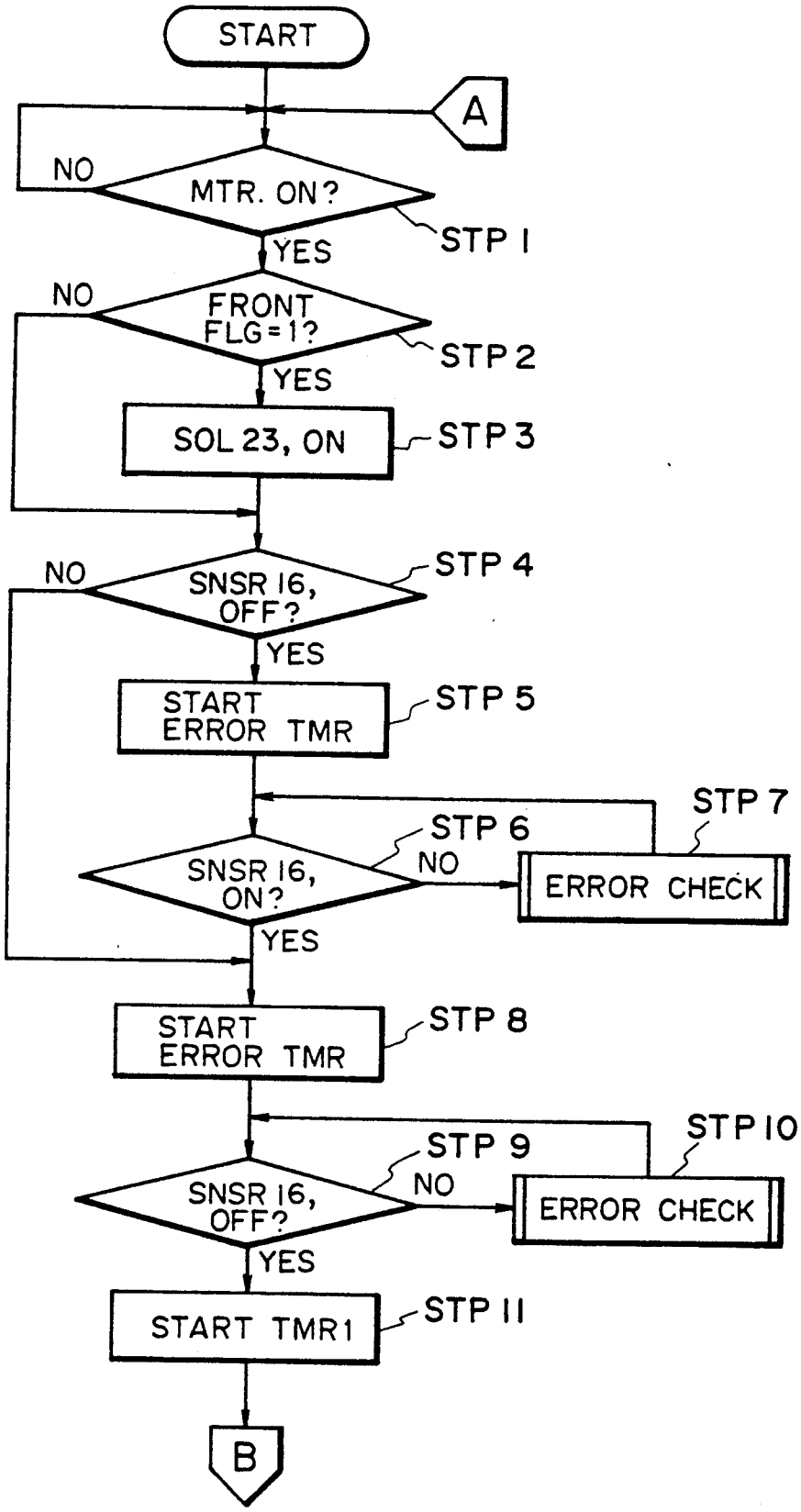
FIG. 8 is a flow chart for the lateral film shift control program.
Figure 9:
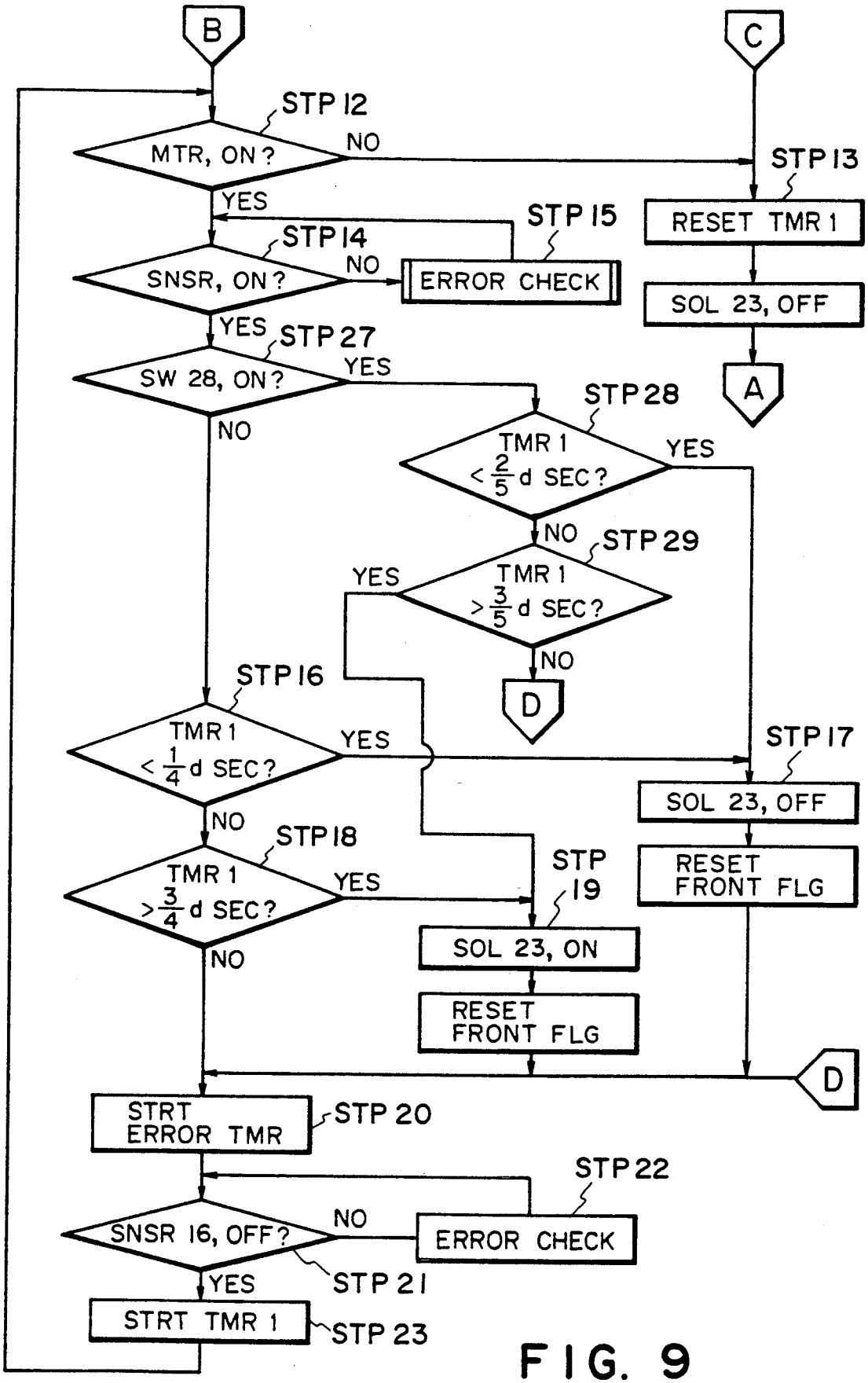
FIG. 9 is a flow chart for the lateral film shift control program.

FIG. 7 shows a control circuit to control the lateral film shift.

Reference numeral 26 refers to a microcomputer, and its input terminal IN 1 is connected to the above mentioned photosensor 16. Also, to its output terminal OUT 1, the solenoid 23 is connected. To the output terminal OUT 2, a rotation control signal for a motor 27, which drives this fixing device, is outputted.

To a $V_{DD}$ terminal, the power source of +5 V is connected, and a GND terminal is connected to ground.

Though not illustrated, this microcomputer 26 is provided with terminals for the signals to and from the copying machine employing this fixing device, and it also contains a non-volatile RAM, the memory contents of which is not erased even when the power supply to this microcomputer 26 is interrupted, as well as ROMs, other RAMs, and the like, which store the programs such as the sequence program for the copying operation of this copying machine.

Reference numeral 28 refers to a switch for selecting the lateral film shift control range. In this preferred embodiment, when the switch 28 is off (input terminal IN 2 of the microcomputer 26 indicates "H"), the control is executed within the first lateral shift control range, and when the switch 28 is on (input terminal IN 2 indicates "L"), the lateral film shift control is executed within the second lateral shift control range.

At this time, the relation between the first and second lateral shift control ranges is set up as follows:

First lateral shift control range > Second lateral shift control range

FIGS. 8 to 11 show flow charts for the lateral film shift control programs for this fixing device.

These programs are also stored in the internal ROM of the above mentioned microcomputer 26, and are called and executed, at a predetermined interval or as needed, by the main sequence program and the like.

In step 1 (FIG. 8) immediately after the start, it is determined whether or not the motor 27 is subroutine is also called which selects the lateral film shift control range, depending on the sheet size (width of the transfer material). If the motor 27 is off, the program returns to the step 1 and waits until the motor 27 is turned on.

Next, in the step 2, it is decided whether or not the film is controlled to shift to the front side. In this arrangement, the contents of a predetermined address of the internal non-volatile RAM of the above mentioned microcomputer 26 is set up as the front side flag, and if its memory status is 1, in other words, if the film has been controlled to shift frontward up to this point, step 3 is followed, where the solenoid 23 is turned on and the lateral shift control is set up on the front side, and step 4 is followed. Also, in the step 2, if the front side flag indicates 0, this means that the film has been controlled to shift rearward; therefore, the program skips to the step 4.

In the step 4, it is decided whether or not the sensor 16 is off, and if the sensor 16 is on, step 8 is followed, and if it is off, step 5 is followed.

In the step 5, the value in an error timer is reset to 0, simultaneously starting the measurement, and step 6 is followed.

In the step 6, it is decided whether or not the sensor 16 is on, and if it is not on, the step 7 is followed.

In the step 7, an error check routine is executed to return to the step 6.

Figure 10:
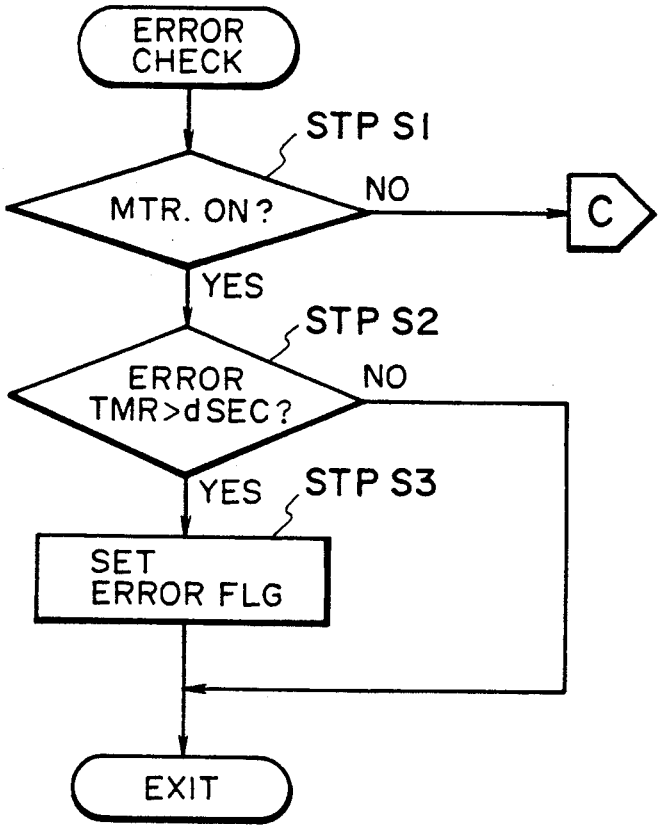
FIG. 10 is a flow chart for the lateral film shift control program.

At this time, the contents of the error check routine is described, referring to FIG. 10. First, in step S1, it is decided whether or not the motor 27 is on, and if it is on, step S2 is followed, and if it is not on, step 13 (FIG. 9) is followed.

In the step S2, it is decided whether or not the error timer value is larger than d seconds, and if it is smaller, the program proceeds to the exit of this routine. Also, in the step S2, if the error time value is larger than d seconds, step S3 is followed. In the step S3, an error flag is set and the program proceeds to the exit of this routine.

Next, in the step 6, if the sensor 16 is on, the step 8 is followed, where the error timer value is reset to 0, simultaneously starting the measurement, and then, step 9 is followed. In the step 9, it is decided whether or not the sensor 16 is off, and if it is not off, step 10 is followed, where the error check routine is executed to return to the step 9; and if the sensor 16 is off, step 11 is followed, where the value of the timer 1 is reset to 0, simultaneously starting the measurement, and then step 12 (FIG. 9) is followed.

In the step 12, it is determined whether or not the motor 27 is on, and if it is on, step 14 is followed.

In the step 14, it is determined whether or not the sensor 16 is on, and if it is not on, step 15 is followed, where the error check routine is executed, and the program returns to the step 14; and if it is on, step 27 is followed.

In the step 27, it is determined whether or not the above mentioned lateral film shift control selection switch 28 is on.

In this preferred embodiment, the lateral shift control range is set up as follows:

First lateral shift control range: d/4 to 3d/4

Second lateral shift control range: 2d/5 to 3d/5

In step 27, if the switch 28 is on, step 28 is followed, where the control is executed within the second lateral shift control range, and if it is not on, step 16 is followed, where the control is executed within the first lateral shift control range, which is wider than the second lateral shift control range.

In the step 28, a comparison is made to determine whether or not the value measured by the timer 1 is smaller than 2d/5 seconds, and if it is smaller, it can be decided that the film 11 is located to the front side beyond the second shift control range; therefore, step 17 is followed, where the solenoid 23 is turned off to switch the lateral shift direction of the film 11 to the rearward, and the front flag is reset to 0, and then, step 20 is followed.

Also, in the step 28, if the value measured by the timer 1 is not smaller than 2d/5 seconds, step 29 is followed.

In the step 29, a comparison is made to determine whether or not the value measured by the timer 1 is larger than 3d/5 seconds, and if it is not larger, the step 20 is followed, and if it is larger, it can be determined that the film 11 is positioned to the rear side beyond the second shift control range; therefore, step 19 is followed, where the solenoid 23 is turned on to switch the shift direction of the film 11 to the frontward direction, and the front flag of 1 is set, and then, the step 20 is followed.

In the step 16, a comparison is made to determine whether or not the value measured by the timer 1 is smaller than d/4 seconds, and if it is smaller, it can be determined that the film 11 is located to the front side beyond the first shift control range; therefore, the step 17 is followed, where the solenoid 23 is turned off to switch the shift direction of the film 11 to the rearward direction, and the front flag is reset to 0, and then, the step 20 is followed.

Also, in the step 16, if the value measured by the timer 1 is not smaller than d/4 seconds, the step 18 is followed.

In the step 18, a comparison is made to determine whether or not the value measured by the timer 1 is larger than 3d/4 seconds, and if it is not larger, the step 20 is followed, and if it is larger, it can be decided that the film 11 is located to the rear side beyond the first shift control range; therefore, the step 19 is followed, where the solenoid 23 is turned on to switch the shift direction of the film 11 to the frontward direction, as well as the front flag is set to 1, and then, the step 20 is followed.

In the step 20, the error timer value is reset to 0, simultaneously starting the measurement, and the program proceeds to step 21.

In the step 21, it is determined whether or not the sensor 16 is off, and if it is not off, step 22 is followed, where the error check routine is executed, and then, the program returns to the step 21.

Also, in the step 21, if the sensor 16 is off, the step 28 is followed, where the value of the timer 1 is reset to 0, simultaneously starting the measurement, and then, the program returns to the step 12.

In the above mentioned step 12, if the motor 27 is off, the step 13 is followed, where at first, the measurement by the timer 1 is stopped; the measured value is reset to 0; and the solenoid 23 is turned off, and then, the program returns to the step 1.

Figure 11:
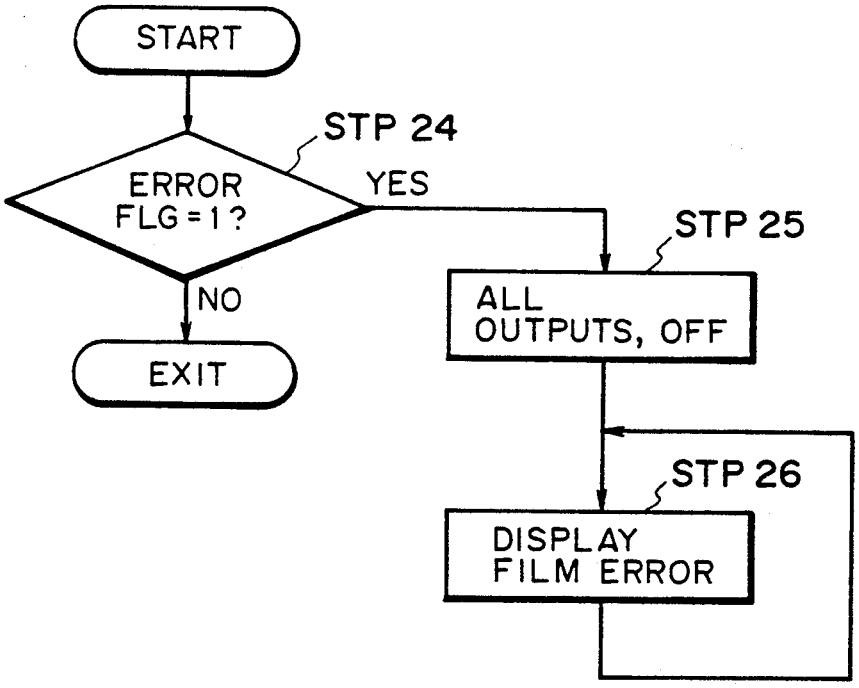
FIG. 11 is a flow chart for the lateral film shift control program.

FIG. 11 shows a flow chart for the film anomaly processing program, which is a part of the main program. Here in step 24, it is decided whether or not the error flag is set, and if it is not set, the program proceeds to the exit to execute the next main sequence program.

Also, in the step 24, if the error flag is set, step 25 is followed, where all the outputs from all the sections of the apparatus (copying apparatus in this preferred embodiment) are turned off, and then, step 26 is followed, where the film anomaly is displayed; the step 26 is set up as an endless loop to prevent the execution of the main program.

As was described above, when the rotation of the motor begins, the lateral shift control program for the endless film 11 of this fixing device controls the solenoid 23, based, first, on the contents of the non-volatile RAM storing the previous direction of the lateral shift control. Next, if the sensor 16 is on while the motor is rotating, the program wait until the sensor 16 is turned off, and if the sensor 16 is off, the program wait until the sensor 16 is turned on and keeps on waiting until it is turned off again; thereby the program detects the switching timing when the output from the film position sensor 16 is switched from ON to OFF, completing the initialization. Next, the OFF-period of the sensor 16, that is, the time it takes for the state of the sensor 16 to change from OFF to ON, is measured to detect the position of the film 11 for the first time.

From this point on, the film position is controlled to remain within the predetermined control range selected by the switch 28, based on the OFF period of the sensor 16, that is, the time between the moment when the state of the sensor 16 changes from ON to OFF and the moment when it changes from OFF to ON.

In this preferred embodiment, a transmission type photosensor is employed as the sensor 16, but needless to say, the same effect can be obtained with use of other sensors such as a microswitch or a reflection type photosensor.

Also, plural switches may be employed so that the lateral film shift control range can be selected from plural choices.

SECOND EMBODIMENT (FIGS. 12 TO 14)

Figure 12:
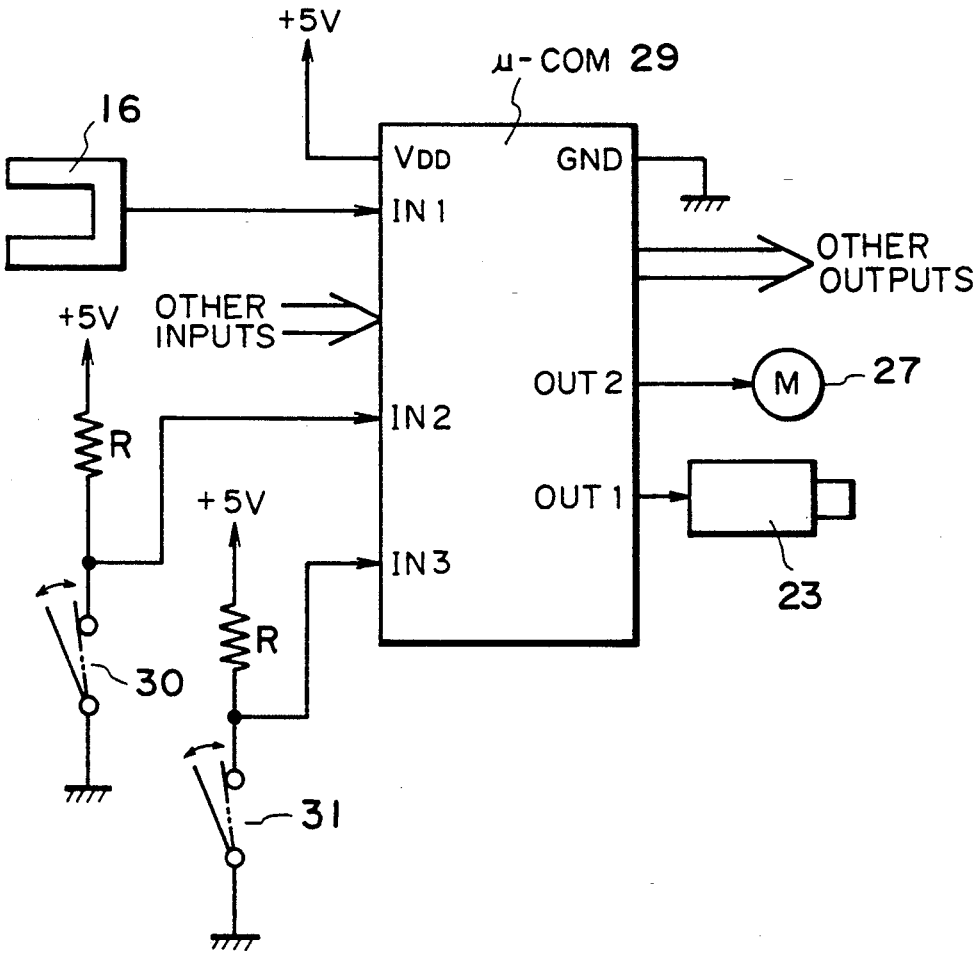
FIG. 12 is a schematic diagram of the control circuit for an alternative embodiment of the present invention.

FIG. 12 is a schematic diagram of the control system of the second embodiment. The structures of the image forming apparatus, fixing device, lateral film shift control mechanism, and the like, are the same as those of the above mentioned first embodiment.

In FIG. 12, reference numeral 29 refers to a microcomputer, and to its input terminal IN 1, the above mentioned photosensor 16 is connected. Also, to its output terminal OUT 1, the solenoid 23 is connected. To the output terminal OUT 2, the rotation control signal for the motor 24, which drives this fixing device, is outputted.

To the $V_{DD}$ terminal, the power source of +5 V is connected, and the GND terminal is connected to ground.

Though not illustrated, this microcomputer 29 is provided with terminals for the signals to and from the copying machine employing this fixing device, and it also contains non-volatile RAMS, the memory contents of which are not erased even when the power supply to this microcomputer 29 is interrupted, as well as ROMS, RAMS, and the like, which store the programs such as the sequence program for the copying operation of this copying machine.

Reference numeral 30 refers to a switch for selecting the lateral film shift control range on the rear side, and 31 refers to a switch for selecting the lateral shift control range on the front side. When the switches 30 and 31 are off (input terminals IN 2 and IN 3 indicate "H"), the control is executed within the first lateral shift control range, respectively, and when the switches 30 and 31 are on (input terminals IN 2 and IN 3 indicate "L"), the lateral film shift control is executed within the second lateral shift control range, respectively.

Figure 13:
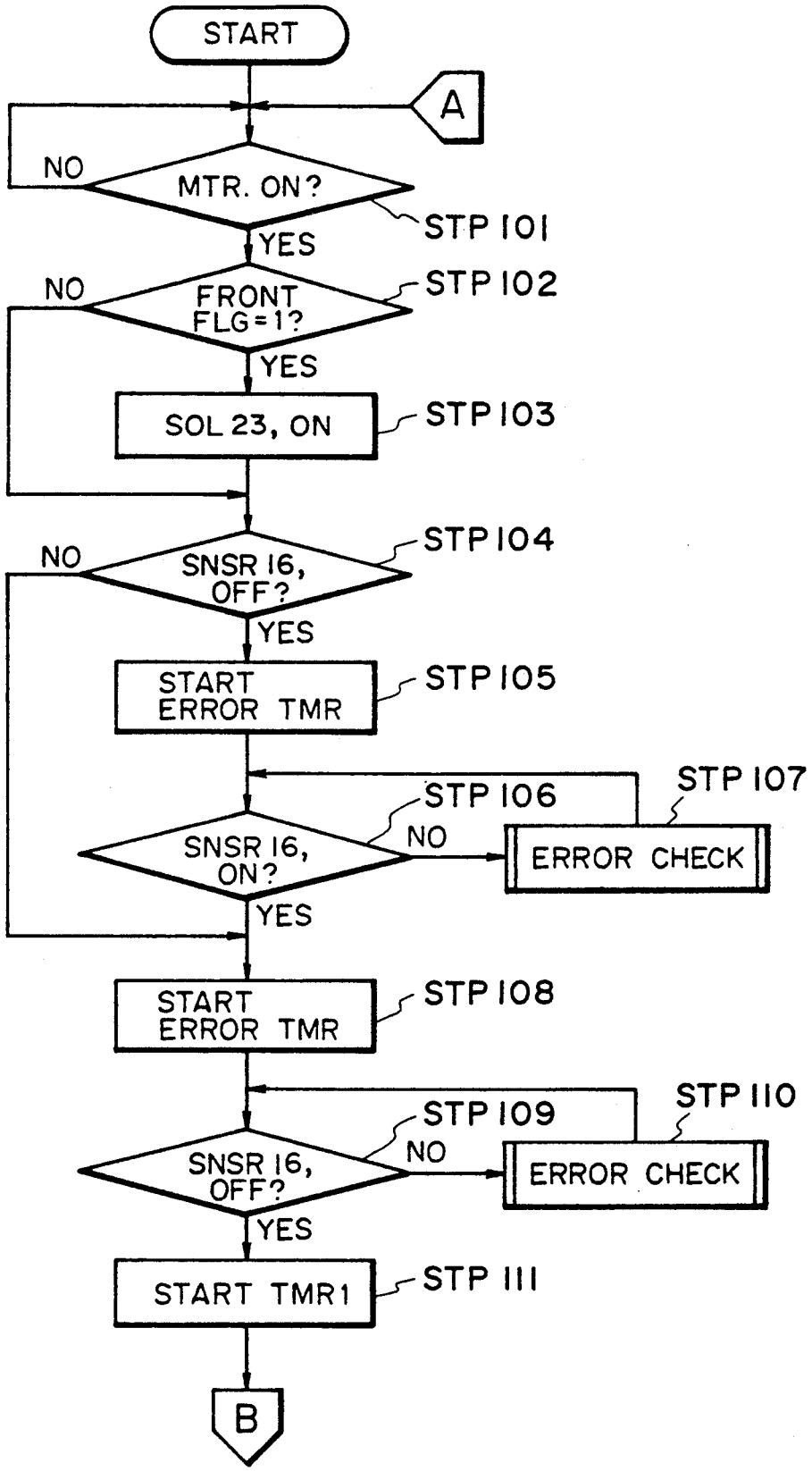
FIG. 13 is a flow chart for the lateral film shift control program.
Figure 14:
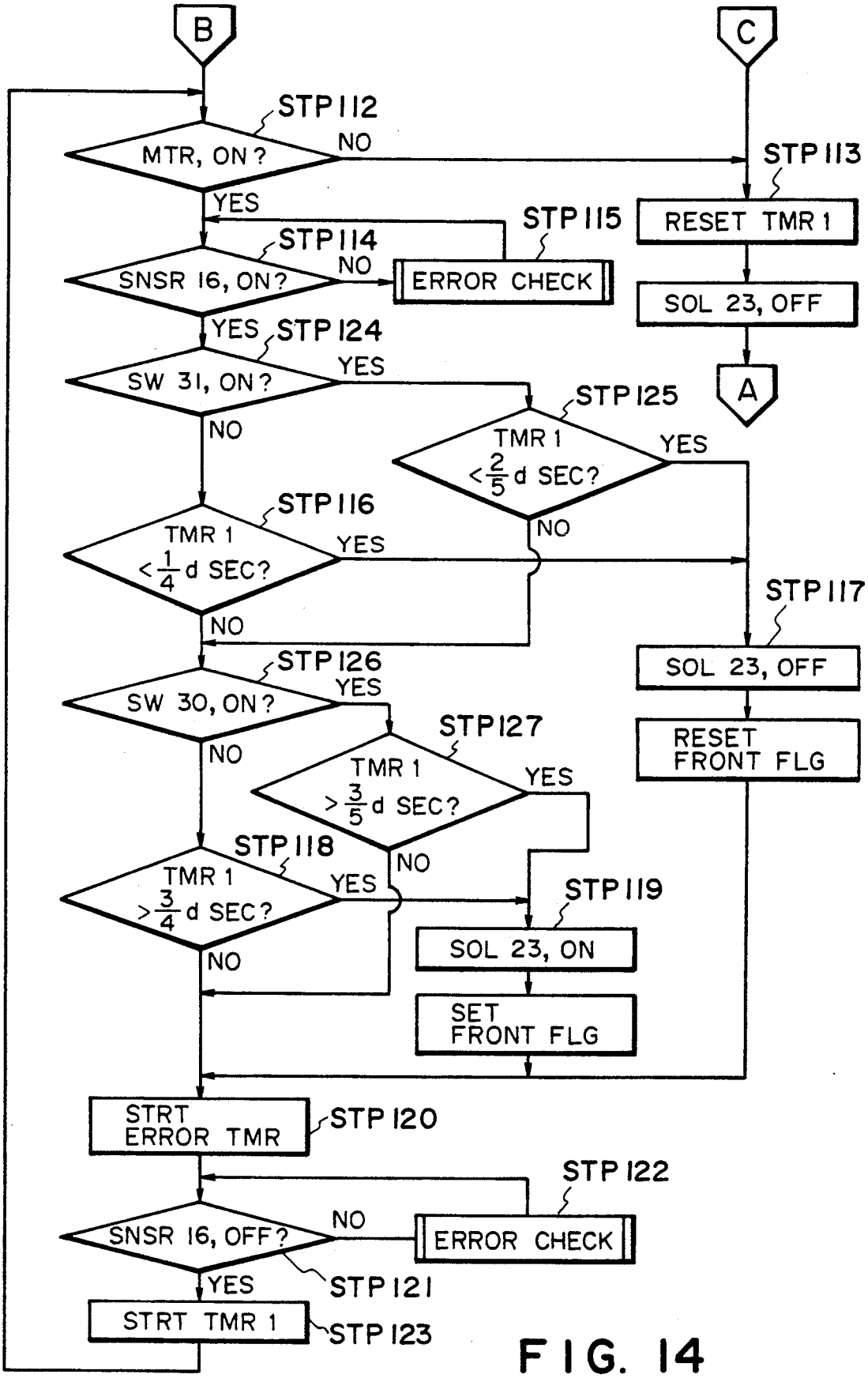
FIG. 14 is a flow chart for the lateral film shift control program.

FIGS. 13 and 14 show flow charts for the lateral film shift control program for this fixing device.

These programs are also stored in the internal ROM of the above mentioned microcomputer 29, and are called and executed, at a predetermined interval or as needed, by the main sequence program and the like.

In step 101, immediately after the start, it is determined whether or not the motor 27 is on, if the motor 27 is on, step 102 is followed, and if the motor 27 is off, the program returns to the step 101, where it waits until the motor 27 is turned on.

Next, in the step 102, it is decided whether or not the film has been controlled to shift frontward up to this point. In this arrangement, the contents of the predetermined address of the internal non-volatile RAM of the above mentioned microcomputer 29 is set up as the front side flag, and if its memory status is 1, in other words, if the film has been controlled to shift frontward up to this point, step 103 is followed, where the solenoid 23 is turned on and the shift control is set up to the front side, and step 104 is followed. Also, in the step 102, if the front side flag indicates 0, this means that the film has been controlled to shift to the rear side; therefore, the program skips to the step 104.

In the step 104, it is decided whether or not the sensor 16 is off, and if the sensor 16 is on, step 108 is followed, and if it is off, step 105 is followed.

In the step 105, the value in an error timer is reset to 0, simultaneously starting the measurement, and the program proceeds to step 106.

In the step 106, it is decided whether or not the sensor 16 is on, and if it is not on, step 107 is followed.

Next, in the step 106, if the sensor 16 is on, the step 108 is followed, where the error timer value is reset to 0, simultaneously starting the measurement, and the step 109 is followed. In the step 109, it is decided whether or not the sensor 16 is off, and if it is not off, step 110 is followed, where the error check routine is executed to return to the step 109, and if the sensor 16 is off, step 111 is followed, where the value of the timer 1 is reset to 0, simultaneously starting the measurement, and the step 112 (FIG. 14) is followed.

In the step 112, it is determined whether or not the motor 27 is on, and if it is on, step 114 is followed.

In the step 114, it is determined whether or not the sensor 16 is on, and if it is not on, step 115 is followed, where the error check routine is executed, and the program returns to the step 114; and if it is on, step 124 is followed.

In the step 124, it is determined whether or not the above mentioned switch 31 for selecting the lateral shift control on the front side is on. If the switch 31 is on in the step 124, step 125 is followed, and if it is not on, step 116 is followed.

In the step 125, a comparison is made to determine whether or not the value measured by the timer 1 is smaller than 2d/5 seconds, and if it is smaller, it can be decided that the film 11 is located to the front side beyond the second lateral shift control range; therefore, step 117 is followed, where the solenoid 23 is turned off to switch the shift direction of the film 11 to the rearward direction, and the front flag is reset to 0, and then, step 120 is followed. Also, in the step 125, if the value measured by the timer 1 is not smaller than 2d/5 seconds, step 126 is followed.

In the step 116, a comparison is made to determine whether or not the value measured by the timer 1 is smaller than d/4 seconds, and if it is smaller, it can be determined that the film 11 is located to the front side beyond the first lateral shift control range; therefore, the step 117 is followed, where the solenoid 23 is turned off to switch the shift direction of the film 11 to the rearward direction, and the front flag is reset to 0, and then, the step 120 is followed. Also, in the step 116, if the value measured by the timer 1 is not smaller than d/4 seconds, the step 126 is followed.

In the step 126, it is decided whether or not the switch 30 for selecting the lateral shift control on the rear side is on. If the switch 30 is on in the step 126, step 127 is followed, and if it is not, step 118 is followed.

In the step 127, a comparison is made to determine whether or not the value measured by the timer 1 is larger than 3d/5 seconds, and if it is not larger, the step 120 is followed, and if it is larger, it can be decided that the film 11 is located to the rear side beyond the second shift control range; therefore, the step 119 is followed, where the solenoid 23 is turned on to switch the shift direction of the film 11 to the frontward direction, as well as the front flag is set to 1, and then, the step 120 is followed.

In the step 118, a comparison is made to determine whether or not the value measured by the timer 1 is larger than 3d/4 seconds, and if it is not larger, the step 120 is followed, and if it is larger, it can be decided that the film 11 is located to the rear side beyond the first shift control range; therefore, the step 119 is followed, where the solenoid 23 is turned on to switch the shift direction of the film 11 to the frontward direction, as well as the front flag is set to 1, and then, the step 120 is followed.

In the step 120, the error timer value is reset to 0, simultaneously starting the measurement, and the program proceeds to step 121.

In the step 121, it is determined whether or not the sensor 16 is off, and if it is-not off, step 22 is followed, where the error check routine is executed, and then, the program returns to the step 121.

In the step 121, if the sensor 16 is off, step 123 is followed, where the value of the timer 1 is reset to 0, simultaneously starting the measurement, and then, the program returns to the step 112.

In the above mentioned step 112, if the motor 27 is off, step 113 is followed, where at first, the measurement by the timer 1 is stopped; the measured value is reset to 0; and the solenoid 23 is turned off, and then, the program returns to the step 101.

As for the handling of a film anomaly, it is the same as that in the first embodiment. At this time, the shift control ranges in which the switches 30 and 31 are switched over are as follows:

If Switch 30=OFF, Switch 31=OFF, d/4 to 3d/4 seconds

Switch 30=OFF, Switch 31=ON, 2d/5 to 3d/4 seconds

Switch 30=ON, Switch 31=OFF, d/4 to 3d/5 seconds

Switch 30=ON, Switch 31=ON, 2d/5 to 3d/5 seconds

THIRD EMBODIMENT (FIGS. 15 TO 17)

This embodiment is another alternative film position detection means.

Figure 15:
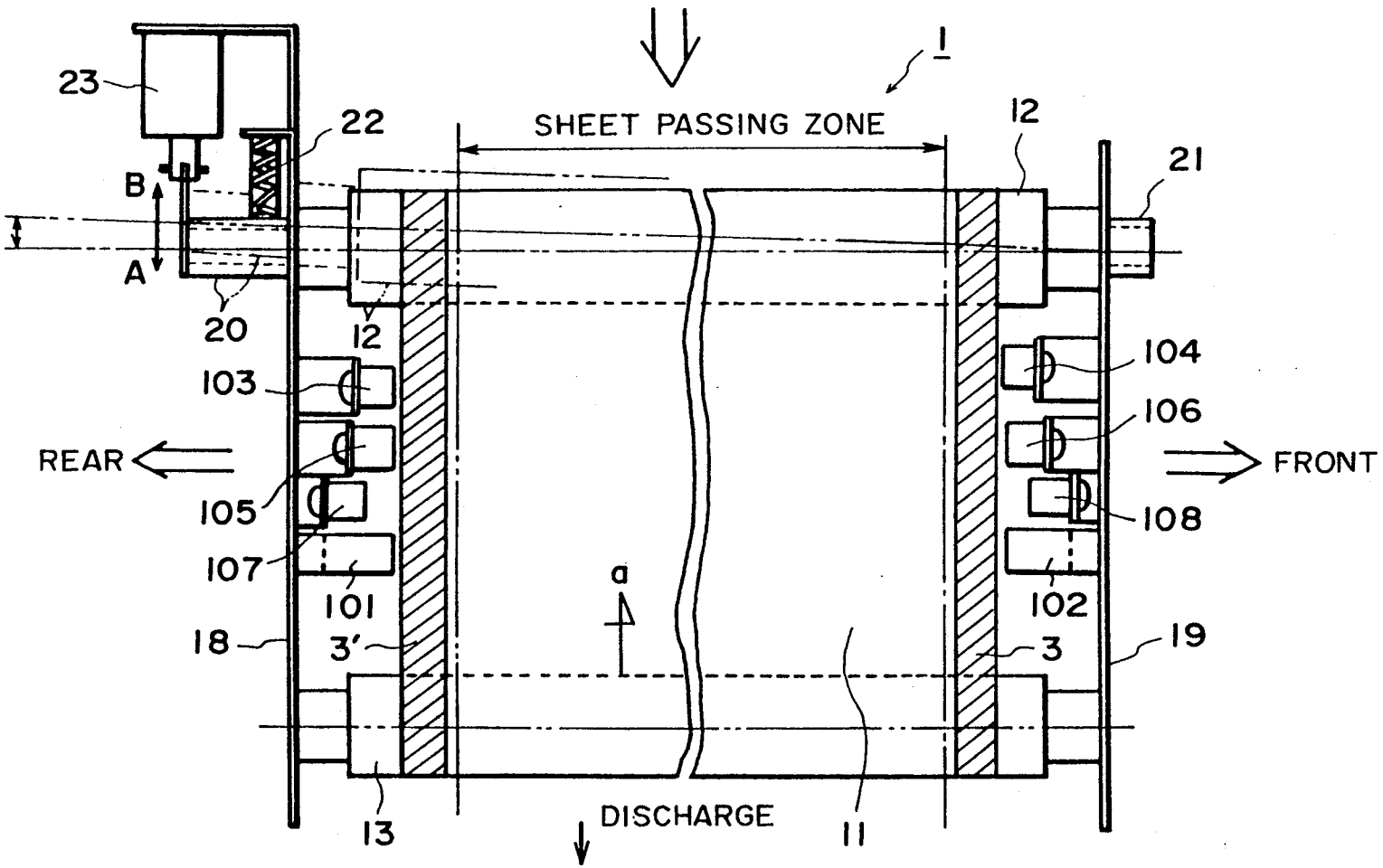
FIG. 15 is a plan view of yet another alternative embodiment of an image heating device in accordance with the present invention.

FIG. 15 is a partial plan view of the fixing device, lacking its middle section, and in this figure, the reference codes identical to those in the above mentioned FIG. 1 are assigned to the corresponding structural members and components, to spare redundant descriptions.

Reference numerals 103, 104, 105, 106, 107, and 108 refer to photosensors which detect the film position.

The sensors 105 and 106 are located to detect the film position on the inward side of the film position detected by the sensors 103 and 104, and the sensors 107 and 108 are located to detect the film position on the outward side of the film position detected by the sensors 105 and 106.

Both end portions 3 and 3' of the film 11 are given a masking treatment to interrupt the beam from the photosensors.

In this embodiment, photointerruptors are employed as the photosensor, but if the reflection type photosensors are employed, it is necessary to give both end portions 3 and 3' of the film 11 a reflective treatment so as to reflect the beam. Also, in this embodiment, the masking treatment and such are given only to both end portions, but needless to say, they may be given across the entire film. The film position may be read by the photosensor through a moving member which moves with the ends of film.

Reference numerals 101 and 102 refer to the cleaning members for the film ends, which constantly clean the film ends to prevent misreading caused by blots and the likes on the film ends when, for example, reflection type sensors are employed. In this embodiment, a felt material is employed, but it is not necessary to select a specific type of material as long as it is effective in cleaning.

Figure 16:
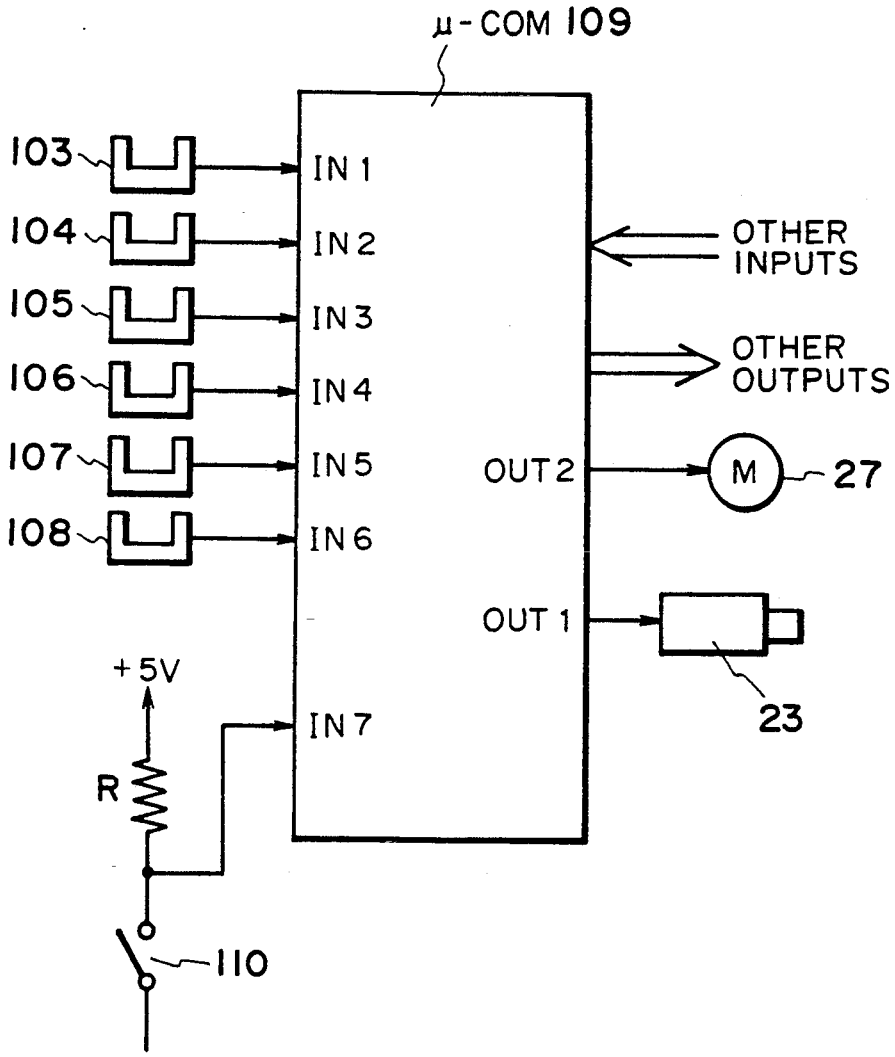
FIG. 16 is a schematic diagram of the control system of the alternative embodiment of the present invention.

Next, the schematic diagram of the electrical control is given in FIG. 16. Reference numeral 109 refers to a microcomputer, and to its input terminals IN 1, IN 2, IN 3, IN 4, IN 5, and IN 6, photosensors 103, 104', 105, 106, 107, and 108 are connected; to OUT 2, the rotation control signal for the motor, which drives this fixing device, is outputted; and to OUT 1, the solenoid 23 is connected.

Also, to the input terminal IN 7, switch 110 for selecting the lateral shift control range is connected, and the microcomputer 109 selects the lateral shift control range, based on the information from the input terminal IN 7. That is, if switch 110 is off (input terminal IN 7 indicates "H"), the first shift control range (sensors 105 and 106 are used) is selected, and if switch 110 is on (input terminal IN 7 indicates "L"), the second shift control range (sensors 103 and 104 are used) is selected.

Also, through not illustrated, the microcomputer 109 is provided with the terminals for the other input and output signals of the copying machine employing this fixing device. Within the microcomputer 109, the ROM, RAM, and the like, which store the copying operation sequence programs and such, are contained.

Figure 17:
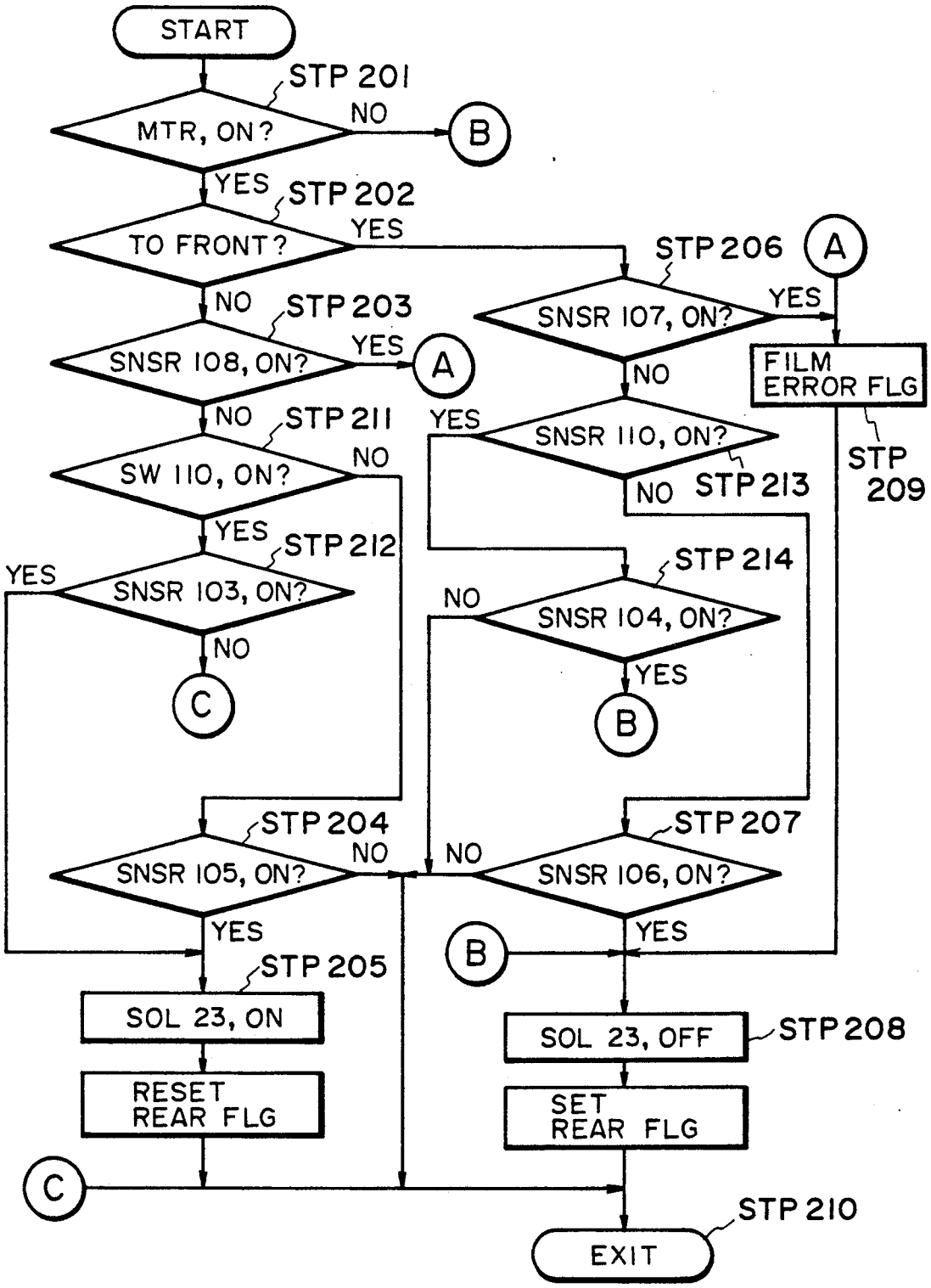
FIG. 17 is a flow chart for the control program.

FIG. 17 shows the lateral film shift control flow chart for the microcomputer 109. This is also stored in the internal ROM of the microcomputer 109 in the same manner as that in the first embodiment, land is called and executed by the main sequence program and such, at a predetermined interval or as needed.

In the step 201 immediately after the start, it is determined whether or not the motor 27 is on. If the motor 27 is on, step 202 is followed, and if the motor 27 is off, the lateral shift control is not executed and step 208 is followed, where the solenoid is turned off and the rear side flag is set, and then, the program proceeds to step 210, the exit, and to return to the main program.

Next, in the step 202, it is decided whether or not the film is controlled to shift to the front side. In this arrangement, the contents of the predetermined address of the RAM of the microcomputer 109 is set up as the rear side flag, and a decision is made depending on whether its memory status is 1 or 0. If the film is shifting rearward, in other words, if the rear side flag indicates 1, step 203 is followed.

In the step 203, it is decided whether or not the sensor 108 is on, and if the sensor 108 is not on, step 211 is followed.

In the step 211, it is determined whether or not the switch 110 is on. If the switch 110 is on, this means the second control range; therefore, step 212 is followed. If the switch 110 is not on, this means the first control range; therefore, step 204 is followed.

In the step 212, it is decided whether or not the sensor 103 is on, and if it is on, step 205 is followed.

In the step 205, the film has shifted rearward to the rear side limit of the second control range, turning on the sensor 103; therefore, the solenoid 23 is turned on to start shifting the film frontward, and simultaneously, the rear side flag is reset, and then, the program proceeds to the step 210, the exit.

Also, in the step 212, if the sensor 103 is not on, the program is skipped to the step 210, the exit.

In the step 204, it is decided whether the sensor 105 is on, and if it is on, step 205 is followed.

In the step 205, the lateral film shifts rearward beyond the first control range, turning on the sensor 105; therefore, the solenoid 23 is turned on, and simultaneously, the rear side flag is reset, and then, the program proceeds to the step 210, the exit.

Also, in the step 204, if the sensor 105 is not on, the program is skipped to the step 210, the exit.

Also, in the step 203, if the sensor 108 is on, in other words, if the lateral film has shifted further to the frontward direction even through it is being controlled to shift rearward, step 209 is followed, where a film anomaly flag is set, and then, the step 208 is followed, where the solenoid 23 is turned off and the rear side flag is reset, and then, the step 210 is followed, returning to the main sequence.

In the step 202, if the film is shifting frontward in the same manner as the above, in other words, if the rear side flag is 0, step 206 is followed. In the step 206, it is decided whether or not the sensor 107 is on, and if the sensor 107 is on, in other words, if the lateral film has shifted further to the rearward direction even though it is being controlled to shift frontward, the step 209 is followed to return to the main program in the same manner as the above.

Also, in the step 206, if the sensor 107 is off, step 213 is followed, where it is decided whether or not the switch 110 is on.

If the switch 110 is on, this means the second control range; therefore, step 214 is followed. If it is not on, this means the first control range; therefore, the step 207 is followed.

In the step 214, it is determined whether or not the sensor 104 is on. At this time, if the sensor 104 is not oh, the program skips to the step 210 to return to the main program, and if the sensor 104 is on, the step 208 is followed, where the solenoid 23 is turned off; the control is switched to make the film shift rearward; and simultaneously, the rear side flag is set, and then, the step 210 is followed to return to the main program.

In the step 207, it is decided whether or not the sensor 106 is on. At this time, if the sensor 106 is not on, the program skips to the step 210 to return to the main program, and if the sensor 106 is on, the step 208 is followed, wherein the solenoid 23 is turned off; the control is switched to make the film shift rearward; and simultaneously, the rear side flag is set, and then, the program proceeds to the step 210, returning to the main program.

As for the error processing, it is the same as in the case of the first embodiment.

Also, the switch for selecting the shift control range on the rear side and the switch for selecting the shift control range on the front side may be separately prepared as those in the second embodiment. As for the control flow for this arrangement, the switch in the step 213 and the switch in the step 211, in FIG. 17, become the front side selection switch and the rear side selection switch, respectively, and the other operations are identical.

FOURTH EMBODIMENT (FIGS. 18 AND 19)

This embodiment pertains to an alternative structure of the electrical control system and its control flow chart for the above mentioned third embodiment.

Figure 18:
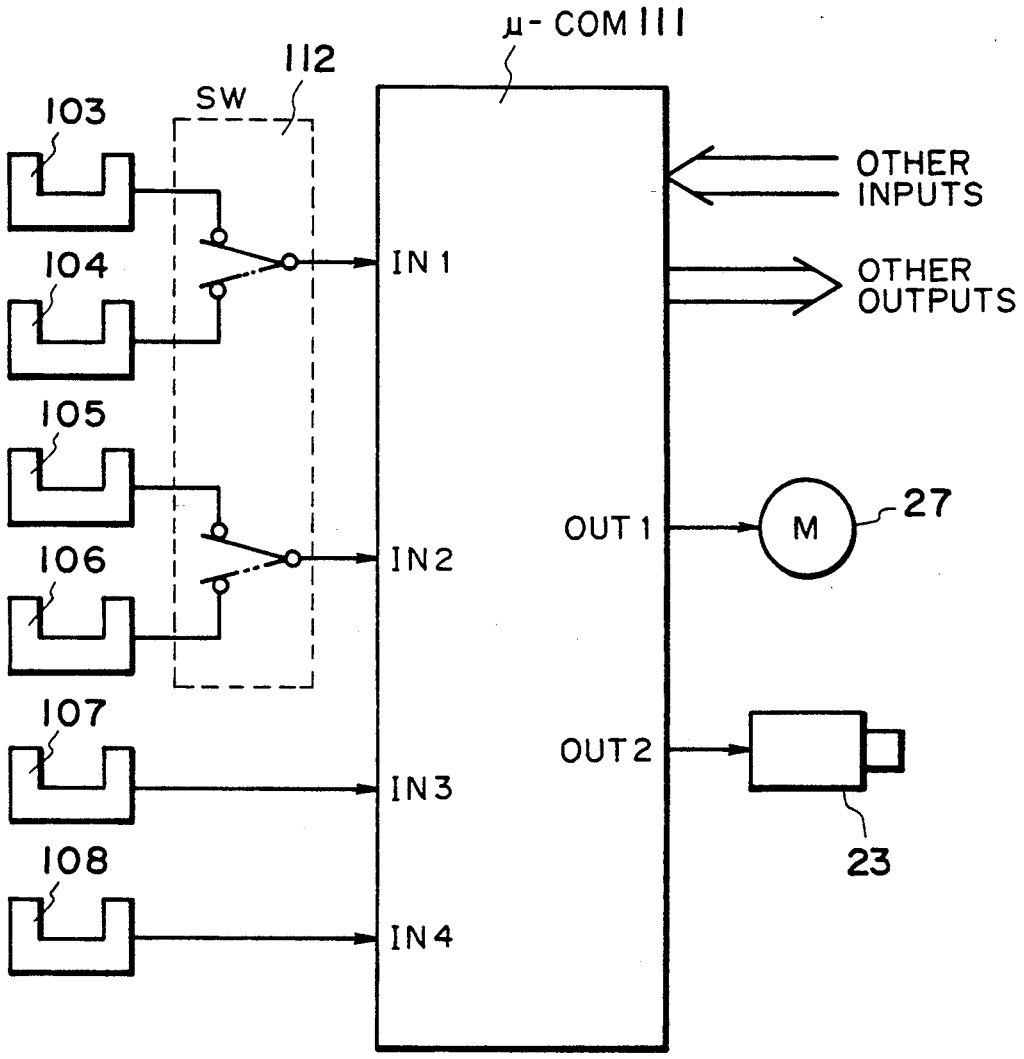
FIG. 18 is a schematic diagram of the control system in the alternative embodiment of the present invention.

In the control system in FIG. 18, reference numeral 111 refers to a microcomputer, and to its input terminals IN 1 to IN 4, the signals from the photosensors 103 to 108 are inputted. To the input terminal IN 1, the signals from the photosensor 103 and 105 selected by the switch 112 are inputted, and to the input terminal IN 2, the signals from the photosensors 104 and 106 selected by the switch 112 are inputted. The other operations are the same as those in the third embodiment.

As is shown in FIG. 15, the sensors 105 and 106 detect the film position on the further outward side of the film position detected by the sensors 103 and 104; therefore, the lateral film shift control range can be selected by using the switch 112 in FIG. 18 to switch the input signal to the microcomputer 111. Also, the switch 112 does not need to be of an interlocking type such as the one in FIG. 18. Instead, it may be of a type which can be independently switched.

Figure 19:
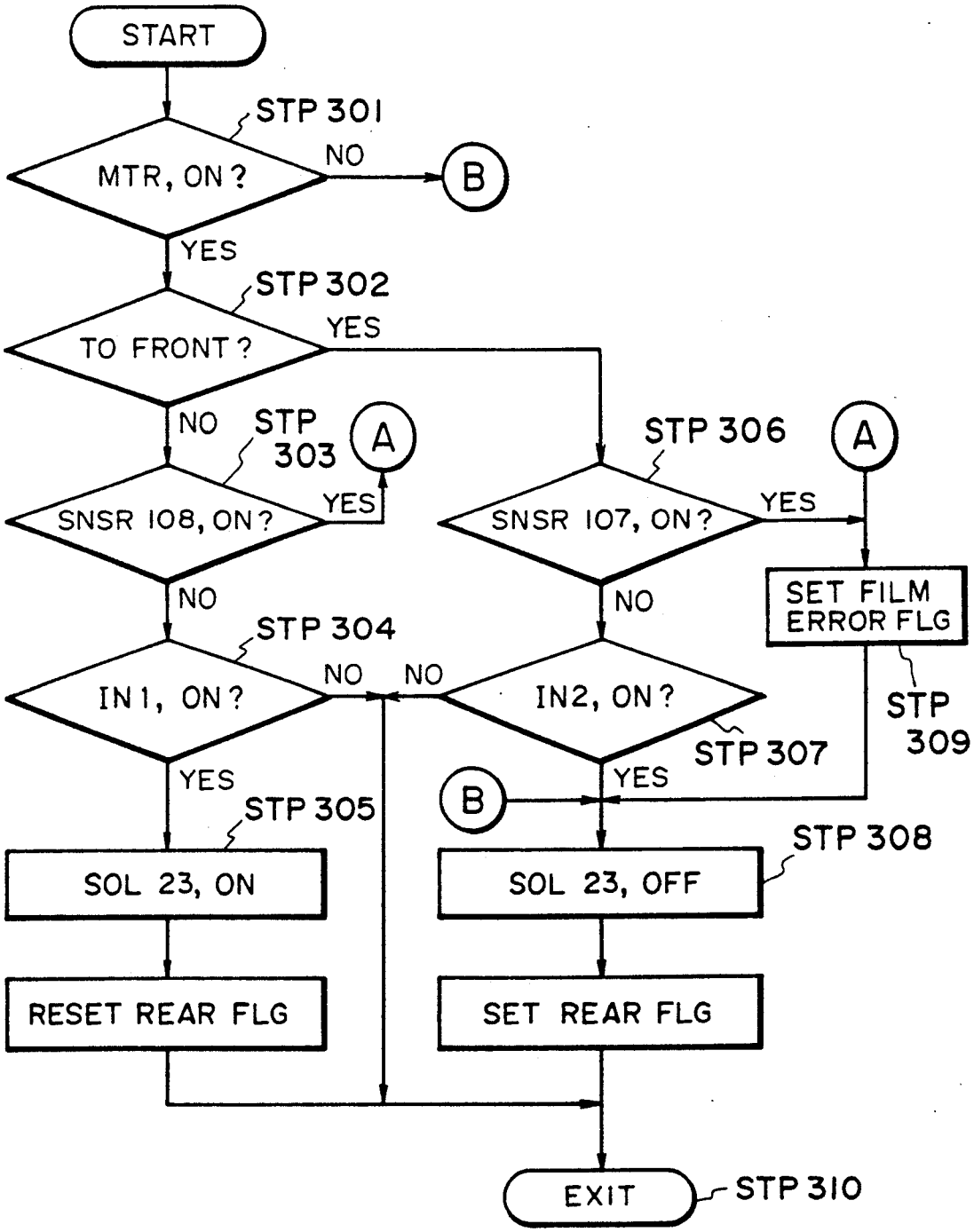
FIG. 19 is a flow chart for the control program.

Hereinafter, the shift control flow chart for the microcomputer Ill is described, referring to FIG. 19. This program is also stored in the internal ROM of the microcomputer 111 in the same manner as in the case of the first embodiment, and is called and executed by the main sequence program and such, at a predetermined interval or as needed.

First, in step 301 immediately after the start, it is determined whether or not the motor 27 is on. If the motor 27 is on at this time, step 302 is followed, and if the motor 27 is off, the shift control is not executed and step 308 is followed, where the solenoid is turned off and the rear side flag is set, and then, the program proceeds to step 310, returning to the main program.

Next, in the step 302, it is decided whether or not the film is shifting toward the-front side. In this arrangement, the contents of the predetermined address of the RAM of the microcomputer Ill is set up as the rear side flag, and a decision is made, depending on whether its memory status is 1 or 0. If the film is shifting rearward, in other words, if the rear side flag indicates 1, step 303 is followed.

In the step 303, it is decided whether or not the sensor 108 is on, and if the sensor 108 is not on, step 304 is followed.

In the step 304, it is determined whether or not the input port IN 1 is on, and if it is on, step 305 is followed.

In the step 305, because the film has shifted rearward, turning the sensor on, the solenoid 23 is turned on to make the film shift frontward, simultaneously setting the rear side flag, and then, the program proceeds to the step 310, the exit.

Also, in the step 304, if the input port IN 1 is not on, the program skips to the step 310, the exit.

In the step 303, if the sensor 108 is on, in other words, if the film has shifted further to the frontward direction even if the control is being executed to make the film shift rearward, step 309 is followed, wherein the film anomaly flag is set, and then, the step 308 is followed, where the solenoid 23 is turned off; the rear side flag is reset; and the step 310 is followed to return to the main sequence.

In the step 302, if the film is shifting frontward, in other words, if the rear side flag indicates 0, the step 306 is followed.

In the step 306, it is decided whether or not the sensor 107 is on, and if the sensor 107 is on, in other words, if the film has shifted further rearward even though the control is being executed to make the film shift to the frontward direction, the program goes to the step 309 to return to the main program in the same manner as in the above.

Also, in the step 306, if the sensor 107 is off, the step 307 is followed, where it is decided whether or not the input terminal IN 2 is on. If the input terminal IN 2 is not on, the program skips to the step 310 to return to the main program, and if the input port IN 2 is on, the step 308 is followed, wherein the solenoid 23 is turned off; the control is switched to make the film shift rearward; and simultaneously, the rear side flag is set, and then, the program proceeds to the step 310 to return to the main program.

FIFTH EMBODIMENT (FIGS. 20 TO 22)

This embodiment pertains to another alternative embodiment of the film position detecting means.

Figure 20:
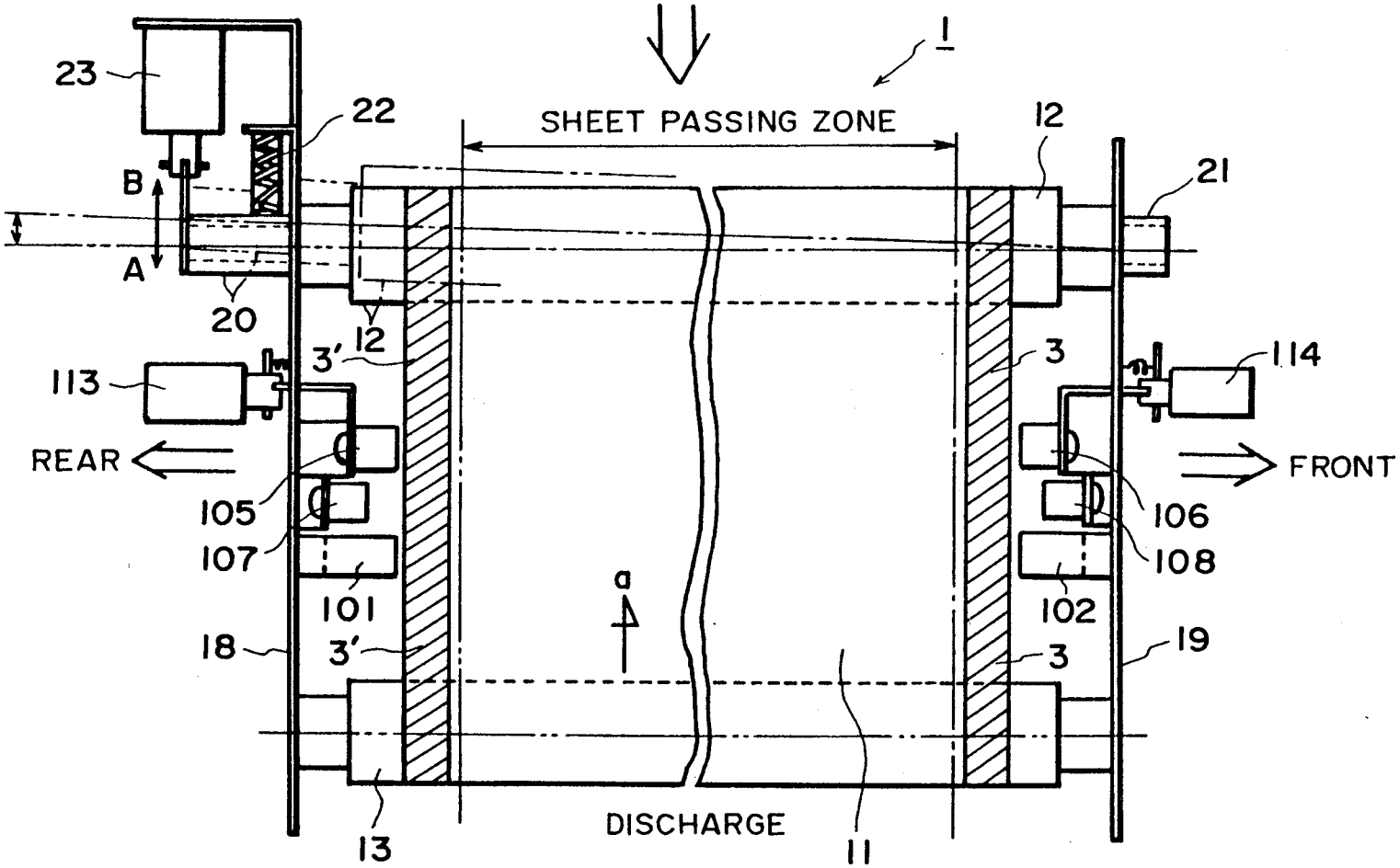
FIG. 20 is a partial plan view of another alternative embodiment of the heating device in accordance with the present invention.

In this embodiment, the photosensors 105 and 106 are movable in the direction perpendicular to the side plates 18 and 19, to select the lateral shift control range, as is shown in FIG. 20. In other words, the photosensors 105 and 106 are movable along the rail (not illustrated) mounted perpendicular to the side plates 18 and 19. Reference numerals 113 and 114 refer to solenoids to move the photosensors 105 and 106. When the solenoids 113 and 114 are on, the photosensors 105 and 106 detect the film position on the outward sides.

Figure 21:
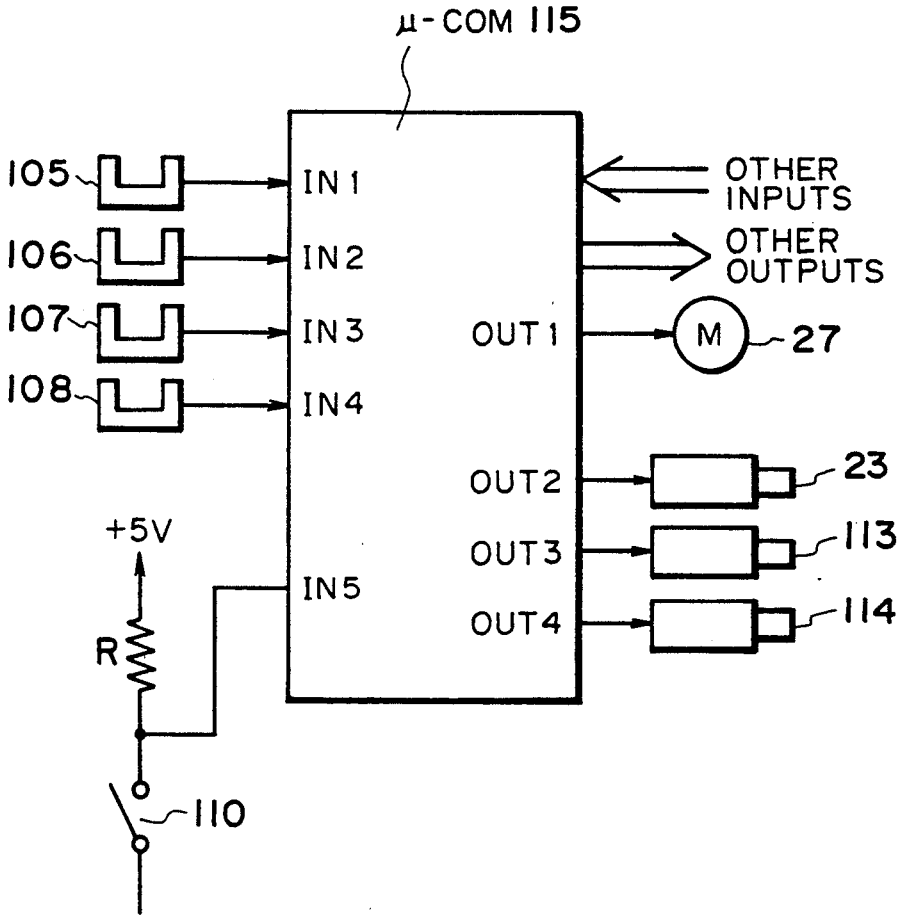
FIG. 21 is a control circuit diagram of the alternative embodiment of the present invention.

In the electrical control system in FIG. 21, reference numeral 115 refers to a microcomputer. To its input terminals IN 1, IN 2, IN 3, and IN 4, the photosensors 105, 106, 107, and 108 are connected, respectively, and to its output terminal OUT 1, the rotation control signal for the motor, which drives this fixing device, is outputted. To the output terminal OUT 2, the solenoid 23 is connected, and to the output terminals OUT 3 and OUT 4, the solenoids 113 and 114 are connected, respectively. Reference numeral 110 refers to the lateral shift control range selection switch, and when it is on (IN 5 indicates "L"), the solenoids 113 and 114 are off. When the switch 110 is not on, the solenoids 113 and 114 are on.

When the solenoids 113 and 114 are on, the photosensors 105 and 106 move outward along the rail. This arrangement makes it possible to use the switch 110 to move the photosensors 105 and 106 perpendicularly to the side plates 18 and 19, thereby selecting the shift control range.

As for the shift control flow chart for this embodiment, it is the same as the one for the fourth embodiment.

Figure 22A:
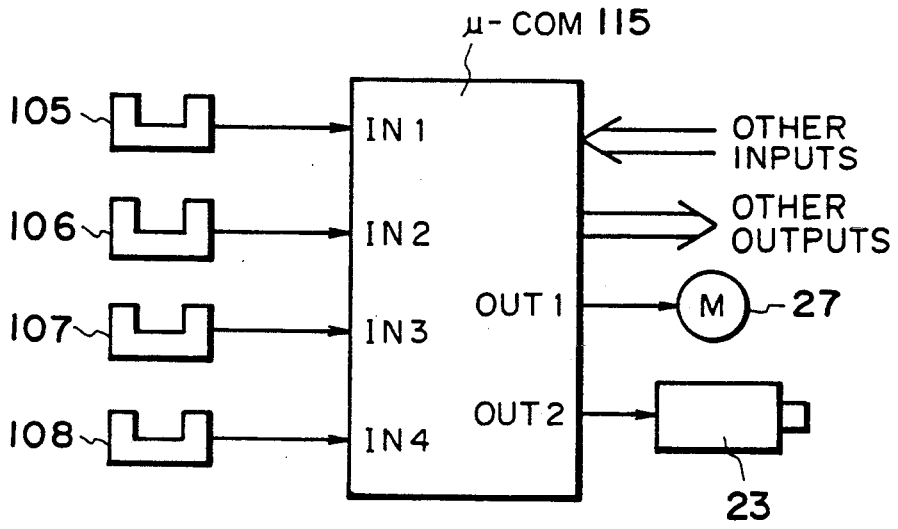
FIGS. 22(*a* and *b*) are schematic diagrams for the control systems of the alternative embodiments of the present invention.
Figure 22B:
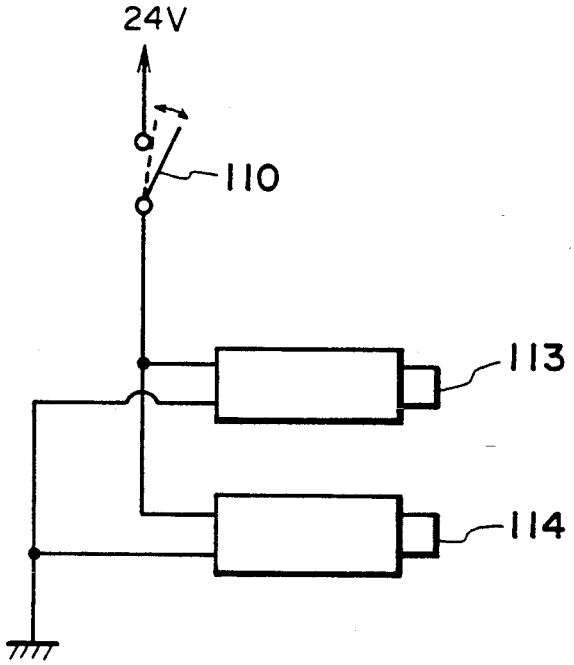

As the control system in FIG. 22 shows, the shift control selection switch 110 may be used for directly turning on/off the power supply to drive the solenoids 113 and 114 in order to make a selection.

Also, two switches may be provided to independently control the solenoids 113 and 114. A lever may be provided instead of the switch, so that the photosensors move along the rail, corresponding to the lever movement, through a linking mechanism.

When the lateral shift control is executed in conjunction with the film type heating system, the temperature variation is large, and this temperature variation has a great effect on the lateral shifting force.

Yet another alternative embodiment is described which is capable of handling this temperature variation.

Figure 23:
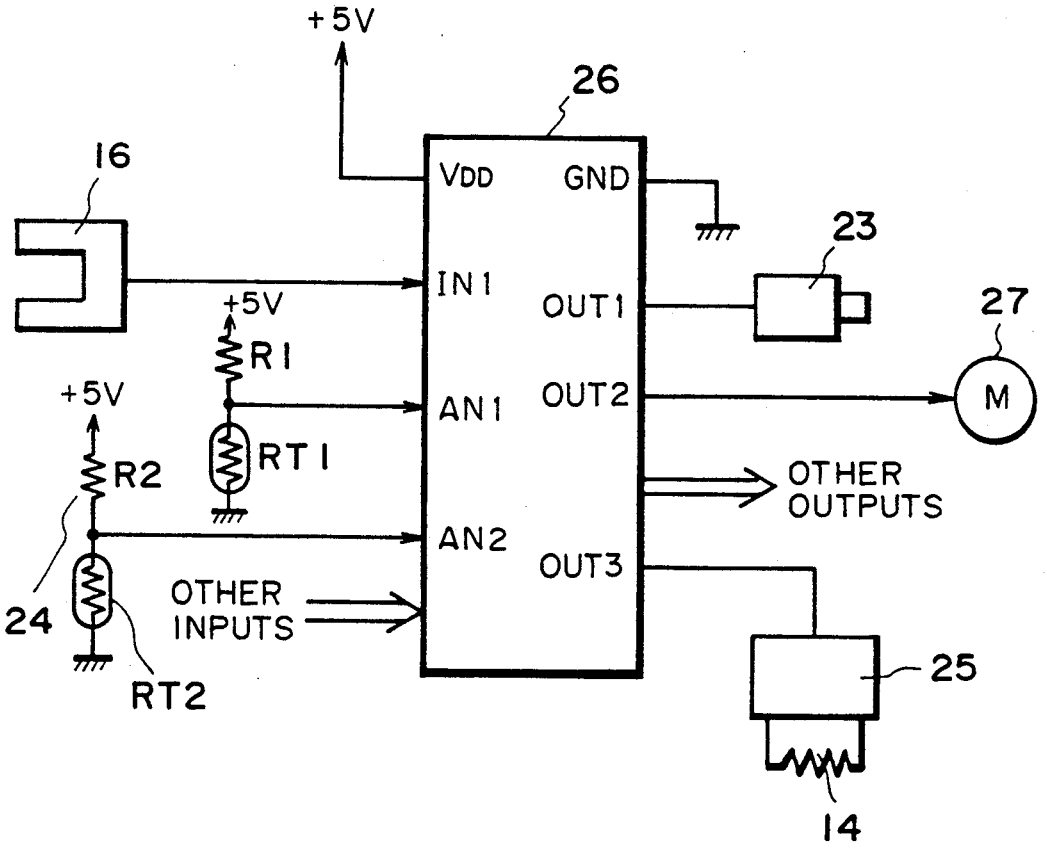
FIG. 23 is a schematic diagram of yet another alternative embodiment of the present invention.
Figure 24:
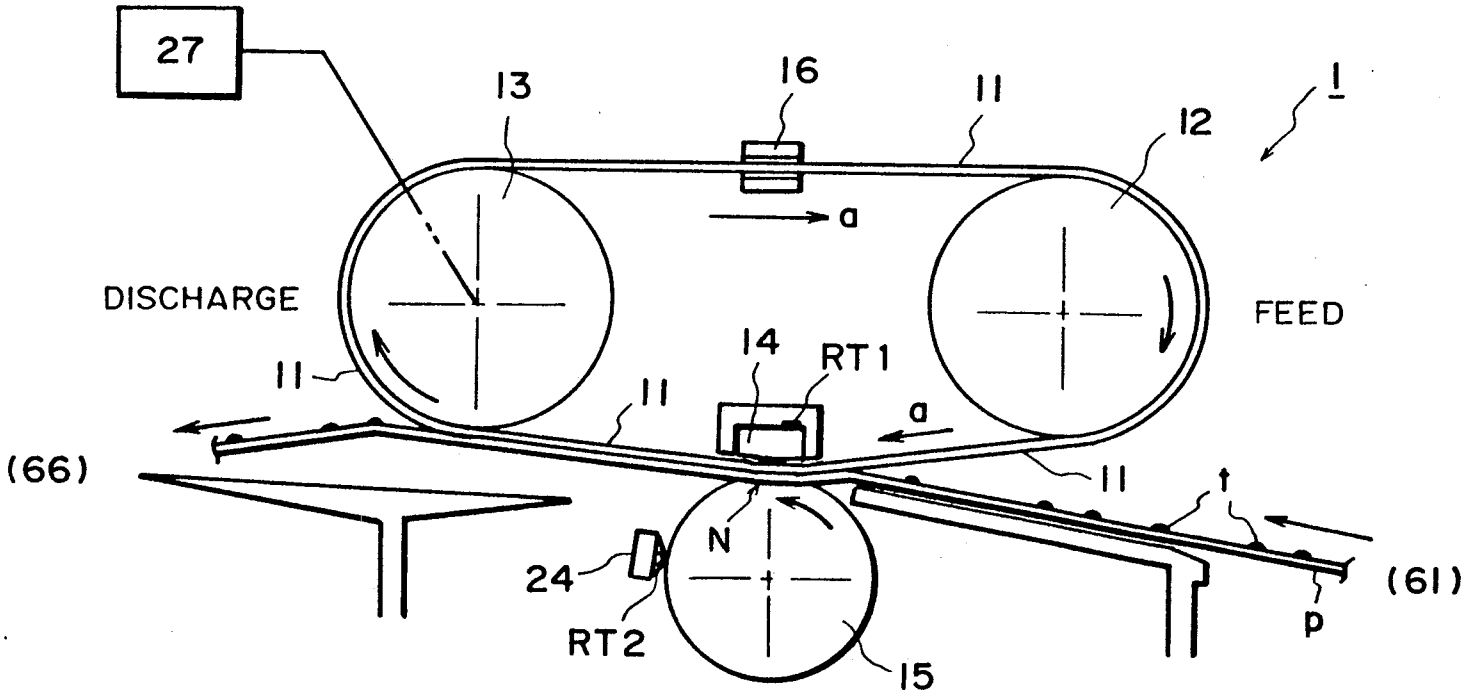
FIG. 24 is a sectional view of the alternative embodiment of a heating device in accordance with the present invention.

FIG. 23 shows the control circuit of this embodiment and FIG. 24 is a sectional view of this embodiment.

Reference numeral 26 refers to a microcomputer, and to its input terminal IN 1, the above mentioned photosensor 16 is connected. To an output terminal OUT 1, the solenoid 23 is connected. To the output terminal OUT 2, the rotation control signal for the motor 27, which drives this fixing device, is outputted.

To the $V_{DD}$ terminal, the power source of +5 V is connected, and the GND terminal is connected to ground.

Though not illustrated, the microcomputer 26 is provided with the terminals for the other input and output signals of the copying machine employing this fixing device, and also, within this microcomputer 26, the non-volatile RAM, the memory contents of which is not erased even when the power supply to this microcomputer 26 is interrupted, is contained together with the ROM, RAM, and the like which store the sequence program and such for the copying operation of this copying machine.

Also, to an analog input port AN 1 of the microcomputer 26, the temperature information detected by a first thermistor RT 1 (FIG. 24), which detects the temperature of the above mentioned heater 14, is inputted. In order to control the temperature of the heater 14 (maintain a target temperature), the microcomputer 26 sends to a heater power supply circuit 25 such signals for maintaining the temperature of the heater 14 approximately at a predetermined temperature, which is detected by this thermistor RT 1.

Figure 25:
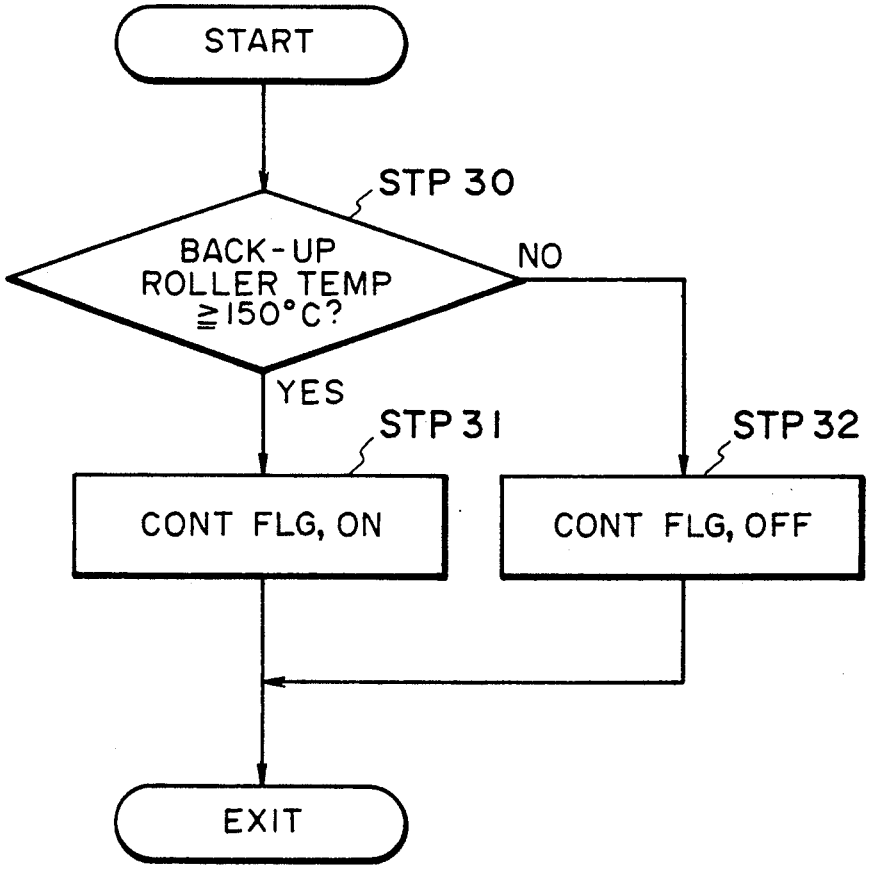
FIG. 25 is a control flow chart for the embodiment of the heating device shown in FIG. 24.

To an analog input port AN 2 of the microcomputer 26, the temperature information detected by a second thermistor RT 2 (FIG. 24), which detects the temperature of the above mentioned pressing roller 15, is inputted. As the flow chart in FIG. 25 shows, the microcomputer 26 turns on the lateral shift control flag if the temperature of the pressing roller 15 is higher than the predetermined temperature, for example, 150° C. (step 30→step 31), and turns off the lateral shift control flag if it is below 150° C. (step 30→step 32). Then, as will be described later, the lateral shift control range is switched, depending on this flag, between the first lateral shift control range and the second lateral shift control range which is narrower than the first lateral shift control range.

As for the flow chart for the lateral shift control, it is the same as the one in FIGS. 8 to 11.

Figure 26:
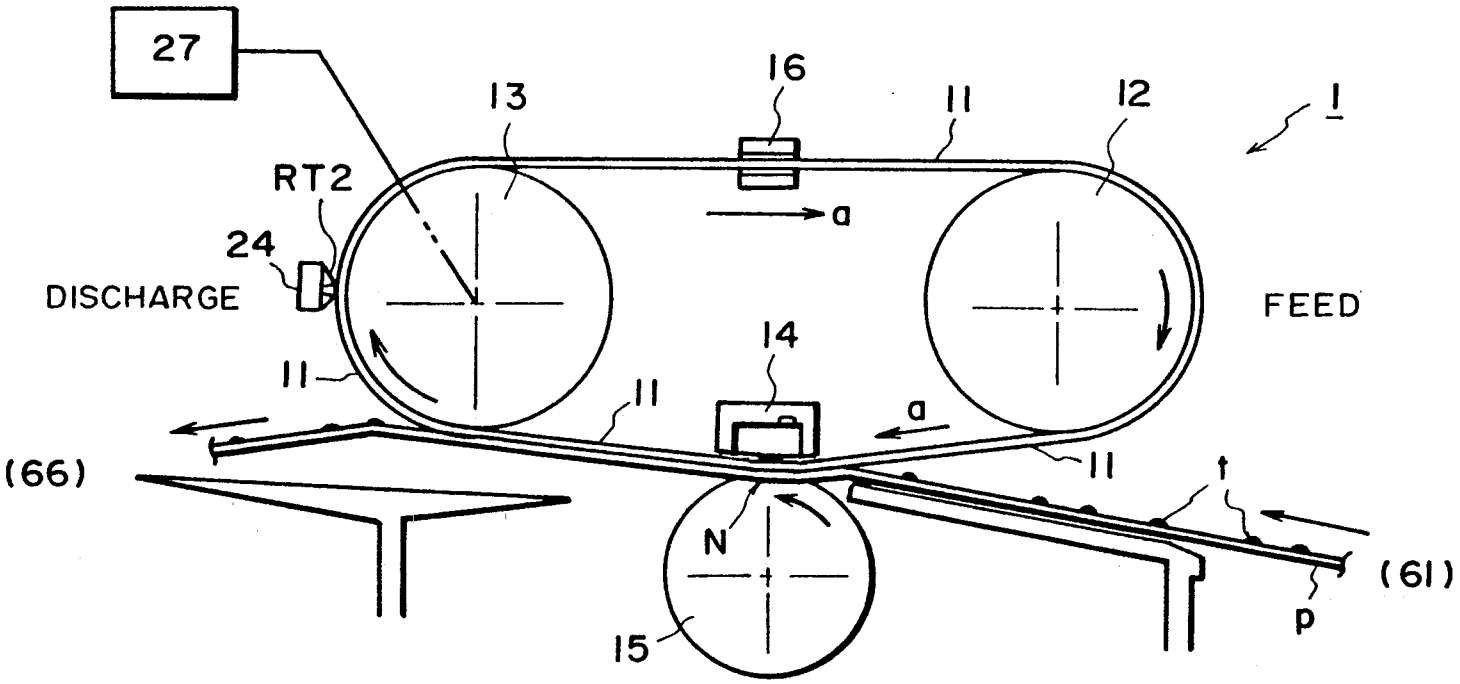
FIG. 26 is a partial plan view showing yet another alternative embodiment of heating device in accordance with the present invention.

FIG. 26 shows a sectional view of another alternative embodiment of the present invention.

In this embodiment, the temperature of the fixing film is detected, whereby the lateral shift control range is changed depending on this temperature of the fixing film. A thermistor unit 24 is mounted in contact with the surface of the fixing film 11 at the location of the driving roller 13, detecting the temperature of the fixing film 11. Then, if the temperature of the fixing film 11 is higher than the predetermined temperature, the lateral shift control is executed within the second lateral shift control range, and otherwise, it is done within the first lateral shift control range. The other structures and controls are the same as those in the first embodiment.

Further, the thermistor 24 may be mounted on the other structural components of the fixing device, such as driving roller 13, follower roller 12, side plates 18 and 19, or the like, so that the lateral shift control range can be switched depending on the temperature of the chosen components.

Figure 27:
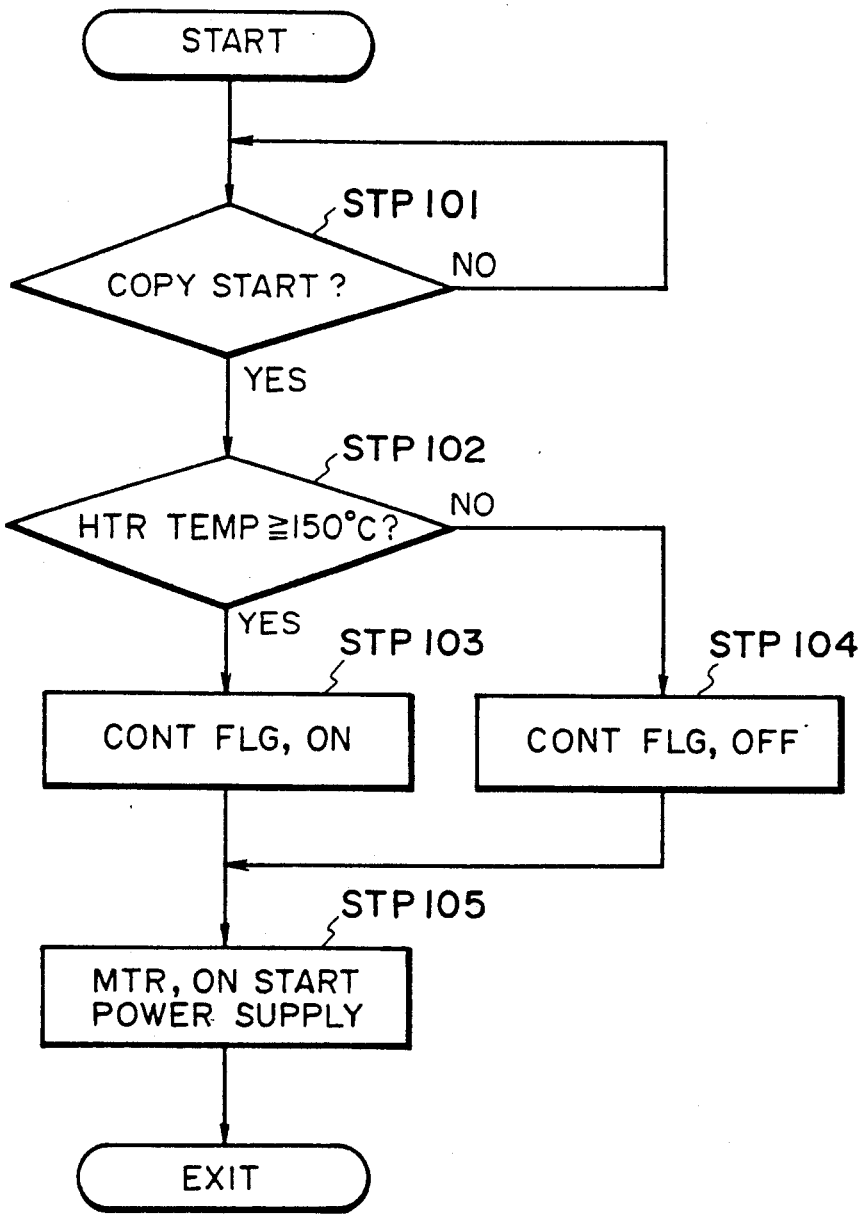
FIG. 27 is a flow chart for the lateral film shift control program for the device shown in FIG. 26.

FIG. 27 is a flow chart for one of the alternative embodiments of the present invention.

In this embodiment, the thermistor RT 1, which detects the temperature of heater 14 is used to switch the lateral shift control range.

In the step 101, it is determined whether or not the copying operation has been started. If the copying operation has begun, the step 102 is followed. In the step 102, the temperature of the heater 14 is determined based on the value of the thermistor RT 1, and if this temperature is higher than a predetermined temperature, for example, 150° C., the step 103 is followed, where the lateral shift control flag is turned on. If the temperature of the heater 14 is below 150° C., the step 104 is followed, where the lateral shift control flag is turned off. Then, the step 105 is followed, where the motor is turned on and the power supply to the heater is started, exiting this routine.

As is shown in this embodiment, the amount of heat reserve in the fixing device can be determined based on the heater temperature detected before the power supply to the heater is started, whereby the lateral shift control range can be switched to obtain the same effects.

Also, thermistors 28 and 29 may be mounted on both side plates, that is, the front side plate 19 and rear side plate 18, of the fixing device 1, and the temperatures on the front and rear sides of the device are detected, respectively. Then, the lateral shift control range may be switched between the front side lateral shift control range and the rear side lateral shift control range, depending on the temperature difference between the front and rear sides.

For example, when the temperature of the front side plate is more than 50° C. higher than the temperature of the rear side plate, the front side lateral shift control range is established to be 2d/5 seconds and the rear side lateral shift control is established to be 3d/4 seconds. By having this arrangement, the lateral film shift can be stably controlled even if a temperature difference occurs between the front and rear sides.

Next, another embodiment is described which is capable of handling the fluctuation of the lateral shifting force after prolonged usage.

Figure 28:
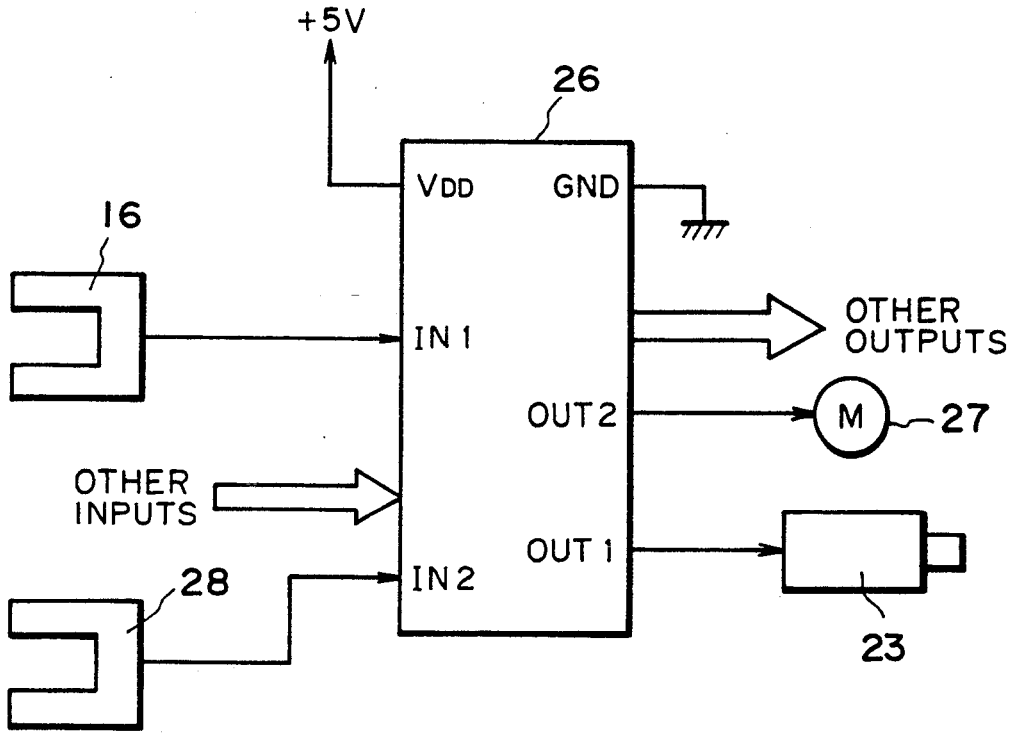
FIG. 28 is a schematic diagram of the control system of another alternative embodiment of the present invention.

FIG. 28 is a schematic diagram of the control circuit of this alternative embodiment of the present invention.

Reference numeral 26 refers to a microcomputer, and to its input terminal IN 1, the above mentioned photosensor 16 is connected. Also, to the output terminal OUT 1, the solenoid 23 is connected. To the output terminal OUT 2, the rotation control signal for the motor 27, which drives this fixing device, is outputted.

To the $V_{DD}$ terminal, the power source of +5 V is connected, and the GND terminal is connected to ground.

Though not illustrated, this microcomputer 26 is provided with the terminals for the other input and output signals of the copying machine employing this fixing device, and within this microcomputer 26, the non-volatile RAM, the memory contents of which is not erased even when the power supply to this microcomputer is interrupted, is contained together with the ROM, RAM, and the like which store the sequence program of the copying operation of this copying machine.

Also, to the input port IN 2 of the microcomputer 26, a photosensor 28, which will be described next, is connected as a means for computing the length of the prolonged usage of the device.

Figure 29:
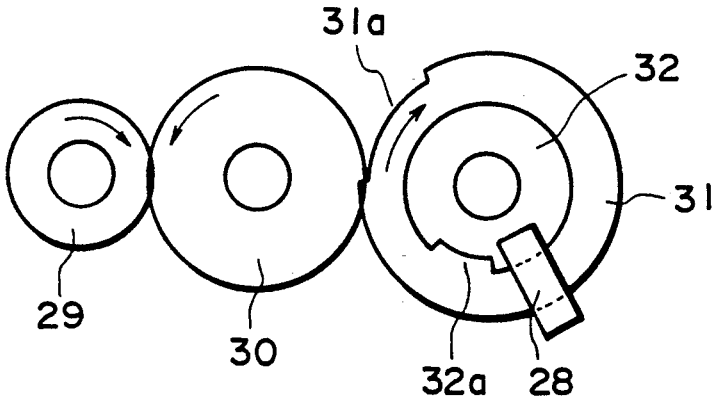
FIG. 29 is a schematic diagram showing an example of a means for measuring the film driving time.

FIG. 29 shows the computing means 28 of this embodiment.

In more concrete terms, as is shown in FIG. 29, a gear 29 is mounted on the axis of the film driving roller, and as the film is driven, the rotation of this gear, that is, the length of driving time of the film, is passed through an intermediary gear 30 onto a gear 31.

Reference numeral 32 designates a beam interrupter plate mounted on the axis of the gear 31, and when the position of a cutout section 32*a* of the beam interrupter plate 32 coincides with the position of a photosensor 28, the beam passage to this sensor 28 becomes open, whereby the sensor 28 is turned on. At this moment, the toothless section 31*a* of the gear 31 moves into the position to face the gear 30, losing the gear engagement, and after this moment, the gear 31 does not rotate, in other words, the beam interrupter plate 32 does not rotate, even if the film is being driven.

Thus, in this embodiment, the lateral film shift control is executed within the first lateral shift control range until the photosensor 28 is turned on, determining that the length of film driving time has reached a predetermined length, that is, while the sensor is off; and after the sensor is turned on, the lateral film shift control is executed within the second lateral shift control range.

FIGS., 30, 31, and 32 present a case of yet another alternative embodiment of the present invention.

In this embodiment, the prolonged device usage is computed by a copy sheet counter.

Figure 30:
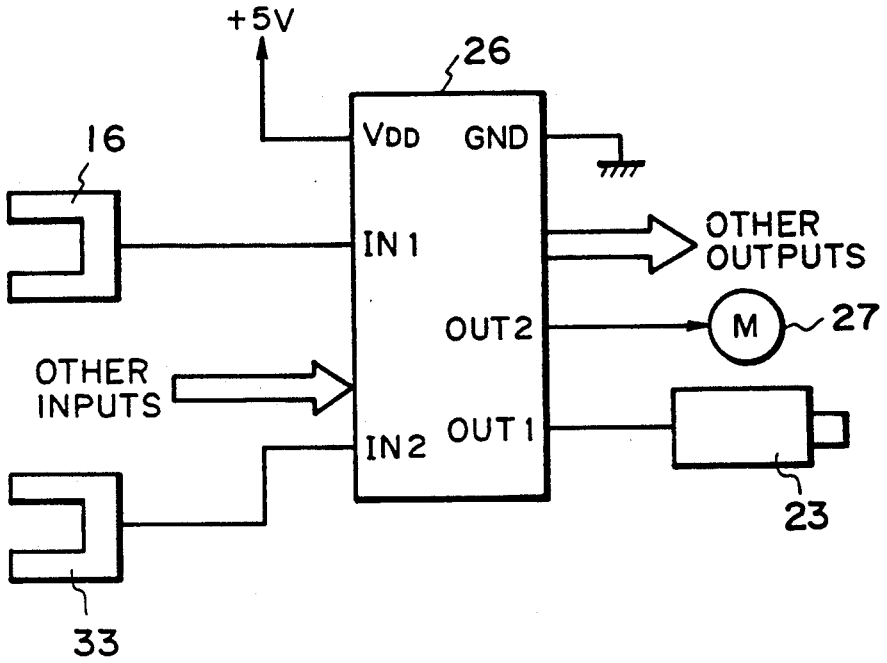
FIG. 30 is a schematic diagram of the control system of another alternative embodiment of the present invention.
Figure 32:
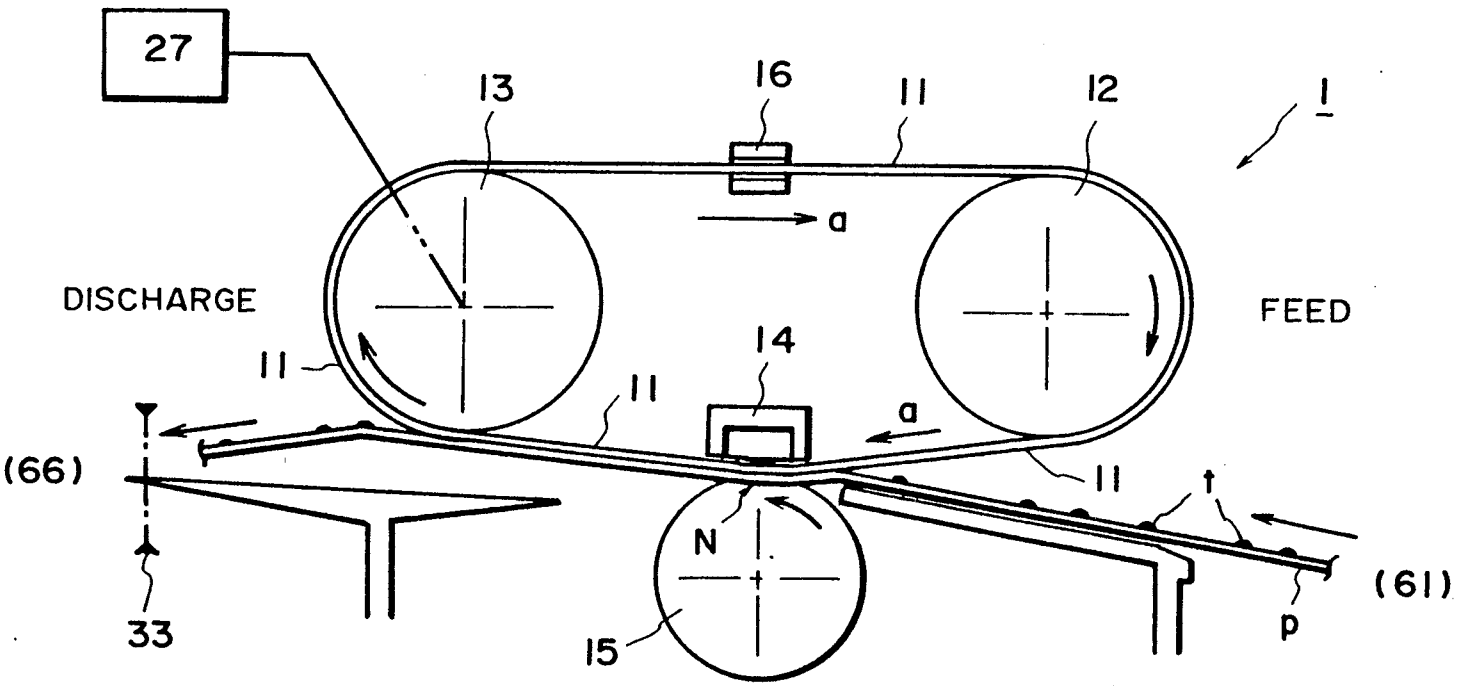
FIG. 32 is a sectional view of another alternative embodiment of heating device in accordance with the present invention.

That is, as is shown in FIG. 32, a sheet discharge sensor 33 is provided on the transfer material exit side of the fixing device 1, and the passage of the transfer material through the fixing device is detected by this sensor 33. The detection signal is inputted to a microcomputer 26, as is shown in FIG. 30, and the microcomputer counts the number of the transfer materials which have passed through the fixing device 1.

If the count value is less than, for example, 10,000, the lateral film shift control-is executed within the first lateral shift control range, and after it goes beyond 10,000, the control is executed within the second lateral shift control range (<first lateral shift control range).

Figure 31:
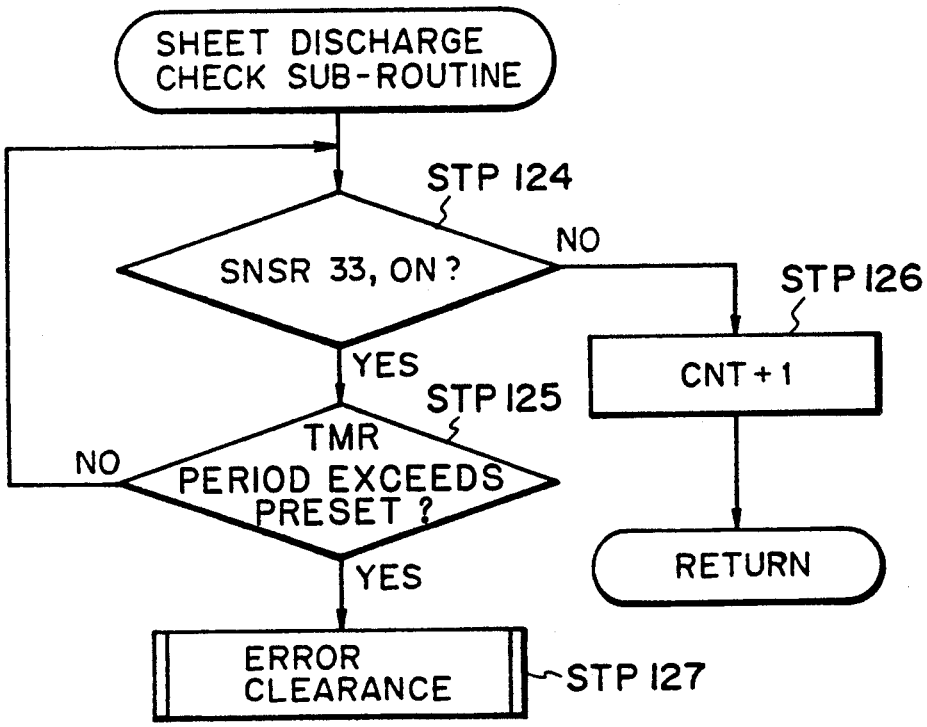
FIG. 31 is a flow chart for the alternative embodiment of the present invention.

The subroutine for counting the number of discharged sheets is shown in FIG. 31. This subroutine is a program which is called during the copy operation sequence, after the transfer material P enters the fixing device 1, turning on the sheet discharge sensor 33.

In step 124, it is determined whether the sheet discharge sensor 33 is on or off. If the sensor 33 is on, step 125 is followed.

In the step 125, the value of a jam error timer is checked. This timer is cleared when the transfer material P enters the fixing device 1, and if its value exceeds a predetermined length of time, it is determined that the transfer material is jammed in the fixing device 1; therefore, step 127 is followed, where the copying operation is halted.

If the timer value is less than the predetermined length of time, the program returns to the step 124. If the sensor 33 is off in the step 124, step 126 is followed. In the step 126, 1 is added to the discharge sheet count, and this count value is entered into the non-volatile RAM, and then, the program exits from this subroutine.

Instead of counting the copy count total by the discharge sheet sensor 33, other means, such as a sheet feed sensor or a sheet pass sensor of a transfer material conveying section may be employed for this purpose.

Figure 33:
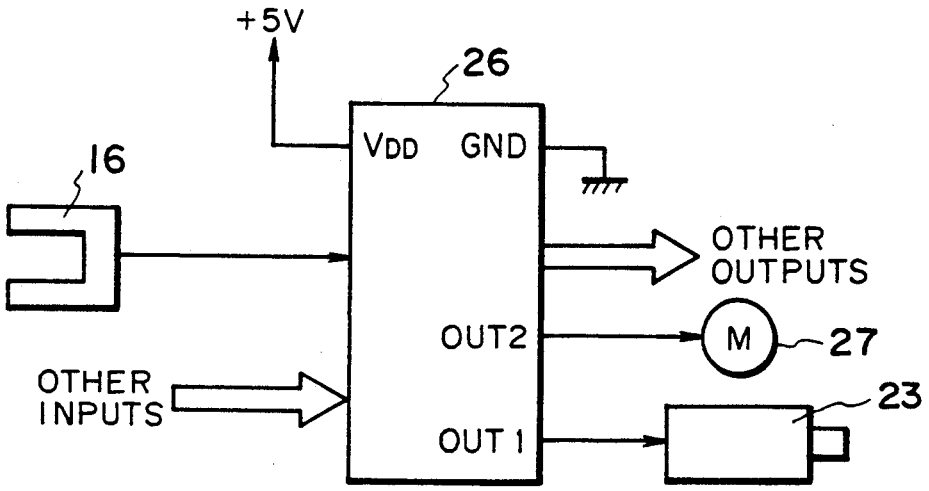
FIG. 33 is a schematic diagram of the control system of the alternative embodiment of the present invention.
Figure 34:
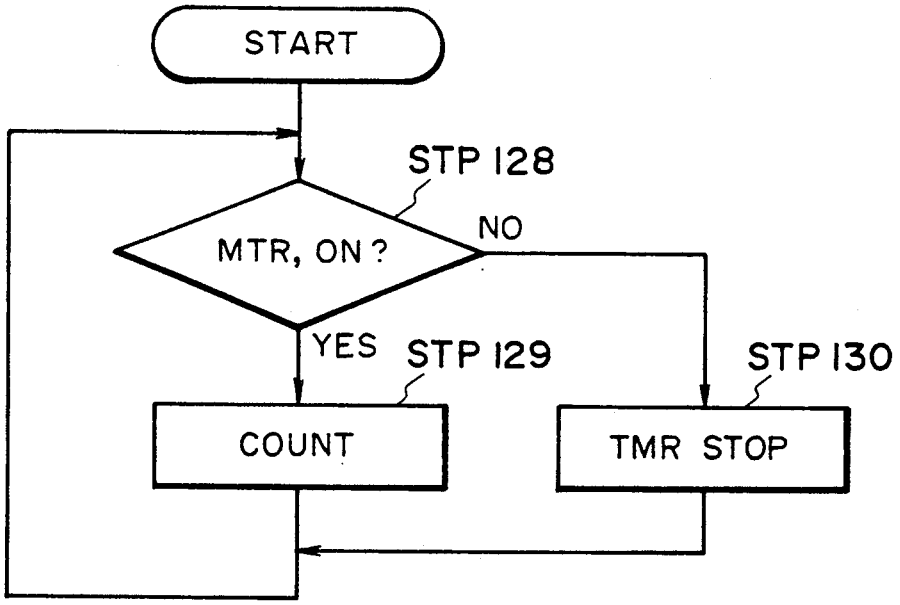
FIG. 34 is a flow chart for the alternative embodiment of the present invention.

FIGS. 33 and 34 present a case of another alternative embodiment.

In this embodiment, the prolonged usage is measured by a timer for the length of film driving time.

FIG. 33 is a schematic diagram of the electrical control.

As is shown by the flow chart in FIG. 34, the timer for the length of film driving time detects whether the motor is on or off, and it stays on only when the motor is on.

Next, an example of the alternative way to detect the film position is described.

Figure 35:
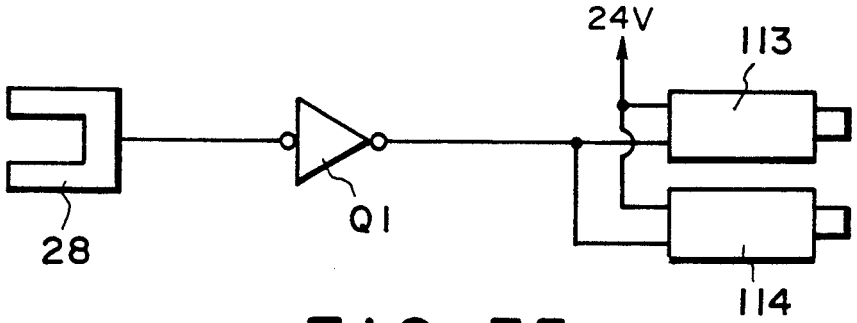
FIG. 35 is a control circuit for the alternative embodiment of the present-invention.

As for the fixing device and the electrical control circuit, the one shown in FIG. 20 and the those shown in FIG. 22(*a*) and FIG. 35 are employed, respectively.

The sensor 28 is a sensor to detect the length of film driving time. Q1 is a driver circuit for driving the solenoids 113 and 114, and when the sensor 28 is off, the solenoids are on.

Though not illustrated, a microcomputer 115 is provided with terminals for the other input and output signals of the copying machine employing this fixing device 1. Within the microcomputer 115, the ROM, RAM, and the like are contained, in which the copying operation sequence program and such for the copy machine are stored.

Figure 36:
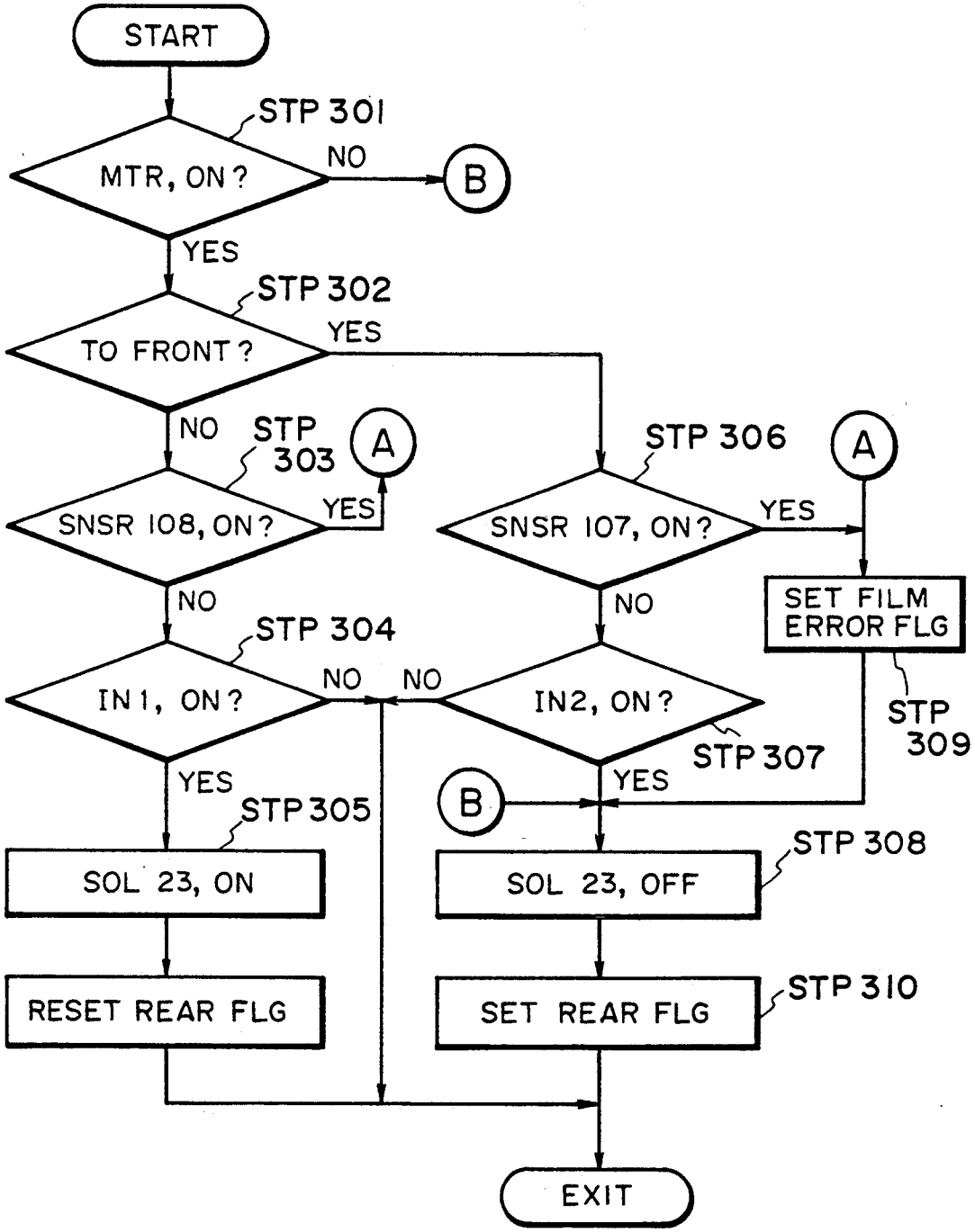
FIG. 36 is a flow chart for the alternative embodiment of the present invention.

FIG. 36 is a flow chart for the lateral film shift control executed by the microcomputer 115. This program is stored in the internal ROM of the microcomputer 115, and is called and executed by the main sequence program, at a predetermined interval or as needed.

In step 301 immediately after the start, it is determined whether the motor 27 is on. If the motor 27 is on in this step, step 302 is followed, if the motor 27 is off, the lateral shift control is not executed, and then, the program skips to step 308, where the solenoid 23 is turned off, and after the rear side flag is set in step 310, the program proceeds to the exit, returning to the main program.

Next, in step 302, it is determined whether or not the film is shifting forward. This decision is made in the following manner; the contents of a predetermined RAM address in the microcomputer 115 is set up as the rear side flag, and the decision is made depending on its memory status, that is, whether it is 1 or 0. If the film is shifting rearward, in other words, if the rear side flag is 1, step 303 is followed.

In the step 303, it is determined whether or not the sensor 108 is on, and if the sensor 108 is not on, step 304 is followed. In the step 304, it is determined whether the input port IN 1 is on, and if it is on, step 305 is followed.

In the step 305, the film has laterally shifted rearward, turning on the sensor; therefore, the solenoid 23 is turned on to make the film shift frontward, simultaneously resetting the rear side flag, and then, the program proceeds to the exit side of the step 310.

In the step 304, if the input port IN 1 is not on, the program skips to the exit side of step 310.

Also, in the step 303, if the sensor 108 is on, in other words, if the film has shifted further forward even though the control is being executed to make the film shift rearward, step 309 is followed, wherein the film anomaly flag is set; the step 308 is followed, wherein the solenoid 23 is turned off; the rear side flag is reset in the step 310; and the program returns to the main sequence.

In the step 302, if the film is shifting forward in the same manner, in other words, if the rear side flag is on, the step 306 is followed.

In step 301, it is determined whether or not the sensor 107 is on, and if it is on, in other words, if the film has shifted further rearward even though the control is being executed to make the film shift forward, the step 309 is followed, wherein the program returns to the main program in the above mentioned manner.

Also, in the step 306, if the sensor 107 is off, step 307 is followed, wherein it is determined whether or not the input port IN 2 is on. If the input port IN 2 is not on in this step, the program skips to the exit side of the step 310, returning to the main program, and if the input port IN 2 is on, step 308 is followed, wherein the solenoid 23 is turned off; the rear side flag is set in the step 310; and the program returns to the main program.

As was stated above, the solenoids 113 and 114 are turned on or off depending on the signal detected by the sensor 28; therefore, the lateral shift control range can be selected based on the length of film driving time.

Also, the same effect can be accomplished even if the signal from the sensor 28 is inputted to the microcomputer 115 to drive the solenoids 113 and 114 through the microcomputer 115. Further, instead of using the sensor 28 to detect the length of film driving time, the sensors 105 and 106-may be mechanically driven like the gear 31.

Also, the solenoids 113 and 114 may be activated depending on the discharge sheet count computed by a microcomputer having a non-volatile RAM.

When the recording material or the like is introduced into the fixing device so that the image carried on it is fixed, heat absorbed by this recording material to be heated; therefore, the heat distribution becomes uneven in the longitudinal direction of the heater, and when a small piece of recording material is introduced to be heated, the heater temperature becomes higher at its surface region off the recording material passage; therefore, the temperature distribution becomes uneven. This phenomenon also causes the lateral film shift speed to fluctuate, bringing about unstable conditions for the lateral film shift control.

Next, another alternative embodiment is described, which allows the lateral shift control range to be selected based on the size of the recording material.

Figure 37:
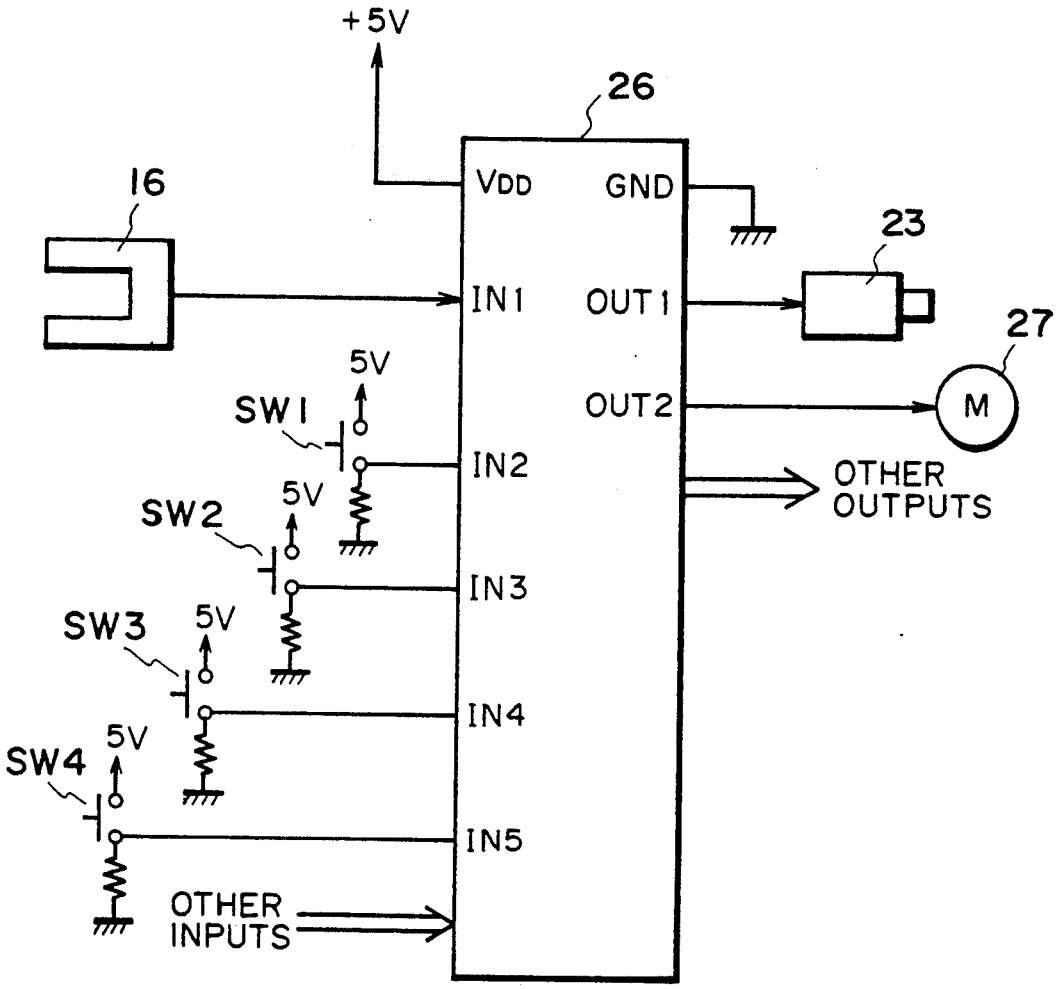
FIG. 37 is a control circuit for the alternative embodiment of the present invention.

FIG. 37 shows the control circuit.

Reference numeral 26 is a microcomputer, and to its input terminal IN 1, the above mentioned photosensor 16 is connected. To the OUT 1 terminal, the solenoid 23 is connected. To the OUT 2 terminal, the rotation control signal for the motor 27, which drives this fixing device, is outputted.

To the $V_{DD}$ terminal, the power source of +5 V is connected, and the GND terminal is connected to ground.

Though not illustrated, the microcomputer 26 is provided with the terminals for the other input and output signals of the copying machine employing this fixing device, and it also contains the non-volatile RAM, the memory contents of which is not erased even when the power supply to this microcomputer 26 is interrupted, together with the ROM, RAM, and the like in which the copying operation sequence program and such of this copying machine are stored.

Also, to the input ports IN 2 to IN 5 of the microcomputer 26, switches SW 1 to SW 4 are connected, respectively, to detect the codes from a feed cassette loaded in the image forming apparatus. These switches are selectively pressed and turned on by the tabs provided on the side of the cassette, which will be described next, whereby the size information of the transfer material in the cassette (that is, the width information of the transfer material being fed) is inputted to the microcomputer 26.

Figure 38:
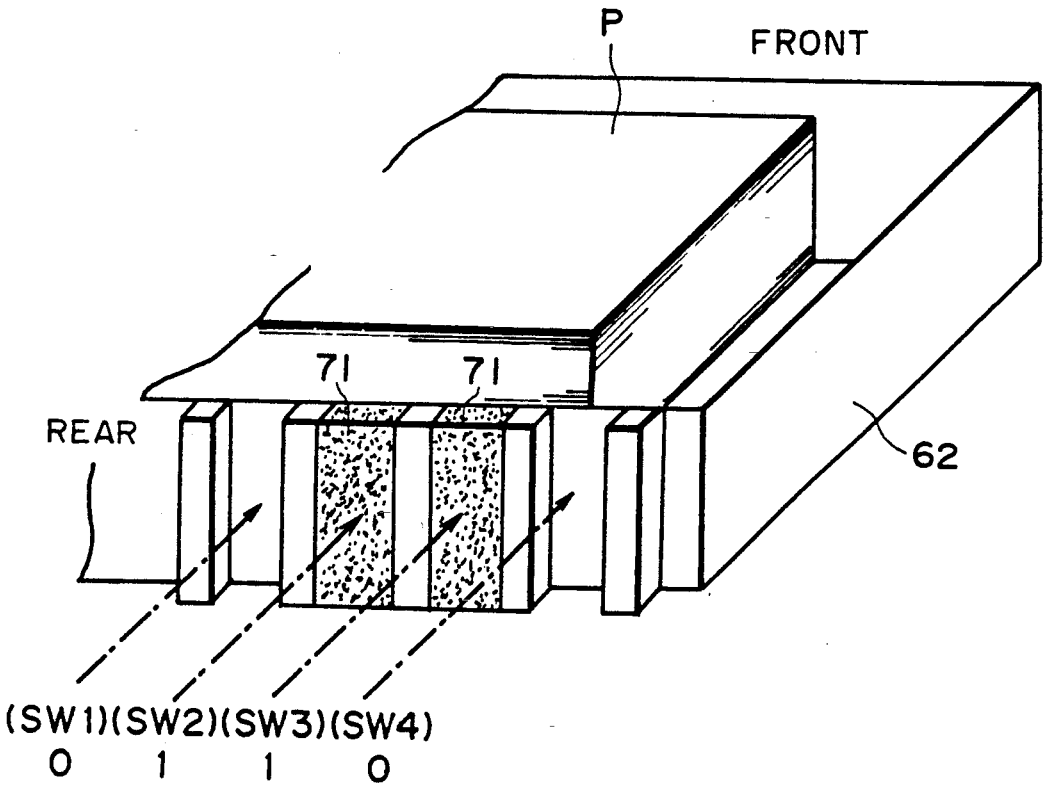
FIG. 38 is a partial perspective view of an embodiment of a sheet feeding cassette in accordance with the present invention.

FIG. 38 is a drawing of the feed cassette 62 viewed from the rear side. When the sheets are loaded in the cassette, the tabs 71 which mounted on the rear side of the feed cassette are-set corresponding to the size of the sheets to be loaded. Then, as this cassette 62 is installed in the image forming apparatus, the above mentioned SW 1 to SW 4 which are located in the image forming apparatus main assembly are selectively turned on, detecting the size of sheets in the cassette 62. In FIG. 38, the input ports IN 2 to IN 5 of the microcomputer 26 receive "1" if there are the tabs 71 at their corresponding locations on the cassette, and "0" if there is none. For example, if a four bit signal "0110" is given, it is determined that A4 size sheets are in the cassette 62.

As was described above, the transfer sheet size is determined by detecting the presence of the tabs 71 on the feed cassette 62, and the lateral film shift control range is selected based on this sheet size information as will be described later. In this embodiment, if the width of the transfer material P being fed is less than half the width of the film 11, the control is executed within the second lateral shift control range, and if it is more than half, the control is executed within the first lateral shift control range.

Figure 39:
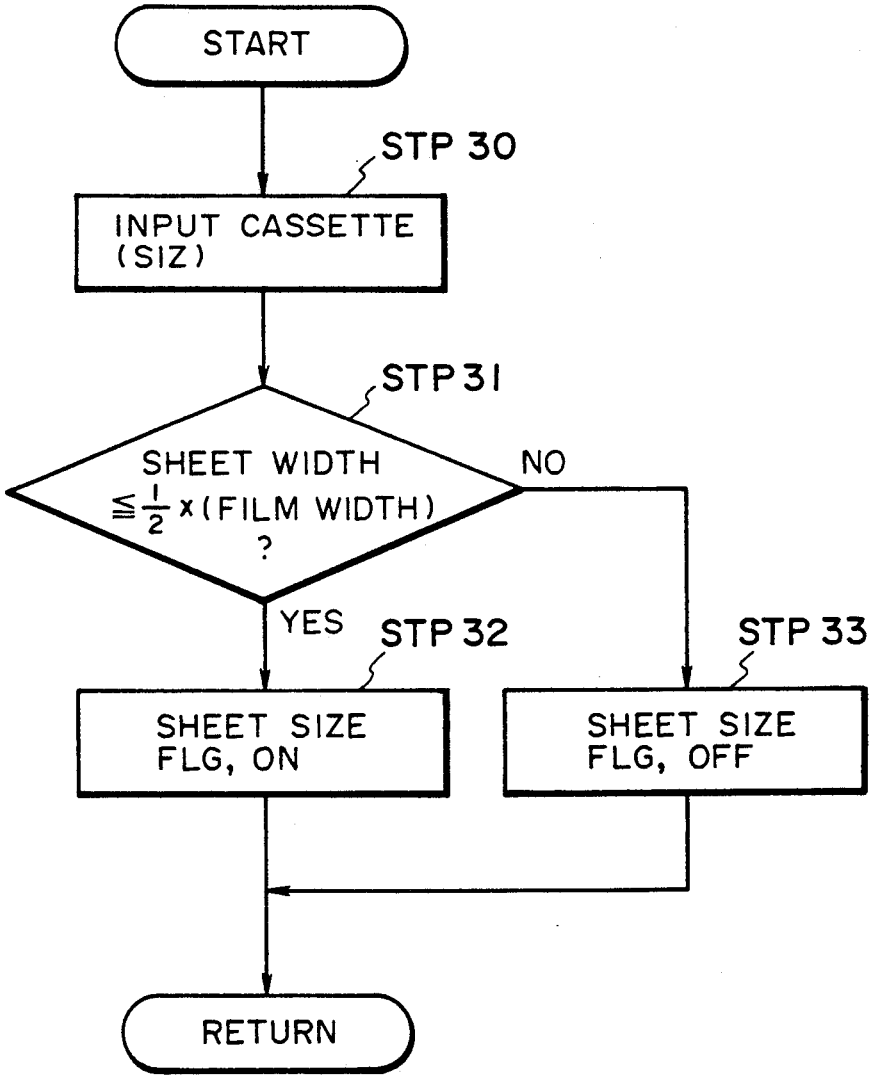
FIG. 39 is a flow chart for controlling the sheet feeding cassette and the sheet size detecting means.

FIG. 39 shows a routine for determining the lateral film shift control range depending on the sheet size. In step 30, the statuses of SW 1 to SW 4 connected to the input ports IN 2 to IN 5 of the microcomputer 26 (FIG. 7) are read. The sheet size is determined based on the result of these inputs. Next, step 31 is followed, where it is determined whether or not the sheet width is less than ½ of the width of the film 11. If it is less, step 32 is followed, where a sheet size flag is turned on, and if it is more, the sheet size flag is turned off in step 33.

Yet another means for detecting the recording material size, in accordance with the present invention, is described.

Figure 40A:
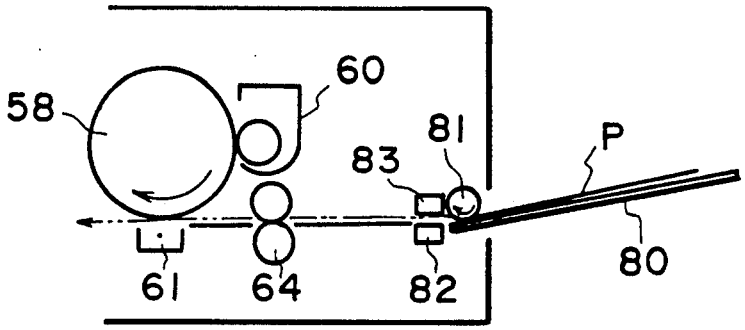
FIG. 40(*a, b*) are a partial sectional view (a) of a hand feed type image forming device of the alternative embodiment in accordance with the present invention, provided with the sheet size detecting means, and a perspective view of the sheet size detection means (b), respectively.
Figure 40B:
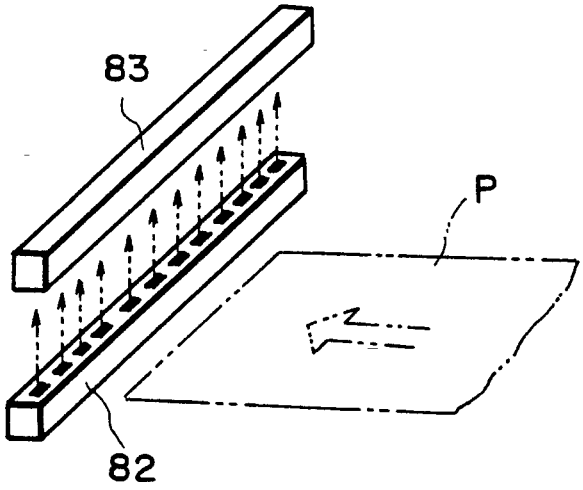

FIG. 40(*a*) shows the manual feed tray section of the manual feed type image forming apparatus. The transfer material P is placed on a manual feed tray 80, with the tip of sheet prefed in the nip section formed between a feed roller 81 and the tray 80. When a sheet feed start signal is received, feed roller 81 begins to be driven, whereby the transfer material P placed on the tray 80 is fed into the apparatus; is passed through a register roller 64; and is conveyed toward the image transfer section.

Reference numerals 82 and 83 refer to a photosensor array, used as the sheet size detection means, mounted on the downstream side of the feed roller 81 in the direction in which transfer material is conveyed. FIG. 40(*b*) is a perspective view of this photosensor array section.

Figure 41:
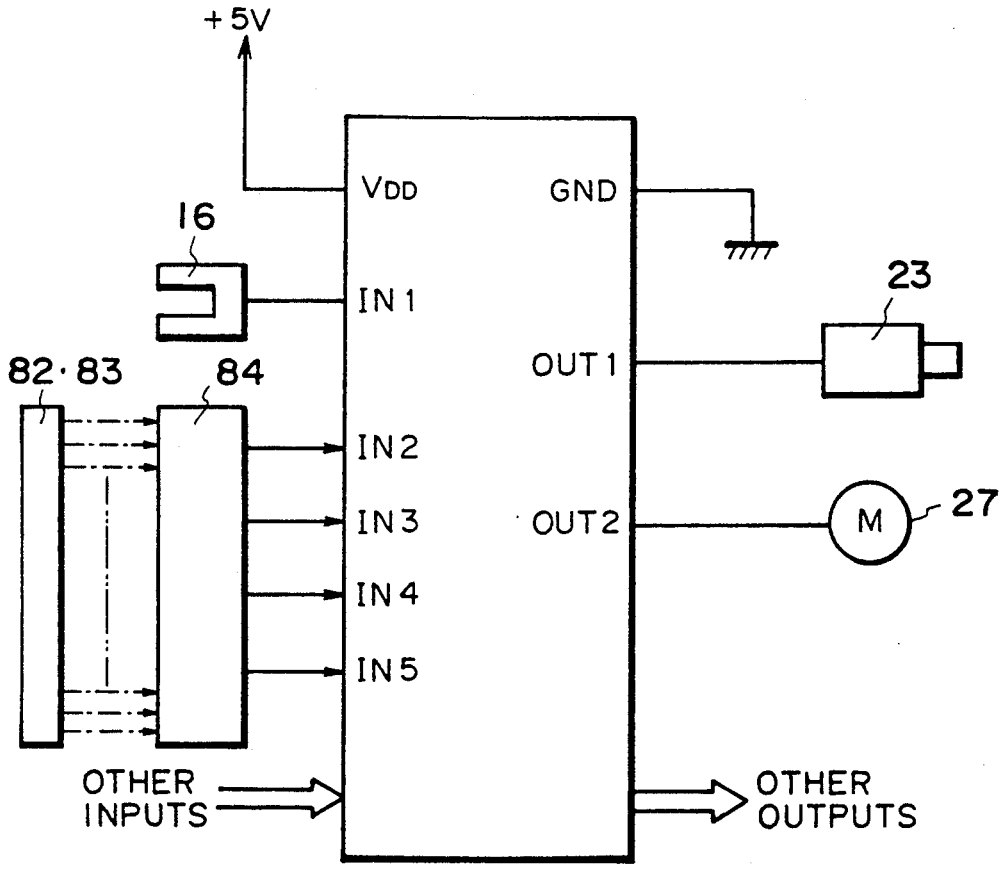
FIG. 41 is a schematic diagram of the control system.
Figure 42A:
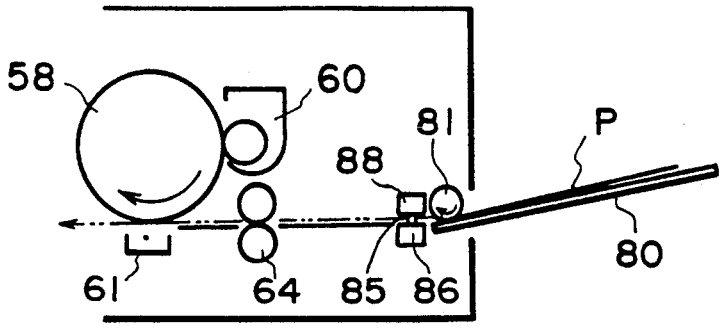
FIG. 42(*a, b, c*, and *d*) are a partial sectional view of the hand feed type image forming apparatus provided with the sheet size detecting means in accordance with the alternative embodiment of the present invention (a), a perspective view of the tab array of the sheet size detecting means (b), a schematic diagram showing the status of the sheet size detecting means just before it begins to pass the sheet (d), and a schematic diagram showing the status of the sheet size detecting means while it is passing the sheet (d).
Figure 42B:
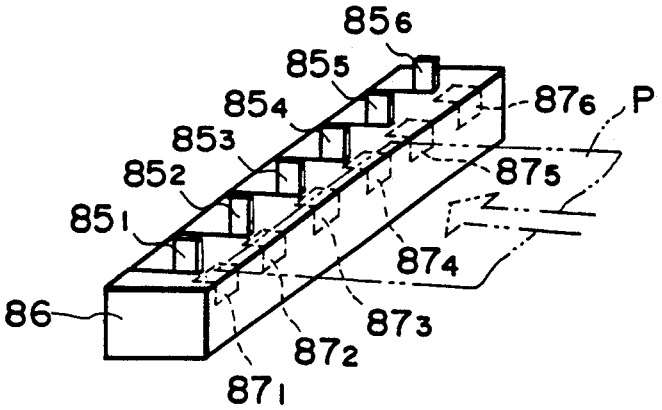
Figure 42C:
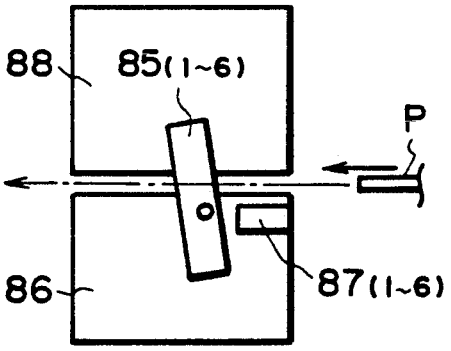
Figure 42D:
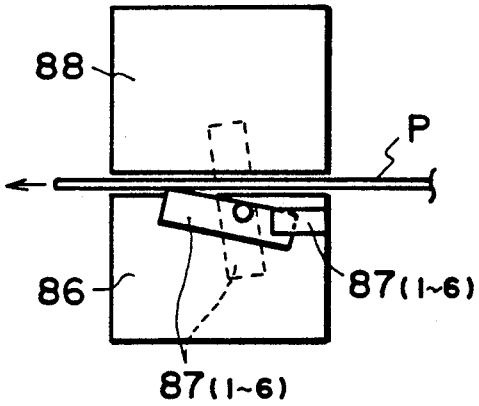

Reference numeral 82 refers to an LED array as the light emitting side, and 83 refers to a phototransistor array as the light receiving side; both of which are mounted to face each other. When the transfer material P conveyed by the feed roller 18 from the tray 80 is passed between this LED array 82 and phototransistor 83, the light emitted from the LED array 82 towards the phototransistor array 83, the receiving side, is blocked within the area of the array which falls within the sheet (transfer material) passage, but is received by the phototransistor array in the area outside the sheet passage. The detection signal from the phototransistor is outputted as a four bit signal, through a sheet size detection microcomputer 84 shown in FIG. 41, to the input ports IN 2 to IN 5 of the microcomputer 26.

Thus, the same operation as that in the first embodiment is possible, and the same effect can be obtained. Incidentally, the above mentioned photosensor array 82·83 may be at any location of the sheet conveying section between the feed section and the entrance of the fixing device.

FIG. 42 shows another alternative embodiment of the sheet size detection means.

FIG. 42(*a*) is a partial sectional view of the manual feed type image forming apparatus, in which a tab array 86 having an array of collapsible tabs $85_1$ to $85_6$ (FIG. 42(*b*) shows its perspective view), and a sheet guide 88 facing this tab array 86 are provided, as a sheet size detection means, on the downstream side of the feed roller 81 in the direction in which the transfer material is conveyed. In the tab array 86, photointerruptors $87_1$ to $87_6$ are arrayed to correspond to the respective collapsible tabs 851 to $85_6$.

When the transfer material P conveyed by the feed roller 81 from the tray 80 is passed between the tab array 86 and the sheet guide 88, the tabs 851 to 856 falling Within the transfer material passage are selectively collapsed corresponding to the width of the transfer material P being conveyed, whereby the width is detected by the photointerruptors $87_1$ to $87_6$ which correspond to the collapsed tabs (FIGS. 42(*c*) and 42(*d*)), and the detection signals are inputted to the microcomputer 26 to detect the sheet size.

In an apparatus which uses multiple toners of various colors, fixing conditions are different depending on the properties of the respective toners; therefore, in order to handle these differences, it is preferable that the length of time it takes for the recording material to be passed through the fixing device, that is, the recording material conveyance speed, can be adjusted, in other words, that the conveyance speed can be switched to be slower for a toner with inferior fixability, and conversely, the conveyance speed can be switched to be faster for a toner which has excellent fixability, but also has inferior offsetting properties in the high temperature condition. Further, if the recording material happens to be a resin film for an overhead projector, it is preferable to slow down the fixing speed.

In this case, it is needless to say that the recording material conveyance speed and the speed at which the film is driven are equal; therefore, the speed at which the film shifts laterally also changes due to the above mentioned speed selections.

Thus, another alternative embodiment in which the lateral shift control range can be selected, depending on the speed at which the film is driven.

Figure 43:
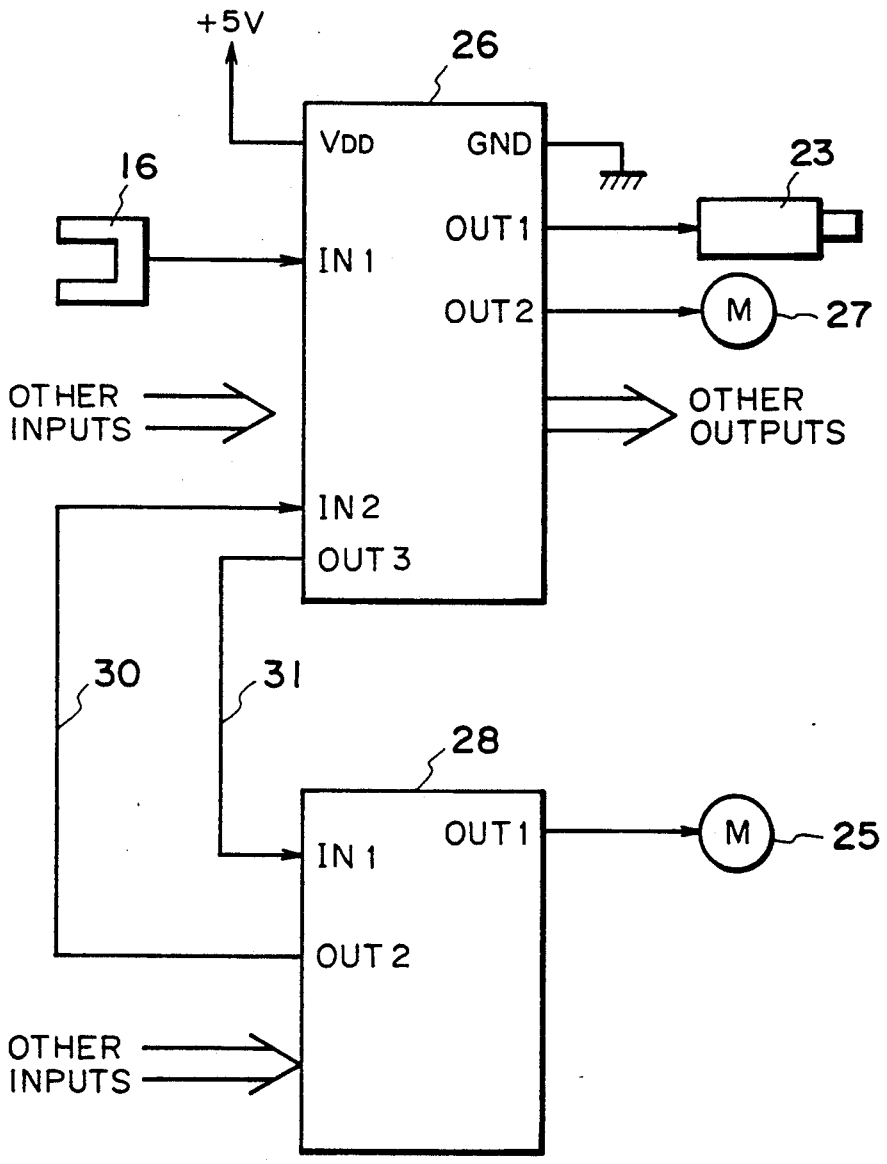
FIG. 43 is a schematic diagram of the control system.
Figure 44:
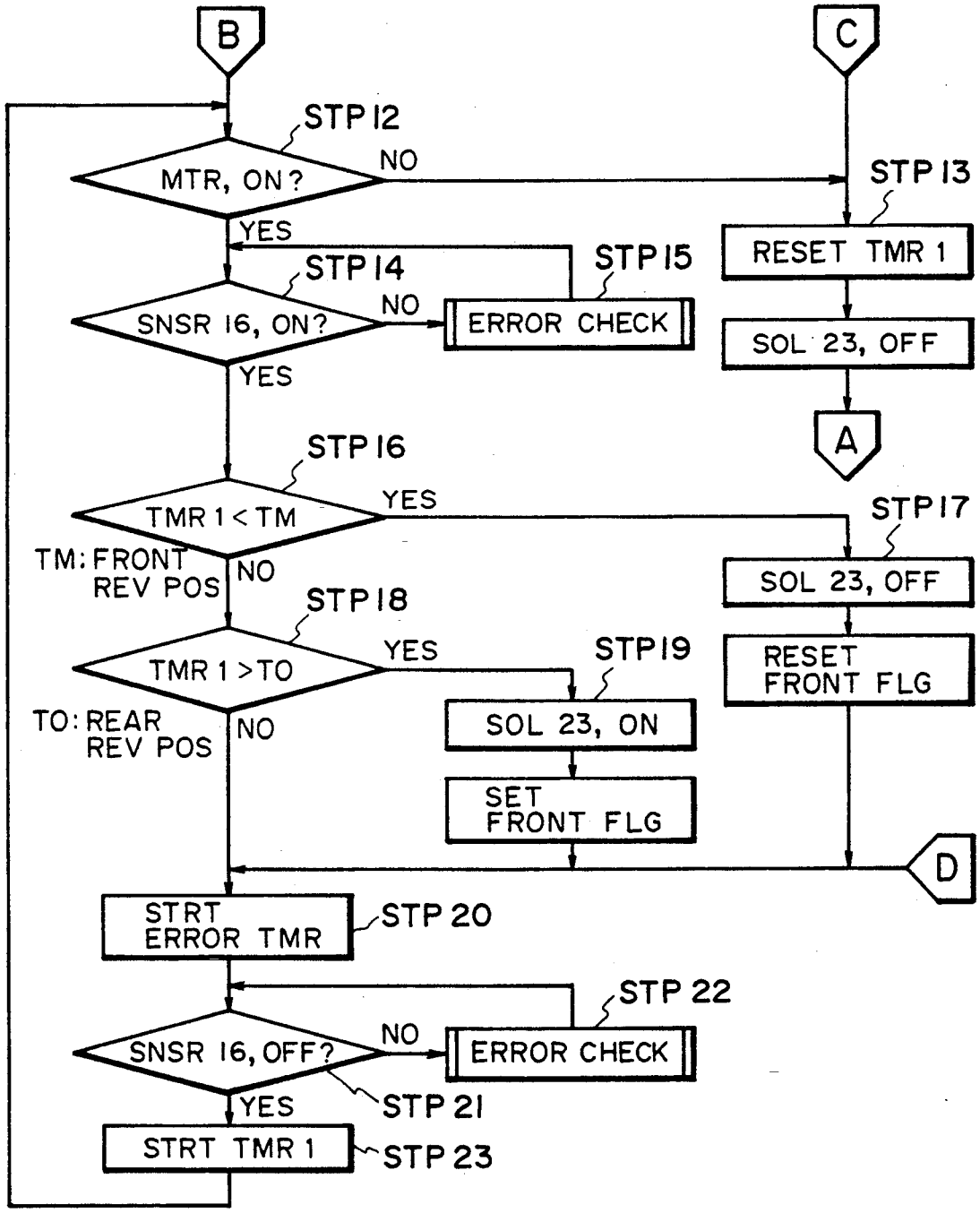
FIG. 44 is a flow chart for the lateral film shift control program of the alternative embodiment of the present invention.

FIG. 43 is a schematic diagram of the control circuit.

Reference numeral 26 refers to a microcomputer, and to its input terminal IN 1, the above mentioned photosensor 16 is connected. Also, to the output terminal OUT 1, the solenoid 23 is connected. To the output terminal OUT 2, the rotation control signal for the motor 27, which drives the copying machine main assembly, is outputted.

To the $V_{DD}$ terminal, the power source of +5 V is connected, and the GND terminal is connected to ground.

Though not illustrated, the microcomputer 26 is provided with the terminals for the other input and output signals of the copying machine employing this fixing device, and it also contains the non-volatile RAM, the memory contents of which is not erased even when the power supply to this microcomputer 26 is interrupted, as well as the ROM, RAM and the like in which the copying operation sequence program and such are stored.

Reference 28 refers to a control circuit for controlling the film speed (speed at which the film is driven to be rotated) of this fixing device 1, and it controls the speed of the motor 25 to control this film rotation speed. The motor 25 is arranged to drive the film 11, independently from the main motor 27 of the copying machine main assembly.

A signal 31 is a film drive control signal inputted to the control circuit 28 by the microcomputer 26, to be used as needed to drive the film during the copying sequence.

A signal 30 is a signal for indicating the state of the film rotation speed control executed by the control circuit 28. If the signal 30 indicates "H," this means that the control signal 28 is executing the control using the film speed 1, and if the signal 30 indicates "L," this means that the film speed 2, which is slower than the film speed 1, is employed for the control. The microcomputer 26 computes the film rotation speed by taking in the signal 30 through the input port IN 2. The control circuit 28 switches the film rotation speed, based on the condition signal indicating the toner conditions and such, which are not illustrated.

The flow charts for this embodiment are described, referring to FIGS. 8, 10, 11, 44, and 45.

To begin with, in the step 1 (FIG. 8) immediately after the start, it is determined whether or not the motor 25 is on. If the motor 25 is on in this step, the step 2 is followed, and, depending on the sheet size (width of the transfer material), the subroutine for determining the lateral film shift control range is called. If the motor 25 is off, the program returns to the step 1 to wait till the motor 25 is turned on.

Next, in the step 2, it is determined whether or not the film has been controlled, up to this point, to shift frontward. In this step, the contents of a predetermined address of the non-volatile RAM within the above mentioned microcomputer 26 is set up as the front side flag, and if the status of this memory is 1, in other words, if the film has been controlled to shift frontward up to this point, the step 3 is followed, wherein the solenoid is turned on, selecting the frontward lateral shift control, and the step 4 is followed. Also, if the front side flag is 0 in the step 2, this means that the film has been controlled up to this point to shift rearward; therefore, the program skips to the step 4.

In the step 4, it is determined whether or not the sensor 16 is off, and if the sensor 16 is on, the step 8 is followed, and if it is off, the step 5 is followed.

In the step 5, the value of the error timer is reset to 0, simultaneously starting the measurement, and the step 6 is followed.

In the step 6, it is determined whether or not the sensor 16 is on, ana if it is not on, the step 7 is followed.

In the step 7, the error check routine is executed, and then, the program returns to the step 6.

Here, the contents of the error check routine is described, referring to FIG. 10. First, in the step S1, it is determined whether or not the motor 27 is on. If it is on, the step S2 is followed, and if it is not on, the step 13 (FIG. 44) is followed.

In the step S2, it is determined whether or not the error timer value is larger than d seconds, and if it is smaller, the program proceeds to the exit of this routine. Also, in the step S2, if the error timer value is larger than d second, the step S3 is followed. In the step S3, the error flag is set, and the program proceeds to the exit of this routine.

Next, in the step 6, if the sensor 16 is on, the step 8 is followed, wherein the error timer value is reset to 0, simultaneously starting the measurement, and then, the step 9 is followed.

In the step 9, it is determined whether or not the sensor 16 is off. If it is not off, the step 10 is followed, wherein the error check routine is executed for the program to return to the step 9, and if the sensor 16 is off, the step 11 is followed, wherein the value of the timer 1 is reset to 0, simultaneously starting the measurement, and then, the step 12 (FIG. 44) is followed.

In the step 12, it is determined whether or not the motor 25 is on, and if it is on, the step 14 is followed.

In the step 14, it is determined whether or not the sensor 16 is on. If it is not on, the step 15 is followed, wherein the error check routine is executed to return to the step 1, and if it is on, the step 16 is followed.

In the step 16, a comparison is made to determine whether or not the value measured by the timer 1 is smaller than a value which corresponds to the front side reversing point. This value which corresponds to the front side reversing point is a value which corresponds to the location at which the lateral shift direction of the film 11 is switched from the frontward direction to the rearward one, and is determined by a subroutine which will be described later. At this time, if the value of the timer 1 is smaller, it can be determined that the film is located on the frontward side; therefore, the step 17 is followed, wherein the solenoid 23 is turned off, switching the lateral shift direction of the film 11 to the rearward one, and after the front side flag is reset to 0, the step 20 is followed.

Also, in the step 16, if the value measured by the timer 1 is not smaller than the value which corresponds to the front side reversing point, the step 18 is followed.

In the step 18, a comparison is made to determine whether or not the value measured by the timer 1 is larger than the value for the rear side reversing point. Here, the rear side reversing point means the point at which the lateral film shift direction is switched from the rearward direction to the frontward one. If it is not larger, the step 20 is followed, and if it is larger, it can be determined that the film 11 is located on the rear side; therefore, the step 19 is followed, wherein the solenoid 23 is turned on to switch the lateral shift direction of the film 11 to the frontward direction, and after the front side flag is set to 1, the step 20 is followed.

In the step 20, the error timer value is reset to 0, simultaneously starting the measurement, and the step 21 is followed.

In the step 21, it is determined whether or not the sensor 16 is off, and if it is not off, the step 22 is followed, wherein the error check routine is executed, and the program returns to the step 21.

Also, in the step 21, if the sensor 16 is off, the step 23 is followed, wherein the value of the timer 1 is reset to 0, simultaneously starting the measurement, and the program returns to the step 12.

In the above mentioned step 12, if the motor 27 is off, the step 13 is followed, wherein the measurement by the timer 1 is stopped; the measured value is reset to 0; and the solenoid 23 is turned off, and then, the program returns to the step 1.

Figure 45:
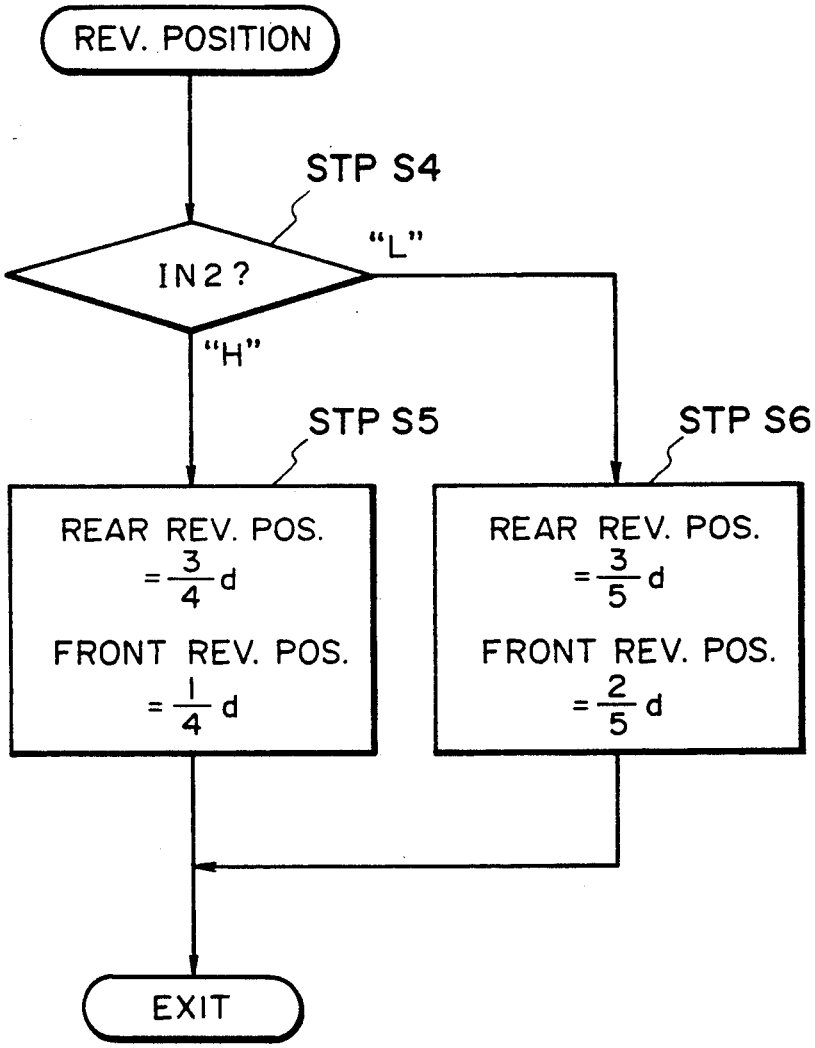
FIG. 45 is a flow chart for the lateral film shift control program of the alternative embodiment of the present invention.

Next, the above mentioned subroutine is described, which determines the front side reversing point and the rear side reversing point. This subroutine shown in FIG. 45 is a subroutine which is called as needed. First, in the step S4, the value of the input port IN 2 is determined. In the step S4, if the IN 2 indicates "H," in other words, if the control circuit 28 is executing the control using the film rotation speed 1, the step S5 is followed.

In the step 5, the following arrangement is set up, and the program proceeds to the exit.

Rear side reversing point 3/4 d

Front side reversing point 1/4 d

Also, in the step S4, if the IN 2 indicates "L,", in other words, if the control circuit 28 is executing the control using the film rotation speed 2, the step 6 is followed.

In the step 6, the following arrangement is set up, and the program proceeds to the exit.

Rear side reversing point 3/5 d

Front side reversing point 2/5 d

According to this embodiment, a control means is provided so that the lateral film shift control range can be selected depending on the rotation speed at which the film is driven; therefore, it becomes possible to execute a stable lateral shift control without imparting excessive stress on the film, even if the lateral film shift speed fluctuates due to changes in the rotation speed at which the film is driven.

Figure 46:
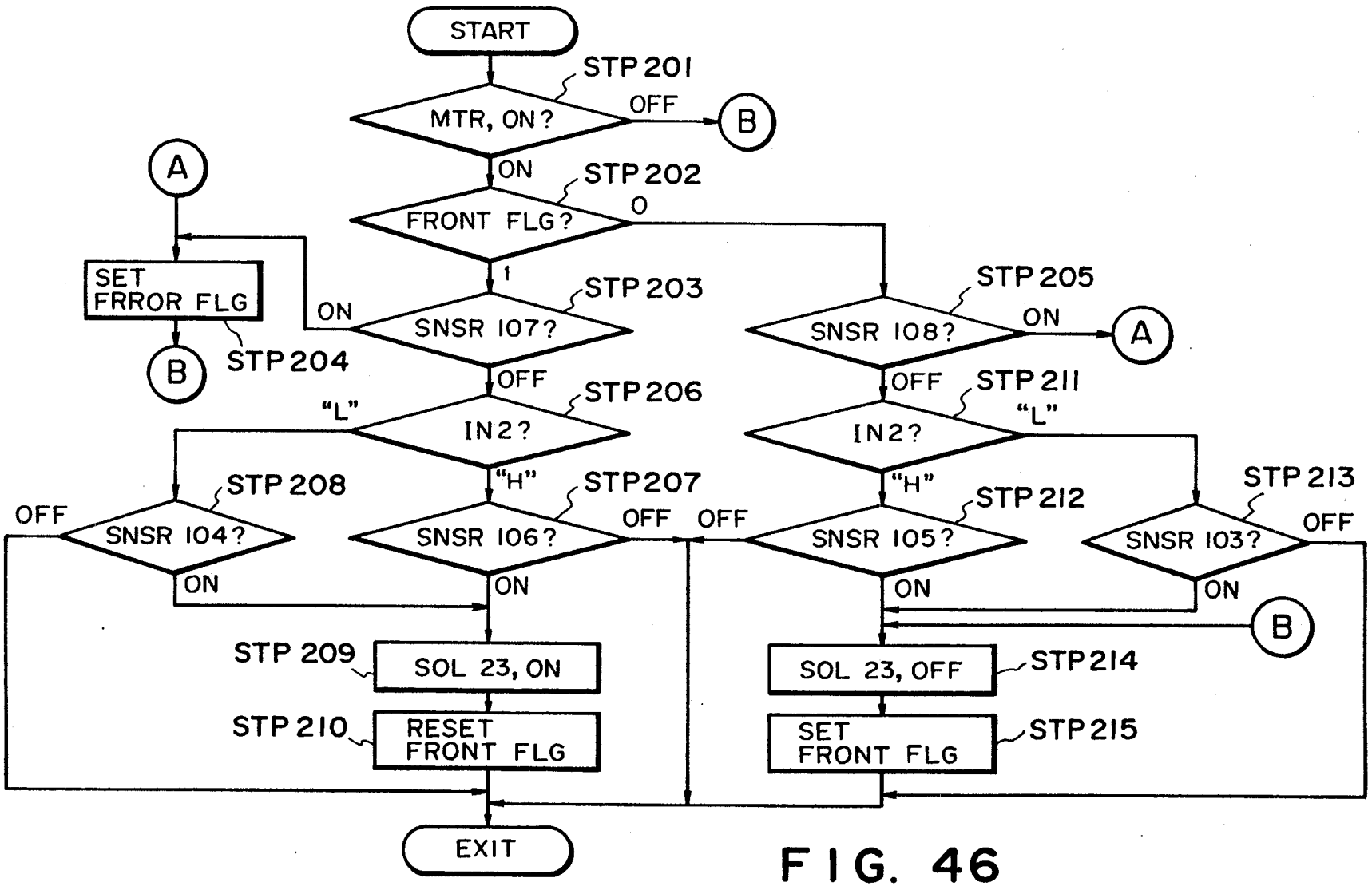
FIG. 46 is a flow chart for the lateral film shift control program of the alternative embodiment of the present invention.

Yet another alternative embodiment is described, referring to FIGS. 15 and 46.

First, in the step 201 immediately after the start, it is determined whether or not the motor 25 is on. If the motor 25 is on, the step 202 is followed.

In the step 202, it is determined whether or not the front side flag is on. If it is on, this means that the film is being controlled to shift frontward. If it is on, the step 203 is followed.

In the step 203, it is determined whether or not the sensor 107 is on. If it is on, it is determined that the film has shifted rearward in spite of the forward lateral film shift control; therefore, the step 204 is followed, where the error flag is set, and then, the program proceeds to the step 214.

In the step 214, the solenoid 23 is turned off, and after the front side flag is reset, the program proceeds to the exit. In the step 203, if the sensor 107 is off, the step 206 is followed.

In the step 206, the status of the signal 30 which indicates the film rotation speed is determined at the input terminal IN 2. If the IN 2 indicates "H," the step 207 is followed.

In the step 207, it is determined whether or not the sensor 106 is on. If the sensor 106 is off, the program proceeds to the exit. If the sensor 106 is on, it is determined that the film is shifting frontward; therefore, the step 204 is followed, where the solenoid 23 is turned on, and after the front side flag is reset, the program proceeds to the exit.

In the step 206, if the IN 2 indicates "L," the step 208 is followed. In the step 208, it is determined whether or not the sensor 104 is on, if it is off, the exit is followed.

If it is on, it is determined that the film is shifting forward; therefore, the step 209 is followed.

Also, in the step 202, if the front side flag is off, the step 205 is followed. In the step 205, it is determined whether or not the sensor 108 is on, if it is on, it is determined that the film has shifted frontward in spite of the rearward lateral shift control; therefore, the step 204 is followed, wherein the error flag is set, and then, the step 214 is followed.

In the step 205, if the sensor 108 is off, the step 211 is followed. In the step 211, the status of the signal 30 which indicates the film rotation speed is determined at the input IN 2. If IN 2 indicates "H," the step 212 is followed.

In the step 212, it is determined whether or not the sensor 105 is on. If the sensor 105 is off, the exit is followed. If the sensor 105 is on, it is determined that the film is shifting rearward; therefore, the step 214 is followed.

In the step 214, the solenoid is turned off, and after the front side flag is set, the exit is followed. In the step 211, if the IN 2 indicates "L," the step 213 is followed.

In the step 213, it is determined whether or not the sensor 103 is on. If it is off, the exit is followed. If it is on, it is determined that the film is shifting rearward; therefore, the step 214 is followed.

Next, another alternative embodiment of the present invention is described.

This embodiment is a device provided with a control means for controlling the pressing force with which the material to be heated is indirectly pressed against the heater through the endless film; and another control means for selecting the lateral film shift range of the lateral film shift control means, depending on this pressing force.

Figure 47:
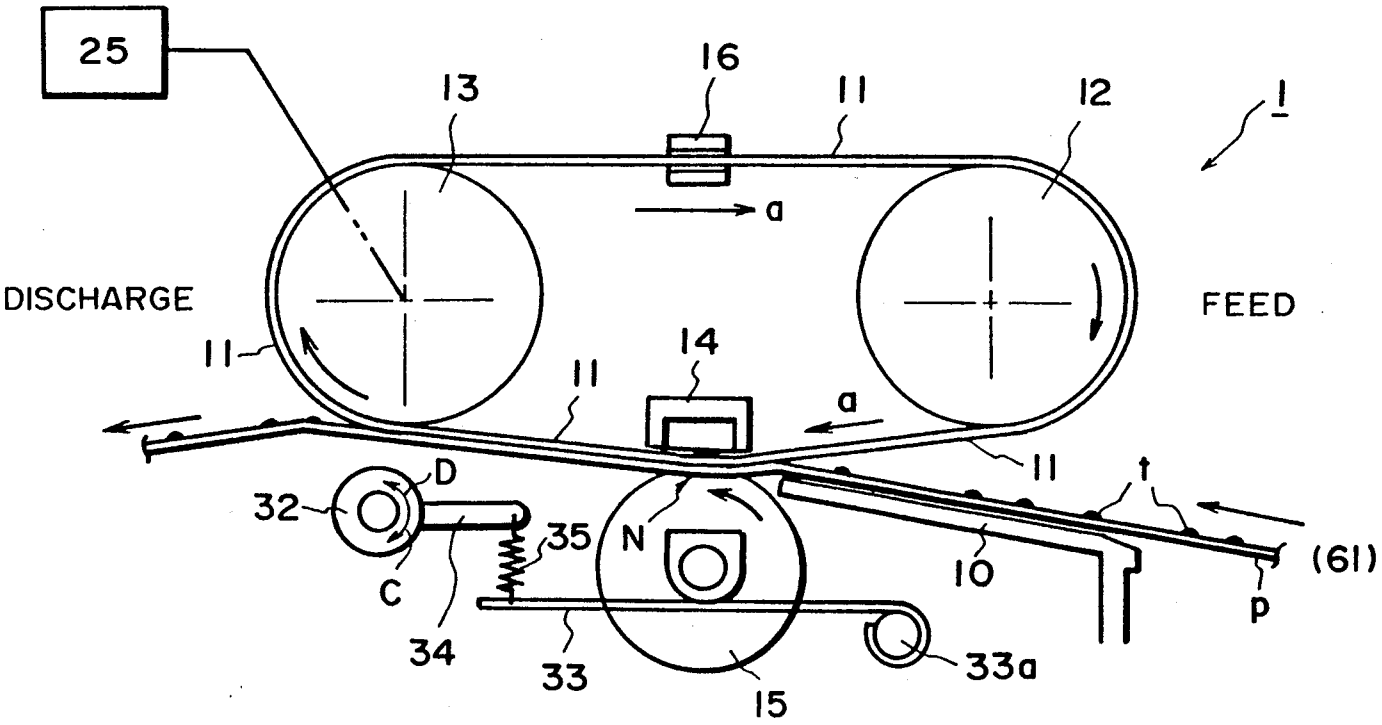
FIG. 47 is a sectional view of the image heating device in accordance with yet another alternative embodiment of the present invention.

FIG. 47 shows an example of the control means for changing the pressing force (applied pressure) with which the recording material is indirectly pressed against the heater 14 through the film 11.

The pressing roller 15 receives its pressing force from a tension spring 35 through the medium of a pressing lever 33, one end of which is supported by a fulcrum 33*a* so as to rotate about it, and the other end of which is attached to the pressing lever 33, which is also linked to a lever 34 by the tension spring 35. The lever 34 is rotatively driven by a motor 32, whereby the pressing force decreases if the motor 32 rotates in the direction of C, and increases if it rotates in the direction of D.

If the pressing force is large, the film driving load increases; therefore, the lateral film shift speed decreases. Conversely, if the pressing force is small, the lateral film shift speed increases.

Figure 48:
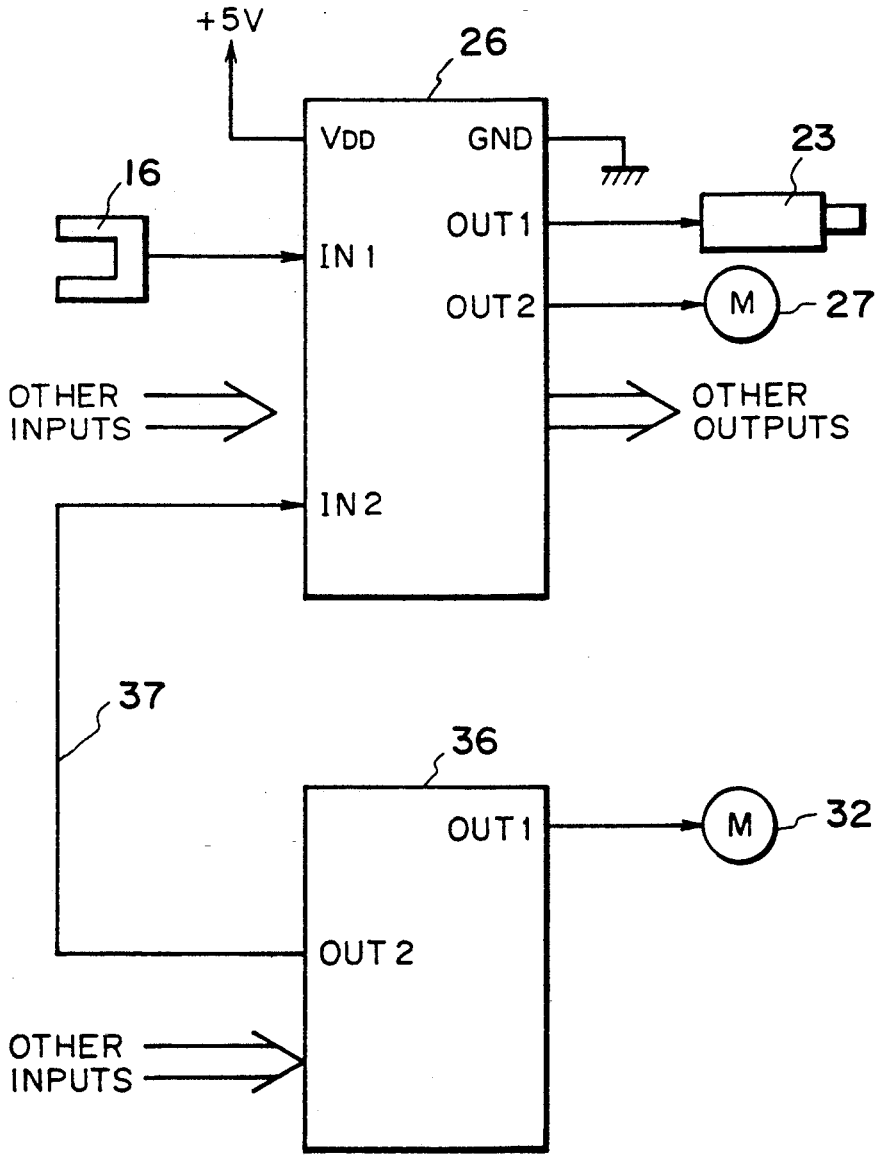
FIG. 48 is a control circuit of the image heating device shown in FIG. 47.

FIG. 48 shows the control circuit of this embodiment.

In FIG. 48, a reference numeral 36 refers to the control circuit to control the pressing force, and in order to control the pressing force, it controls the rotational position of the motor 32.

A signal 37 is a signal to indicate the status of the pressing force control executed by a control circuit 36. If the signal 37 indicates "H," it is indicated that the control circuit 36 is using the pressing force 1 for the control, and if it indicates "L," it is indicated that the control is executed using the pressing force 2, which is stronger than the pressing force 1. The microcomputer 26 determines the magnitude of the pressing force by taking in the signal 37 through the input port IN 2. The control circuit 36 switches the pressing force, based on the signals indicating the conditions such as toner types, which are not illustrated.

Further, in FIG. 45, first, in the step S4, the value of the input port IN 2 is detected. In step S4, if the IN 2 indicates "H," in other words, if the control circuit 36 is executing the control using the pressing force 1, the step S5 is followed.

In the step S5, the following conditions are set up, and then, the exit is followed.

Rear side reversing point 3/4 d

Front side reversing point 1/4 d

Also, in the step S4, if the IN 2 indicates "L," in other words, if the control circuit 36 is executing the control using the pressing force 2, the step S6 is followed.

In the step 6, the following conditions are set up, and then, the exit is followed.

Rear side reversing point 3/5 d

Front side reversing point 2/5 d

In such a manner as was described above, the fixing film is perpetually shifted back and forth so that it remains within the lateral shift control range which corresponds to the pressing force of the fixing device.

Thus, it is arranged so that the lateral film shift control range can be selected depending on the pressing force of the fixing device; therefore, it becomes possible to contain the lateral film shift alternation frequency approximately within a predetermined range even if the lateral film shift speed fluctuates due to changes in the pressing force, and it also becomes possible to execute a stable lateral film shift control without imparting excessive stress on the film.

In this embodiment, only two selections, pressing forces 1 and 2, are available, but multiple selections may be prepared, depending on conditions, such as toner type. In such a case, the same effect can be obtained by providing plural bits for the signal 37.

The control circuit is described as a microcomputer, but another type of logic circuit may be employed.

In this embodiment, the signal indicating the control status is outputted from the film rotation speed control circuit, but a sensor to detect the positions of the lever 34 or the pressing lever 33 may be provided so that the control may be executed based on a determination of the magnitude of the pressing force.

Yet another alternative embodiment of the present invention is described.

If arrangements are made so that the fixing temperature can be set to obtain the optimum fixing condition, depending on the toner type and the recording material type, and so that the fixing temperature can be switched to a specific one, since the device is cool when it is started-for the first time after a period of non-usage, the lateral film shift becomes unstable due to the difference in the fixing temperature setup.

Therefore, in this embodiment, the lateral shift control range can be selected depending on the fixing temperature.

Figure 49:
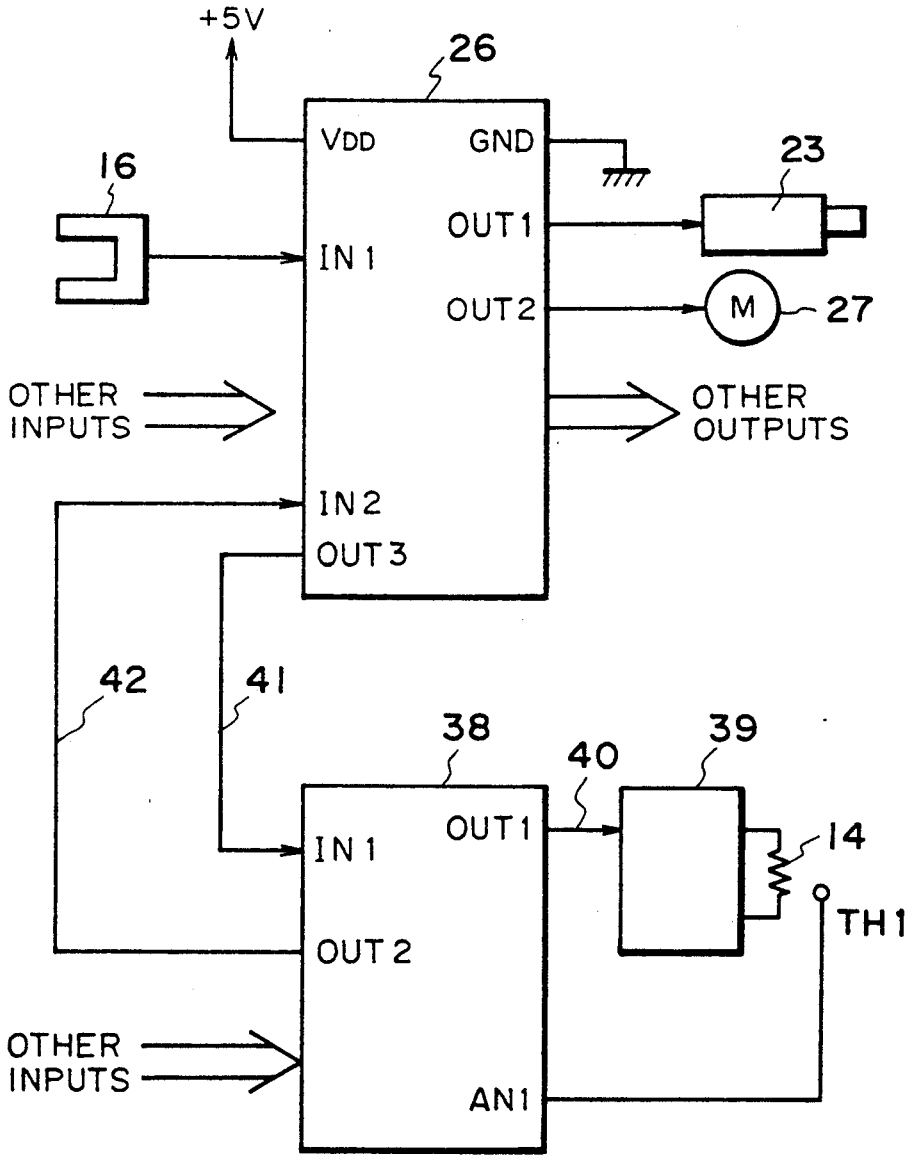
FIG. 49 is a schematic diagram of the control circuit of the image heating device shown in FIG. 47.

FIG. 49 shows the control circuit of this embodiment.

In FIG. 49, reference numeral 38 refers to a control circuit for controlling the temperature of the heater 14 of this fixing device, and it takes in, through an analog input terminal AN 1, the value detected by the thermistor RT 1 which detects the temperature of the heater 14, and outputs a control signal 40 to a heater power supply circuit 39.

A signal 41 is a temperature control signal to be inputted to the control circuit 38 from the microcomputer 26, and is used to supply the power to the heater 14 as needed during the copying sequence. A signal 42 is a signal indicating the status of the heater temperature control executed by the control circuit 38.

If the signal 42 indicates "H," it means that the control circuit 38 is controlling the temperature to be a target temperature 1, for example, 180° C., and if it indicates "L," it means that the control circuit 38 is controlling the temperature to be the other target temperature 2, which is higher than the target temperature 1, for example, 200° C.

The microcomputer 26 determines the target temperature by taking in the signal 42 through the input port IN 2. The control circuit 38 switches the target temperature, depending on the signals which indicate the conditions such as toner type, whether the device i.e. started first time after a period of non-usage, or the like, which are not illustrated.

If the target temperature is high, the temperatures of the driving roller 13 and the follower roller 12 become high, reducing the coefficient of friction between them and the film 11; therefore, the lateral film shift speed decreases. Conversely, if the target temperature is low, the lateral film shift speed increases.

In FIG. 45, first, in the step S4, the value of the input port IN 2 is determined. If the IN 2 indicates "H" in the step S4, in other words, the control circuit 38 (FIG. 49) is using the target temperature 1, the step S5 is followed.

In the step S5, the following conditions are set up, and then, the exit is followed.

Rear side reversing point 3/4 d

Front side reversing point 1/4 d

Also, in the step S4, if the IN 2 indicates "L," in other words, if the control circuit 38 is using the target temperature 2, the step S6 is followed.

In the step 6, the following conditions are set up, and then, the exit is followed.

Rear side reversing point 3/5 d

Front side reversing point 2/5 d

In the manner such as was described above, the fixing film is perpetually shifted in alternating lateral directions so that the lateral film shift control range is confined within the control range which corresponds to the target temperature of the heater 14 in the fixing device.

Thus, a control means is provided, by which the lateral film shift control range can be selected depending on the target temperature of the heater; therefore, it becomes possible to contain the directional alternation frequency of the lateral film shift virtually within a predetermined range, and it also becomes possible to execute a stable lateral film shift control without imparting excessive stress upon the film.

In this embodiment, only two selections, target temperatures 1 and 2, are available, but multiple selections may be prepared depending on conditions, such as toner type. In such a case, the same effect can be obtained by providing plural bits for the signal 42.

In the above mentioned embodiments, the lateral shift control range was described, but next, an embodiment in which the lateral film shift speed can be varied is described.

Figure 50:
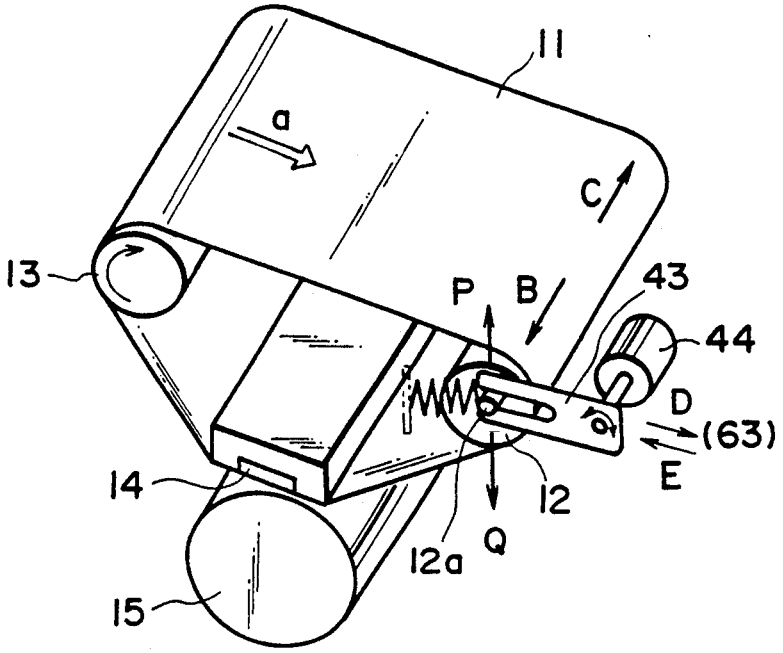
FIG. 50 is a perspective view of the heating device in accordance with yet another alternative embodiment of the present invention.
Figure 51A:
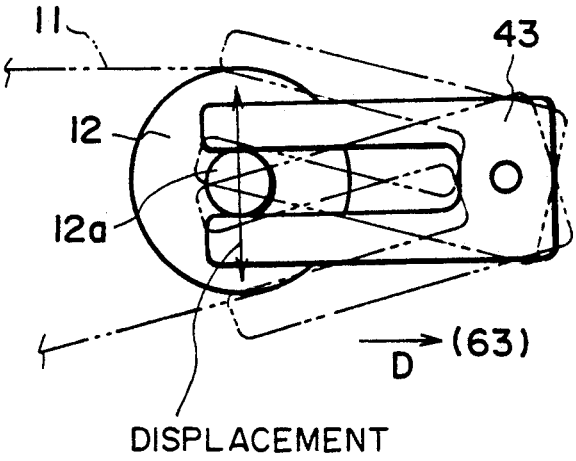
FIG. 51(*a, b*) are schematic diagrams describing the operation of the rockable lever of the heating device shown in FIG. 50.
Figure 51B:
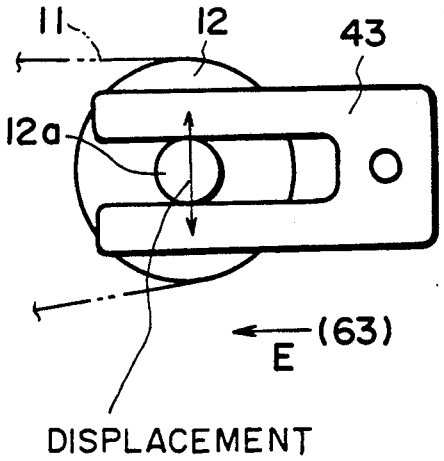

FIG. 50 is a perspective view of the image heating device of this embodiment, and FIG. 51 is an enlarged view of its section.

On the end section of the axis of the tension roller (follower roller) 12, rockable lever (fork lever) 43 to move this roller 12 is rotatably mounted, and this rockable lever 43 is driven by a stepping motor 44. As this stepping motor 44 rotates in the clockwise direction, the tension roller 12 is displaced in the direction indicated by an arrow P, and as it rotates in the counterclockwise direction, the tension roller 12 is displaced in the direction of an arrow Q. At this time, the lateral shifting direction of the fixing film 11 changes depending on the displacement direction of the tension roller 12; the fixing film shifts in the arrow B direction if the tension roller moves in the arrow P direction, and in the direction of an arrow C if the tension roller moves in the arrow Q direction. Thus, the film position detecting means (lateral film shift control mechanism), which includes the sensor 16 which is omitted from this figure, detects the positional status of the fixing film 11, and changes the lateral film shift direction to perpetuate the lateral shifting movement of the film in the alternating directions. This is the basic arrangement of the lateral shift control.

Also, it is known that the lateral shifting speed of the fixing film 11 accelerates if the amount of the above mentioned displacement is increased, and decelerates if it is reduced. Therefore, in this embodiment, the rockable lever 43 shown in FIG. 50 is mounted as is shown in FIG. 51 so that it can be slid in either direction indicated by an arrow D or an arrow E. In other words, if the rockable lever 43 is moved in the arrow D direction as is shown in FIG. 51(*a*), the amount of displacement of the tension roller 12 increases, whereby the lateral film shift speed can be accelerated, and if the rockable lever 43 is moved in the arrow E direction, the amount of displacement of the tension roller 12 decreases, whereby the lateral film shift speed can be decelerated.

Incidentally, the mechanism for switching the sliding direction of the rockable lever 43 between the D and E directions is not shown, but it may comprise a mechanism which includes the stepping motor 63.

However, if the amount of heat generated by the heater 14 (hereinafter, called target temperature) is high, the temperatures of the driving roller 13 and the tension roller 12 become high as was described before; therefore, the coefficient of friction between themselves and the film 11 decreases. Then, the lateral film shift speed slows down, or the lateral shift direction reverses if the amount of the displacement shown in FIG. 51 remains uniform.

Conversely, if the target temperature is low, the coefficient of friction does not decrease; therefore, the shifting force increases, in other words, the lateral film shift speed increases. In particular, if grease is present on the inner surface of the film, this phenomenon becomes more conspicuous. Therefore, when the target temperature is high, the rockable lever 43 is controlled so as to move in the arrow D direction in FIG. 51(*a*), and conversely, in the arrow E direction when the target temperature is low; whereby the above mentioned fluctuation in the lateral film shift speed due to the changes in temperature is suppressed to a minimum so that the film is controlled to shift to the alternating directions at an approximately uniform speed.

An alternative means for displacing the tension roller 12 is described, referring to FIGS. 52 to 63.

Figure 52:
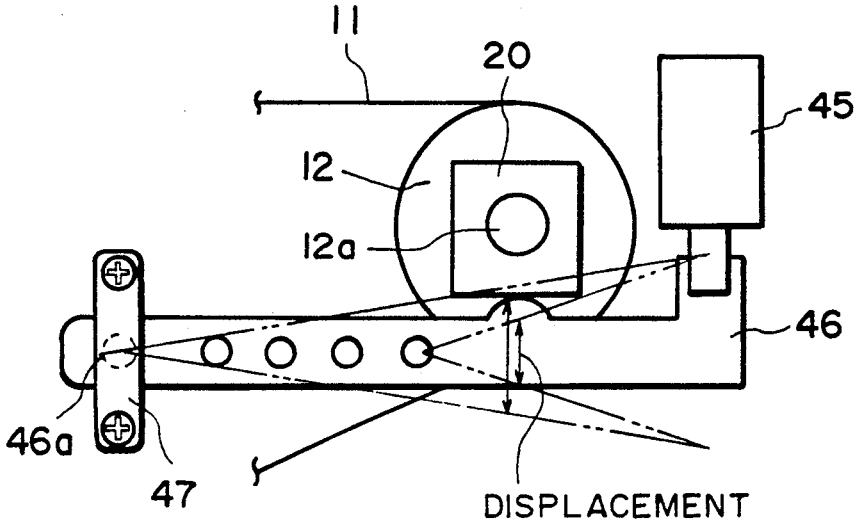
FIGS. 52 to 63 are schematic diagrams of the lateral film shift speed changing means for various alternative embodiments.

In the example shown in FIG. 52, the rockable lever 46 is driven by a solenoid 45. The fulcrum 46*a* of the rockable lever 46 can be moved by moving the fulcrum member 47; therefore, the amount of displacement of the tension roller 12 can be varied.

It is possible to change the amount of displacement to both the upward and downward direction from the mid-point, but it is also effective to adjust the lateral shift speed only to a single direction by changing the amount of displacement only to a single direction from the mid-point. In particular, when a sheet of small size is fed, with its side being aligned with a reference the temperature increases on the side where the sheet is not passed, and the balance is lost in the lateral film shift speed; therefore, the amount of displacement on one side must be changed for the adjustment. Further, the amount of displacement of the tension roller 12 can be varied also by varying the rotational angle of the stepping motor 44 by an appropriate control means.

Figure 53:
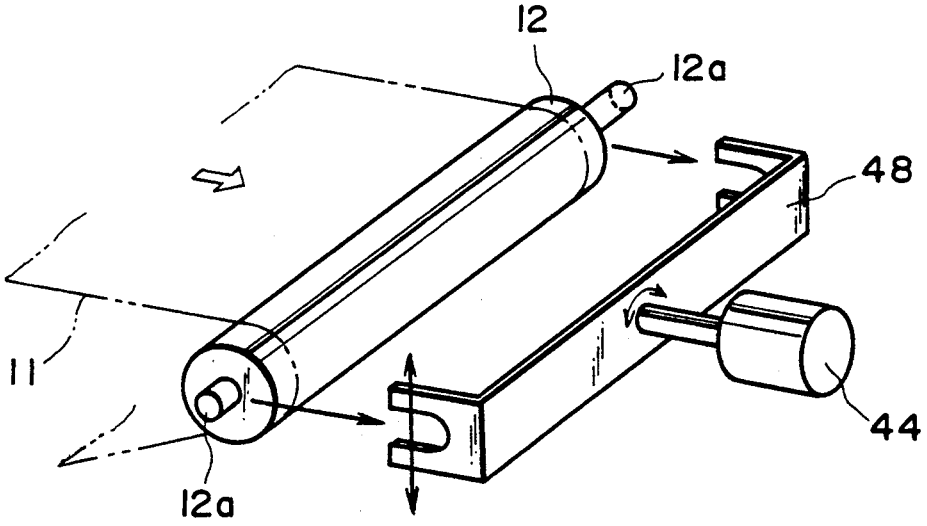

In the example shown in FIG. 53, the tension roller 12 is displaced by rotating a rotatable lever 48 which supports both ends of the tension roller 12. This example may be said to be a more effective means, compared to the above mentioned example, since the displacement is generated on both front and rear sides.

Figure 54:
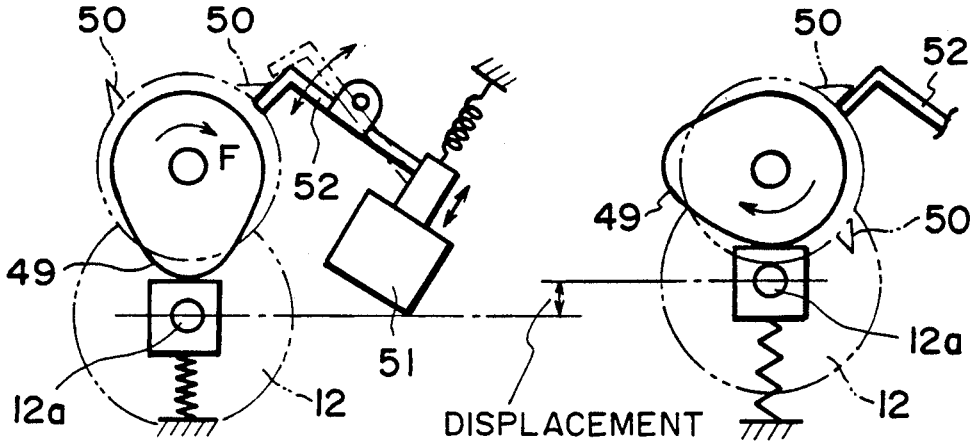

The example shown in FIG. 54 employs an eccentric cam 49. That is, the eccentric cam 49 is rotatably mounted in contact with the-end of the axis of the tension roller 12, and the amount of displacement of the tension roller 12 is controlled by where this eccentric cam 49 stops. Also, an unshown driving mode selection means, such as a clutch, is mounted on the rotational axis of the eccentric cam 49, and a projection 50 for selecting the driving mode is controlled by a solenoid 51 to determine where the eccentric cam 49 is to be stopped.

When the solenoid 51 is driven while the positional relationship among the components are as is shown in FIG. 54(*a*), a control lever 52 releases the projection 50, and the eccentric cam 49 begins to be rotated in the direction indicated by an arrow F, by the driving force transmitted through the driving mode selection means. Next, as the solenoid 51 is turned off, the control lever 52 engages with the projection 50; therefore, the eccentric cam 49 stops rotating and is locked at the location shown in FIG. 54(*b*).

If this projection 50 is provided in a large number, the eccentric cam 49 can be locked at multiple positions, whereby the amount of displacement can be set up in multiple steps.

Figure 55:
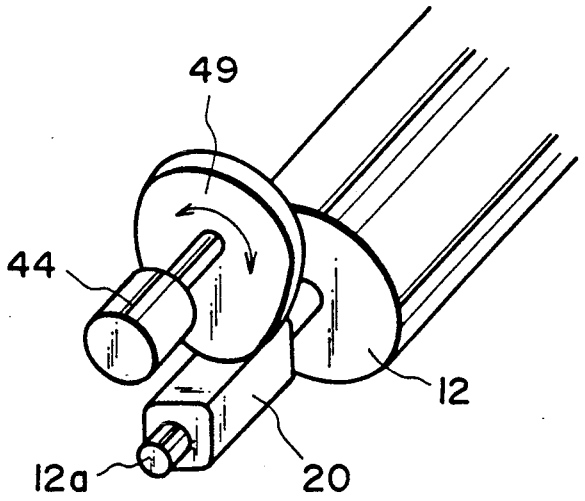

In the example in FIG. 55, the eccentric cam 49 is directly driven by the stepping motor 44, so that it can be stopped at any position.

Figure 56:
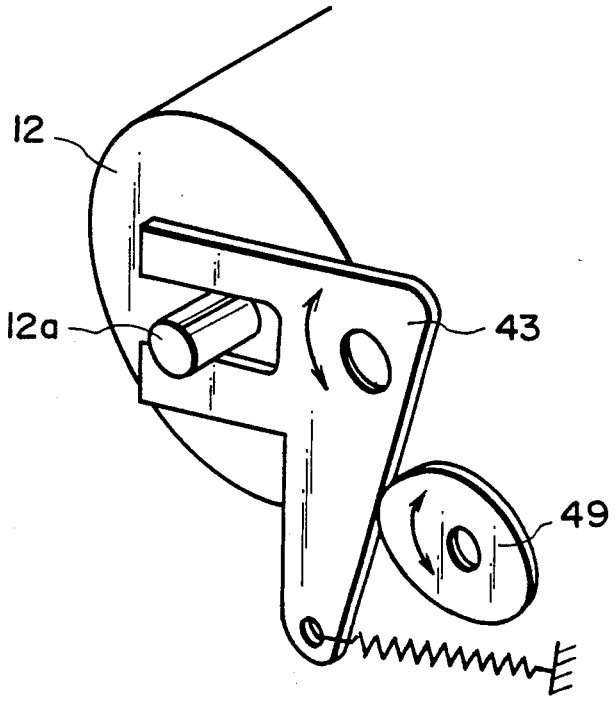

In the example shown in FIG. 56, the eccentric cam 49 is combined with the rockable lever 43.

Figure 57:
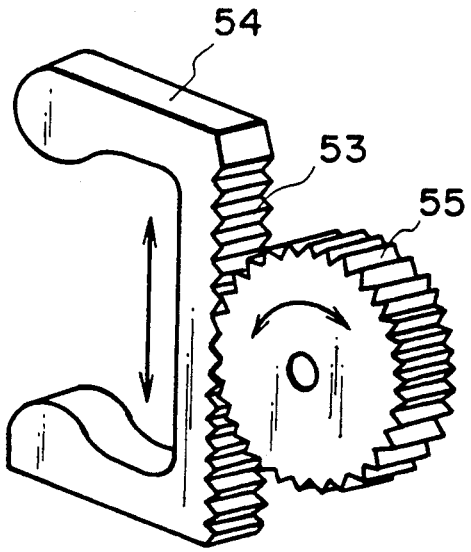

In the example shown in FIG. 57, a guide section 54 provided with a rack 53 is displaced by a pinion gear 55, which in turn displaces the tension roller 12.

Figure 58:
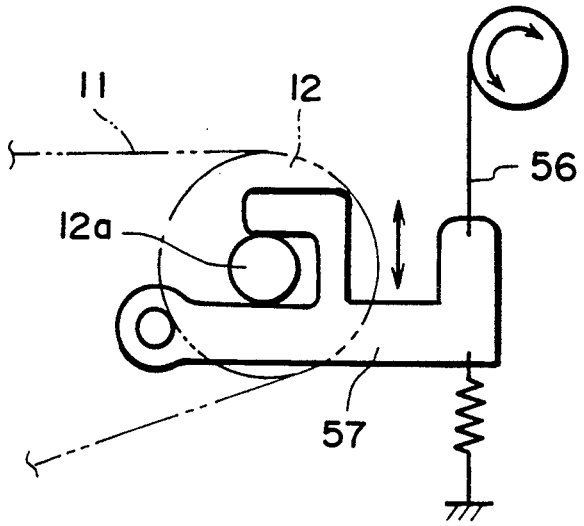

In the example shown in FIG. 58, a lever 57 is driven by a wire rope 56 to displace the tension roller 12.

Figure 59:
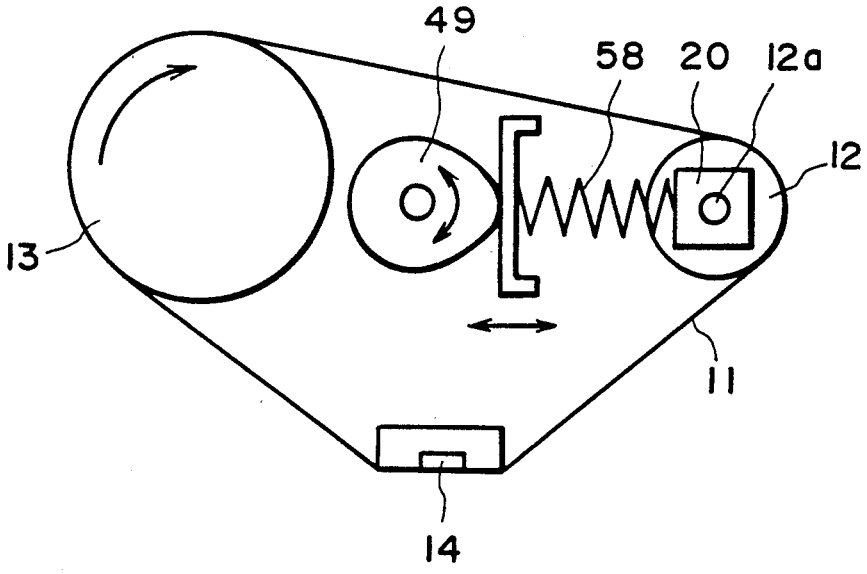

In the example shown in FIG. 59, the cam 49 and pusher spring 58 are employed to vary the tension given to the fixing film 12.

Figure 60:
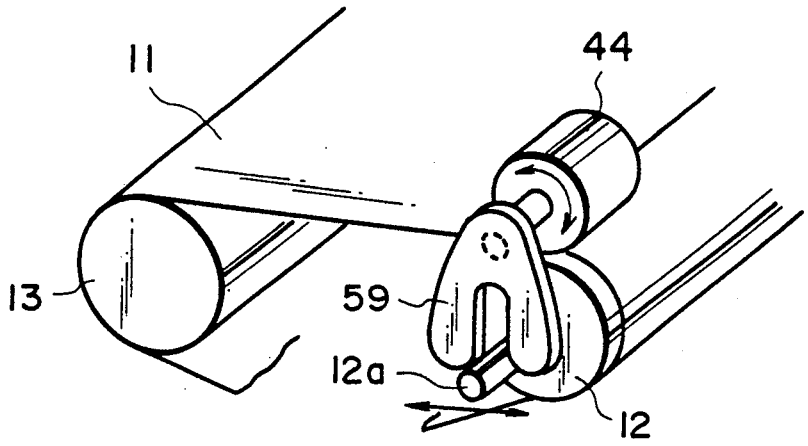

In the example shown in FIG. 60, the stepping motor 44 and the fork 59 are employed to vary the distance between the axis of the driving roller 13 and the axis of the tension roller 12.

Figure 61:
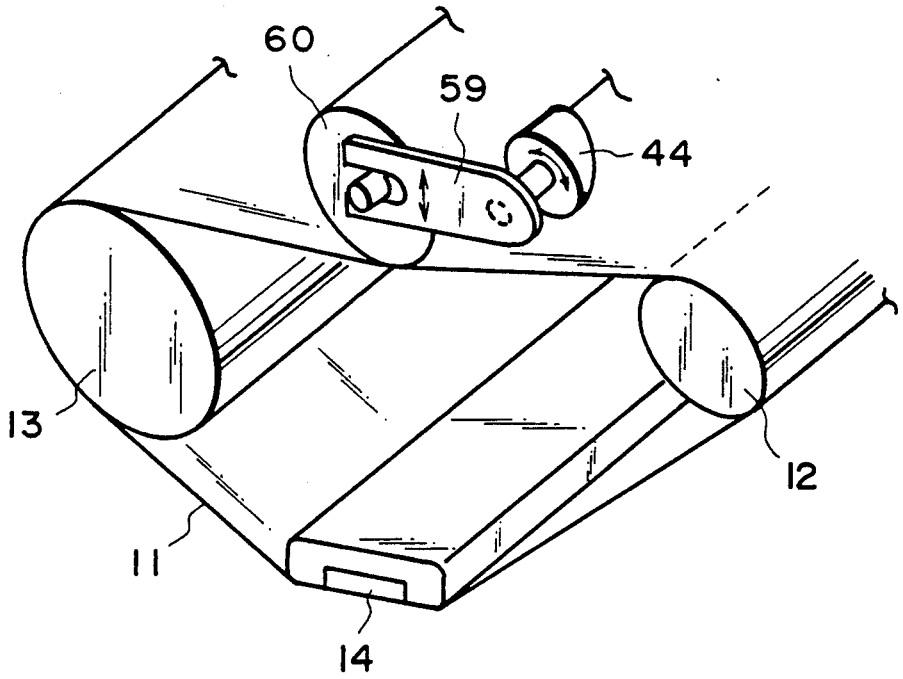

In the example shown in FIG. 61, a separate roller 60 is employed, which is rocked by a combination of the stepping motor 44 and the fork 59, and which also works as the roller for cleaning the film surface.

Figure 62:
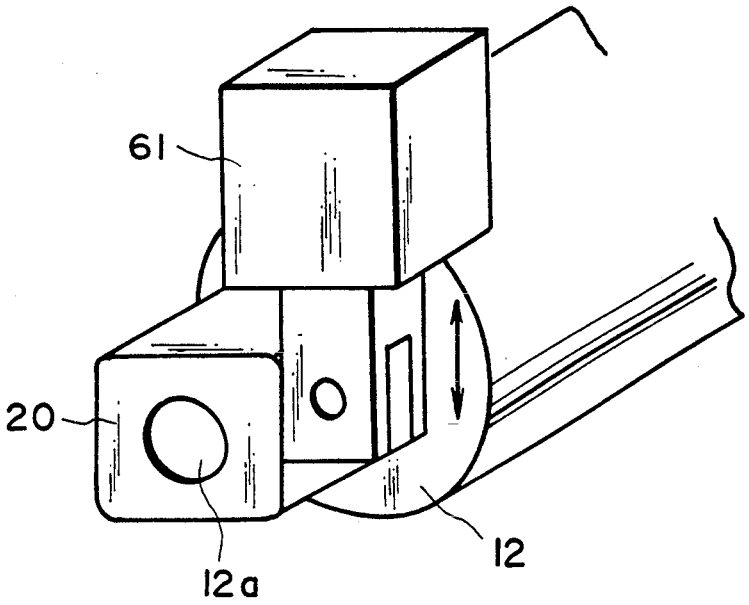

In the example shown in FIG. 62, the tension roller 12 is displaced by a solenoid 61.

Figure 63:
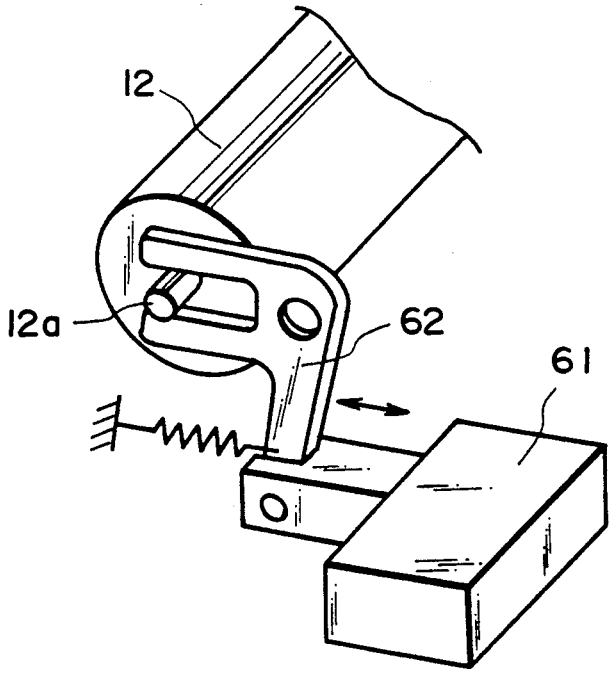

In the example shown in FIG. 63, the tension roller 12 is made to rock through the medium of a rockable lever 62.

Next, an embodiment employing the means for displacing the tension roller shown in FIGS. 50 and 51 is described.

Figure 64:
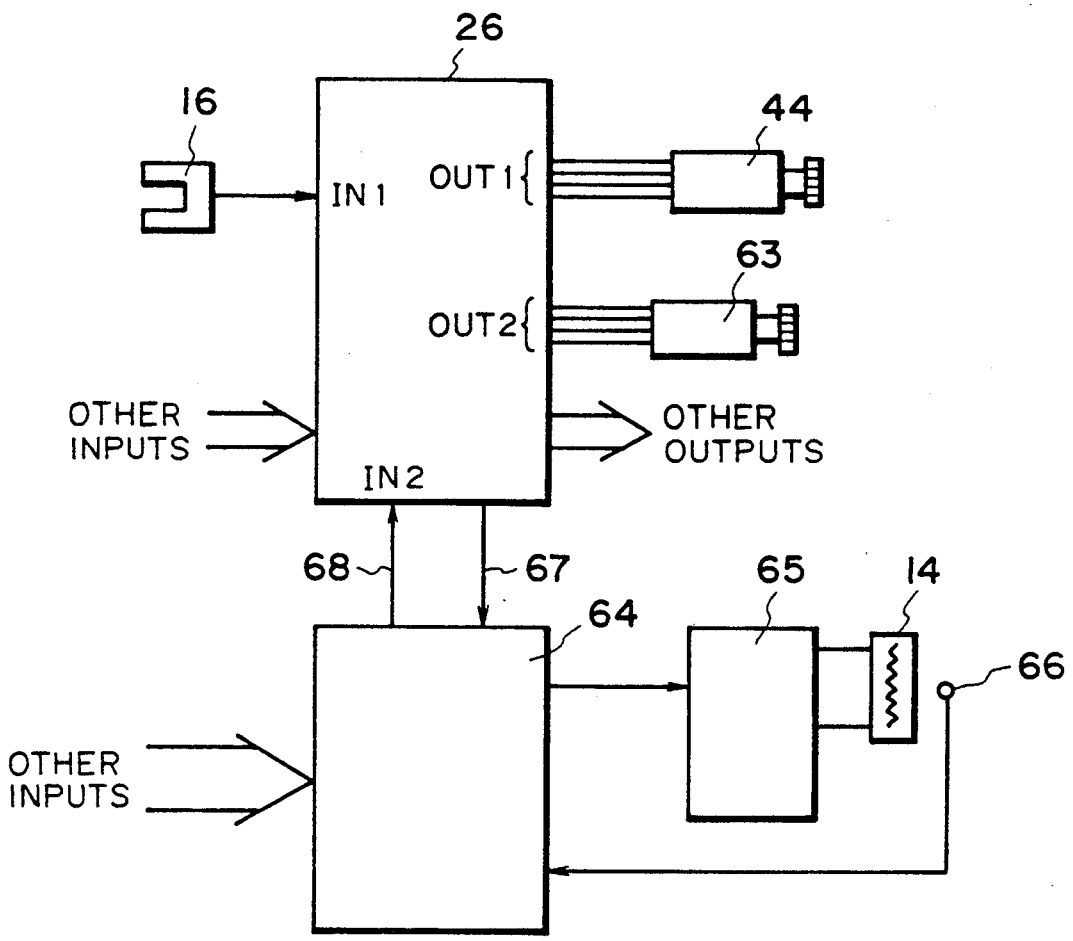
FIG. 64 is a schematic diagram of the control system of the alternative embodiment of the present invention.

FIG. 64 shows the control circuit.

Reference numeral 26 refers to a microcomputer, to the input port IN 1 of which the sensor 16 for detecting the film position is connected. To the output terminal OUT 1, the control signal for the stepping motor 44 which rotates the rockable lever 43 is outputted, and its rotational direction is determined by the excitation signal at OUT 1. To the output terminal OUT 2, a stepping motor 63 is connected, which is provided with a mechanism for sliding the rockable lever 43 in the D-E direction. Also, in order to carry out the copying operation, this microcomputer 26 is provided with the terminals for the other input and output signals of the copying machine employing this fixing device.

Reference numeral 64 refers to a control circuit for controlling the temperature (target temperature) of the heater 14, wherein the power is supplied through the power supply circuit 65 to the heater 14, and the temperature of the heater 14 is controlled through the use of the thermistor 66 positioned close to the heater 14.

A signal 67 is a signal for controlling the target temperature of the heater 14, and is inputted to the control circuit 64. Based on this signal, the power is supplied to the heater as needed during the copying sequence. A signal 68 is a signal for indicating the state in which the target temperature control of the heater 14 is executed by the control circuit 64.

If the signal 68 indicates "H," it means that the control circuit 64 is using the target temperature 1, and if it indicates "L," the target temperature 2, which is lower than the target temperature 1, is used. The control circuit 64 switches the target temperature, based on signals which indicate unshown conditions, such as toner type.

If the microcomputer 26 determines, based on the signal from the sensor 16, that the film is shifting frontward, it activates the motor 44 so that the tension roller 12 is displaced in the Q direction (FIG. 50). At this time, the motor 44 is moved till it comes in contact with the stopper. Also, if it determines, based on the signal from the sensor 16, that the film is shifting rearward, it activates the motor 44 so that the tension roller 12 is displaced in the P direction.

Figure 65:
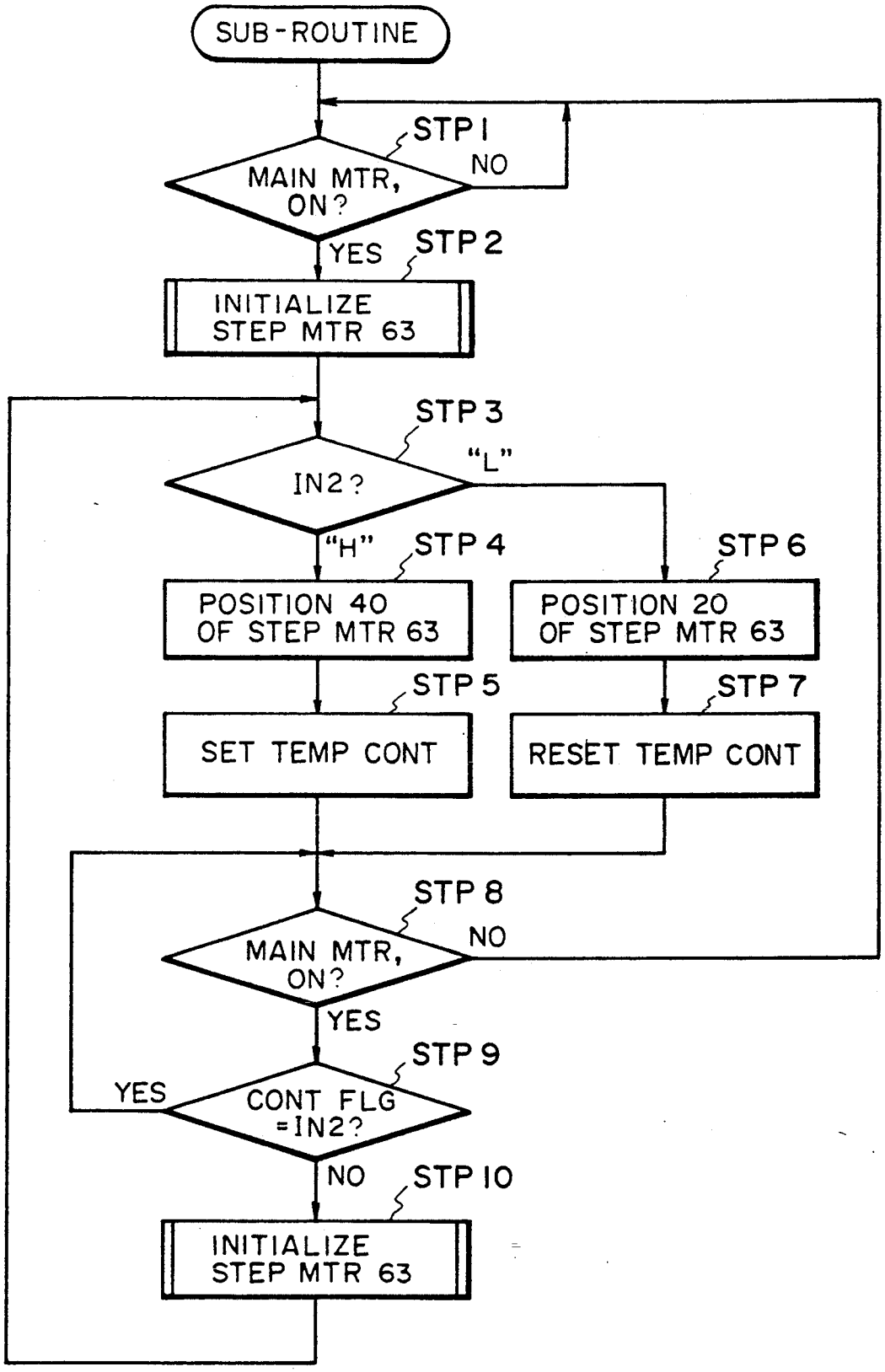
FIG. 65 is a flow chart for the lateral film shift control program.

Next, it is described how the microcomputer 26 controls the stepping motor 63. FIG. 65 is a flow chart for controlling the stepping motor 63. This program is a subroutine which is called, as needed or at a predetermined interval, by the sequence program of the copying machine.

First, in step 1, it is determined whether or not the main motor (not illustrated), which drives the copying machine main assembly and the fixing film, is on. If it is off, the program returns to the step 1. If it is on, the step 2 is followed.

The step 2 is a subroutine to initialize the stepping motor 63, wherein the motor 63 is moved so that the rockable lever 43 is moved in the E direction (FIG. 50, and FIG. 51(*b*)). The rockable lever 43 moves till it comes in contact with the stopper, and at this point, the positional adjustment of the motor 63 is stopped, and this position is used as the reference point for controlling the stepping position of the motor 63.

Then, the program proceeds to step 3, where it is determined whether or not the input IN 2 indicates "H." If it is "H," it is determined that the control is executed using target temperature 1, and step 4 is followed.

In the step 4, the motor 63 is moved by 40 steps, moving the rockable lever 43 in the D direction (FIG. 50 and FIG. 51(*a*)). Then, after the target temperature flag is set, step 8 is followed. Also, if the IN 2 indicates "L" in the step 3, step 6 is followed. In the step 6, the motor 63 is moved to a stepping position 20, and after the target temperature flag is reset, the step 8 is followed.

In the step 8, it is determined whether or not the main motor is on. If it is off, the program returns to the step 1. At this time, the phase excitation for the stepping motor 63 may be completely turned off. If the main motor is on in the step 8, step 9 is followed.

In the step 9, it is determined whether or not the direction of the target temperature flag is the same as that of the IN 2. If they are the same, the program returns to the step 8, where it is determined whether or not the main motor is on, if they are not the same in the step 9, step 10 is followed.

In the step 10, the stepping motor 63 is initialized, and then, the program returns to the step 3, where the position of motor 63 is adjusted to accommodate the new target temperature.

As was described above, the amount of displacement of the tension roller 12 can be controlled, depending on the target temperature.

In other words, a means is provided for controlling, depending on the change in the amount of heat generated by the heater 14, the means for selecting the lateral film shift speed; therefore, this embodiment is effective to realize minimum lateral shift speed fluctuation resulting from the changes in the coefficient of friction and the grease viscosity, which are affected by the thermal factors, so that the fixing film can be driven while its lateral shift speed is being stably controlled.

In this embodiment, two target temperatures 1 and 2 are employed, but multiple settings may be prepared, depending on conditions, such as toner type. In such a case, the same effect can be obtained by assigning plural bits to the signal 68.

In this embodiment, the rockable lever 43 is moved in the D-E direction by the stepping motor 63, but since the motor 44 which rotates the rockable lever 43 is a stepping motor, the stepping position of this motor 44 may be directly controlled.

The same effect can be accomplished by employing a stepping motor in place of the motor 44 in the structure shown in FIG. 53.

Also, in the structure shown in FIG. 54, the same effect can be accomplished if the position of the eccentric cam is controlled by controlling the number of times the solenoid 51 is turned on, instead of controlling the position of the stepping motor.

The control circuit was described as a microcomputer, but it may comprise a different type of logic circuit.

Next, another embodiment is described, in which the lateral film shift speed is selected depending on the change in the pressing force in the nip.

In other words, this embodiment is a device provided with a means for adjusting the pressing force applied to compress the recording material P, that is, the material to be heated, against the heater 14, with the endless film 11 being interposed between them, and a control means for adjusting the lateral film shift speed, depending on this pressing force.

Figure 66A:
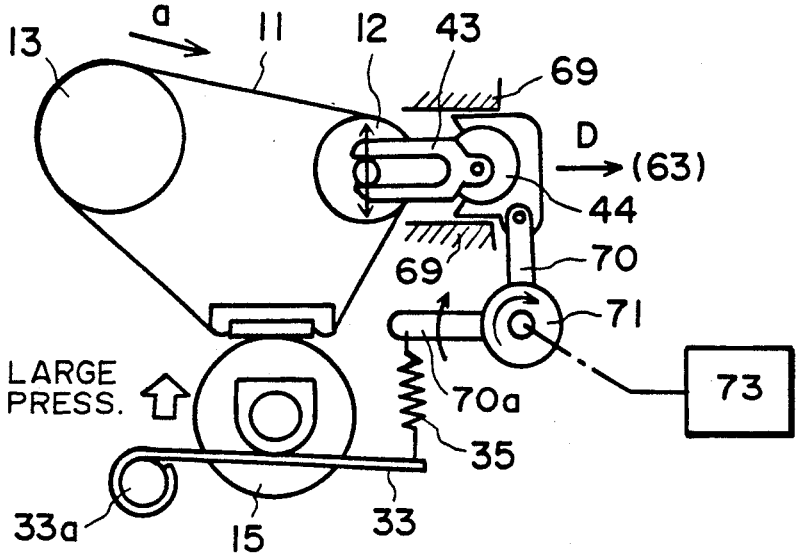
FIG. 66(*a, b*) are schematic diagrams describing the general structure and operation of yet another alternative embodiment of the present invention.
Figure 66B:
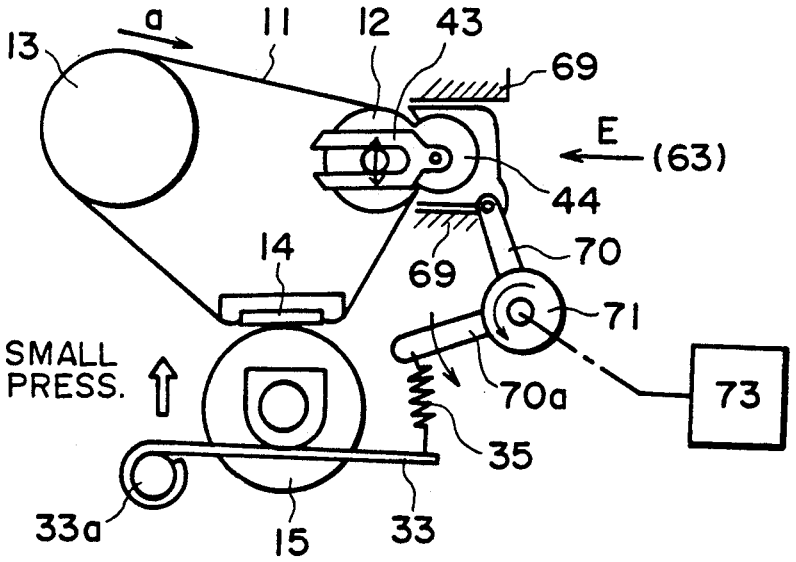

FIG. 66 is a sectional view of the image heating device in accordance with the embodiment of the present invention.

The pressing roller 15 is the pressing member which presses the recording material P against the heater 14, with the film 11 being interposed between them. Its pressing force is provided by the tension spring 35, through the medium of pressing lever 33. One end 33*a* of the pressing lever 33 is supported by the fulcrum about which it can rotate, and the other end is connected to the tension spring 35.

As the means for controlling the lateral film shift, the rockable lever 43 is rotatably mounted so as to displace the tension roller (follower roller) 12, and is driven by the stepping motor 44. That is, one end of the tension roller 12 is displaced in the vertical direction by the above means, whereby the film 11 is controlled so as to shift perpetually in alternating lateral directions, with help of the film position detecting means.

Also, the stepping motor 44 is mounted in a manner so that it can be slid in the D-E direction following guide sections 69. If it is slid in the D direction as is shown in FIG. 66(*a*), the amount of displacement can be increased, and if it is slid in the E direction as is shown in FIG. 66(*b*), the amount of displacement can be reduced. The relation between the amount of this displacement and the shift speed are proportional.

Incidentally, the mechanism for switching the sliding direction of the stepping motor 44 between the E and the D directions is omitted from the description, but it may comprise a mechanism which includes the stepping motor 63.

The stepping motor 44 is connected to a lever 70, one of the levers for changing the pressing force, and this lever 70 is rotatably supported by the axis of pressure adjustment knob 71. A lever 70*a*, the other lever, is connected to the tension spring 35 at its end which is opposite to the end where the above mentioned pressing lever 33 is attached. Reference numeral 73 refers to a stepping motor for rotating the pressure adjustment knob 71.

By turning the knob 71 to the clockwise direction as shown in FIG. 66(*a*), the pressing force increases, and at the same time, the amount of displacement increases. By turning it to the counterclockwise direction as shown in FIG. 66(*b*), the pressing force decreases, and also, the amount of displacement decreases.

In other words, it is possible to increase the amount of displacement of the tension roller 12 if the pressing force is large, imparting a large load for driving the film, and it is also possible to decrease the amount of displacement in the opposite case; as a result, the lateral film shift speed can be maintained approximately steady, even if the pressing force is changed.

Further, the mechanism for adjusting the pressing force is not limited to those embodiments, and needless to say, the pressing force and the amount of the displacement can be easily set by each of the devices. Further, the control means for adjusting the lateral film shift speed may be structured as shown in FIGS. 52 to 63, instead of being structured to include the rockable lever 43, the stepping motor 44, and the like.

Figure 67:
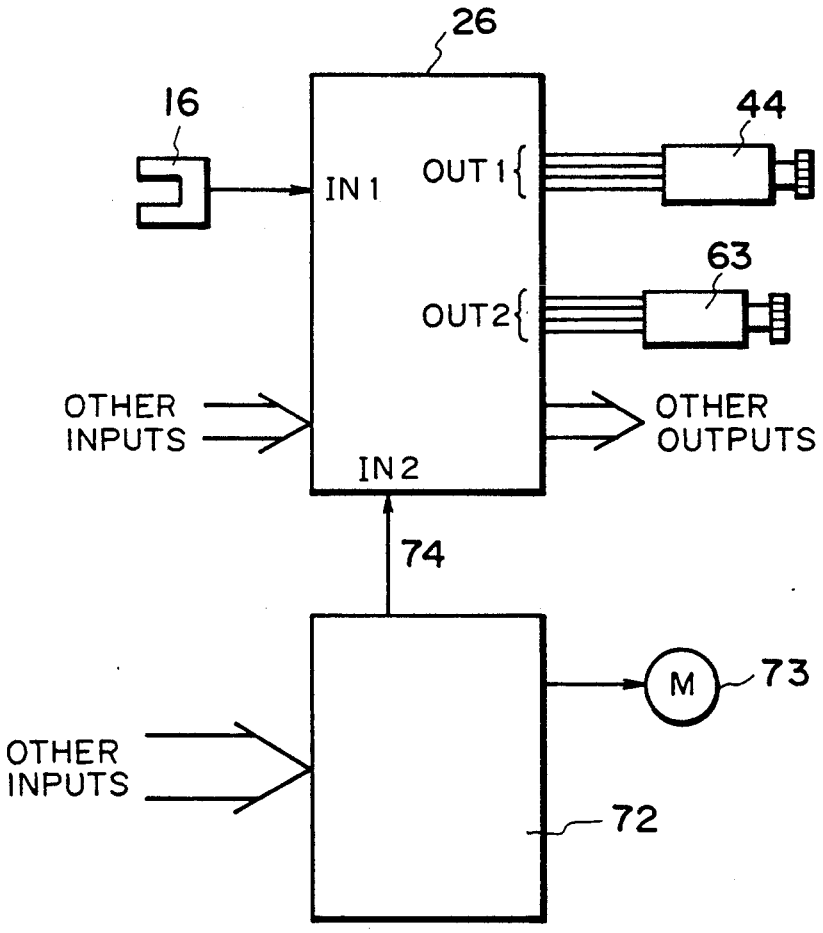
FIG. 67 is a schematic diagram of the control system.

FIG. 67 shows the control circuit of this embodiment.

Reference numeral 26 refers to a microcomputer, to the input port IN 1 of which, the sensor 16 to detect the film position is connected. To the output terminal OUT 1, the control signal for the stepping motor 44, which rotates the rockable lever 43, is outputted, and the rotational direction is determined by the excitation signal at OUT 1. To the output terminal OUT 2, a mechanism 63 for sliding the rockable lever 43 in the D–E direction is connected.

Also, in order to carry out the copying operation, this microcomputer 26 is provided with the terminals for the other input and output signals of the copying machine employing this fixing device.

Reference numeral 72 refers to a control circuit for controlling the pressing force of this fixing device, which controls the pressing force of the fixing device by controlling the stepping position of the motor 73 which rotates the pressing force adjustment knob 71.

A signal 74 is a signal indicating the state of the pressing force of the fixing device, controlled by the control circuit 72. If the signal 74 indicates "H," it means that the control circuit 72 is executing the control by using the pressing force 1, and if it indicates "L," it means that the control is being executed by using the pressing force 2, which is weaker than the pressing force 1.

The control circuit 72 adjusts the pressing force, based on the unshown signals indicating the conditions such as toner type. Also, if the microcomputer 26 determines, based on the signal from the sensor 16, that the film is shifting forward, it activates the motor 44 to displace the tension roller 12 in the downward direction. At this time, the motor is activated till it comes in contact with the stopper. If the microcomputer 26 determines, based on the signal from the sensor 16, that the film is shifting rearward, it activates the motor 44 to displace the tension roller 12 in the upward direction.

Next, it is described how the microcomputer 26 controls the stepping motor 63.

Figure 68:
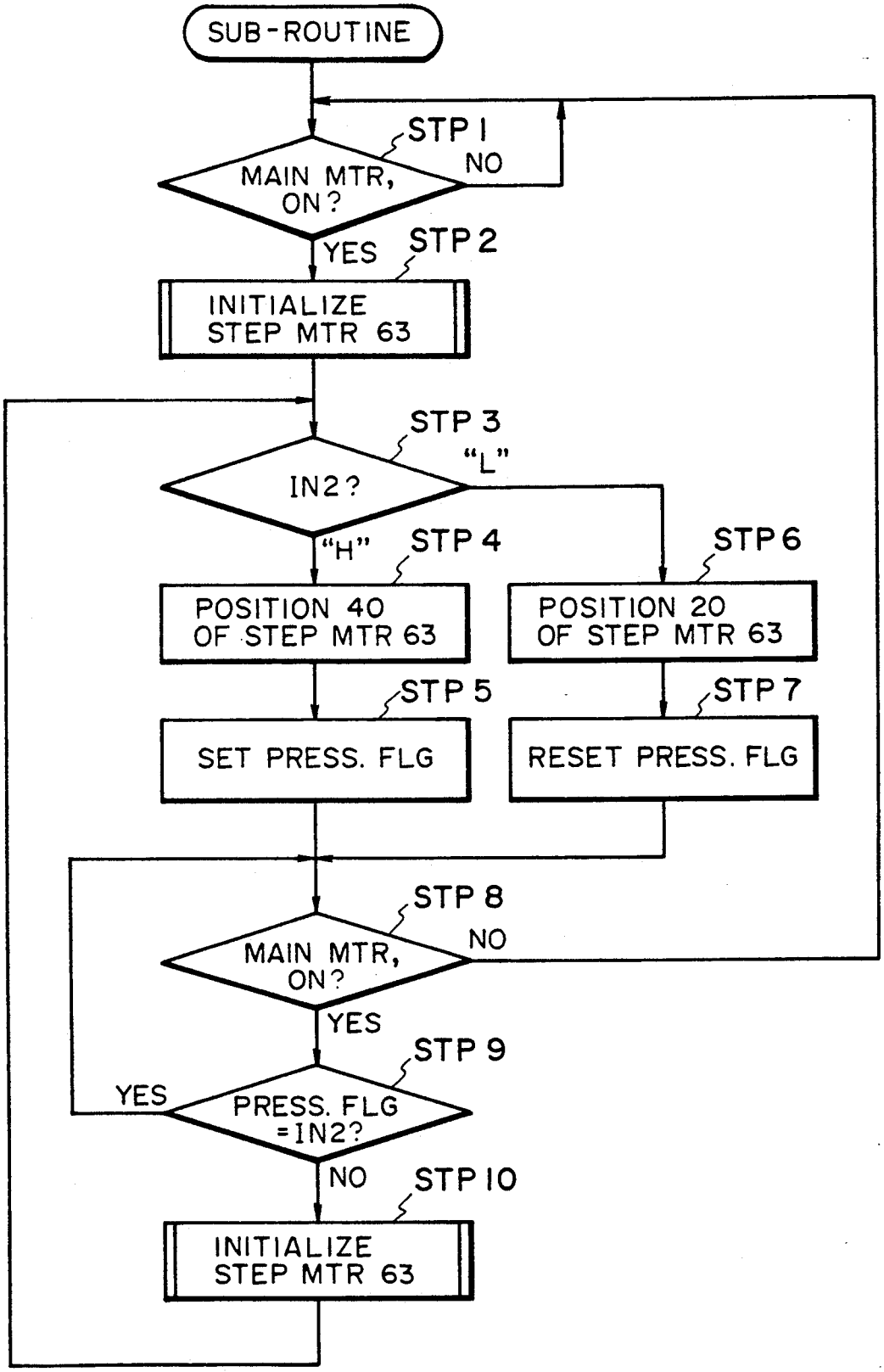
FIG. 68 is a flow chart of the lateral film shift control program.

FIG. 68 is a flow chart for controlling the stepping motor 63. This program is a subroutine which is called by the sequence program of the copying machine, as needed, or at a predetermined interval.

First, in step 1, it is determined whether or not the main motor (not illustrated), which drives the copying machine main assembly and the fixing film, is on. If it is off, the program returns to the step 1. If it is on, step 2 is followed.

The step 2 is a subroutine to initialize the stepping motor 63, where the motor 63 is activated to move the rockable lever 43 in the E direction till it comes in contact with the stopper, where the motor 63 loses its control. Then, this position is used as the reference point for controlling the stepping position of the motor 63.

Then, the program proceeds to step 3, where it is determined whether or not the input IN 2 indicates "H." If it indicates "H," it is determined that the control is executed using the pressing force 1, and step 4 is followed.

In the step 4, the motor 63 is activated to reach the stepping position 40, while moving the rocking lever 43 in the D direction. Then, after the pressure flag is set, step 8 is followed. If IN 2 indicates "L" in the step 3, step 6 is followed.

In the step 6, the motor 63 is activated to reach the stopping position 20, and then, after the pressure flag is reset, the step 8 is followed.

In the step 8, it is determined whether or not the main motor is on. If it is off, the program returns to the step 1. At this time, the phase excitation of the stepping motor 63 may be completely turned off. If it is on in the step 8, step 9 is followed.

In the step 9, it is determined whether or not the pressure flag and the IN 2 indicate the same direction. If they indicate the same, the program returns to the step 8, where it is determined whether or not the main motor is on. If they do not indicate the same in the step 9, step 10 is followed.

In the step 10, the stepping motor 63 is initialized, and then, the program returns to the step 3, where the stepping position of the motor 63 is freshly controlled, depending on the new pressure.

The amount of displacement of the tension roller 12 can be controlled depending on the pressing force of the fixing device in the above mentioned manner.

In other words, since this embodiment is provided with a control means for adjusting the lateral film shift speed depending on the selected pressing force of the pressing member, it becomes possible to prevent wrinkles, creases and the likes, which are caused by the sudden lateral shift of the film; to establish always the optimum lateral film shift speed matching the pressing force; and to contain the perpetually alternating lateral shift of the film 11 within an approximately predetermined range. Therefore, the lateral film shift can be easily controlled to minimize the fixing film damage.

In this embodiment, only two settings, the pressing forces 1 and 2, are prepared for the fixing device, but a large number of settings may be prepared depending on other conditions, such as toner type. In such a case, the same effect can be accomplished by assigning multiple bits to the signal 74.

In this embodiment, the rockable lever 43 is moved by the stepping motor 63, but since the motor 44 which rotates the lever 43 is also a stepping motor, the stepping position may be directly controlled by this stepping movement of this motor 44.

If the structure shown in FIG. 53 is employed as the control means for adjusting the lateral film shift speed, the same result can be obtained by employing a stepping motor as the motor 44 to control the stepping position.

Further, in case the structure shown in FIG. 54 is adopted, the same effect can be obtained if the position of the eccentric cam is controlled by controlling the number of times the solenoid 51 is turned on, instead of controlling the stepping position of the stepping motor 63.

In this embodiment, the control circuit was described as a microcomputer, but it may comprise a different type of logic circuit.

In this embodiment, the signal to indicate the control status is outputted from the pressing force control circuit, but the microcomputer may execute the control by determining the pressing force, based on the signal from a sensor provided for detecting the position of the pressing roller 15. The sensor to detect the pressing force may be provided on the pressing lever 33 or the pressing force adjustment lever 70, instead of being provided on the pressing roller; the effect will be the same.

The same result can be obtained even if the pressing force control circuit and the lateral film shift control circuit are a part of the same system (including the microcomputer 26).

Next, another alternative embodiment is described.

This embodiment is a device provided with a control means for changing the rotation speed at which the endless film 11 is driven, and another control means for adjusting the lateral film shift speed depending on the film driving speed controlled by the former control means.

In this embodiment, the mechanism shown in the above mentioned FIGS. 50 and 51 is adopted as the control means for adjusting the lateral film shift speed. Incidentally, such mechanisms as shown in FIGS. 52 to 63 may be adopted.

Figure 69A:
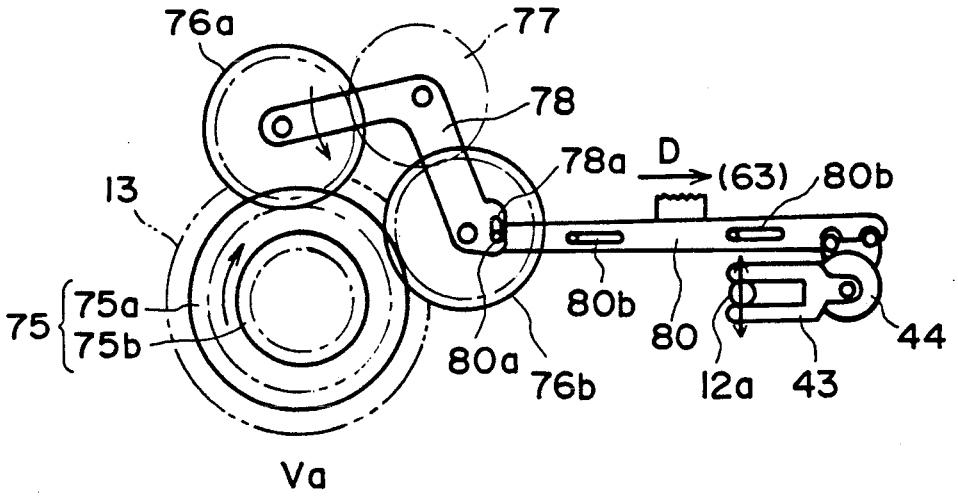
FIG. 69(*a, b*) are schematic diagrams describing the general structure and the operation of yet another alternative embodiment of the present invention.
Figure 69B:
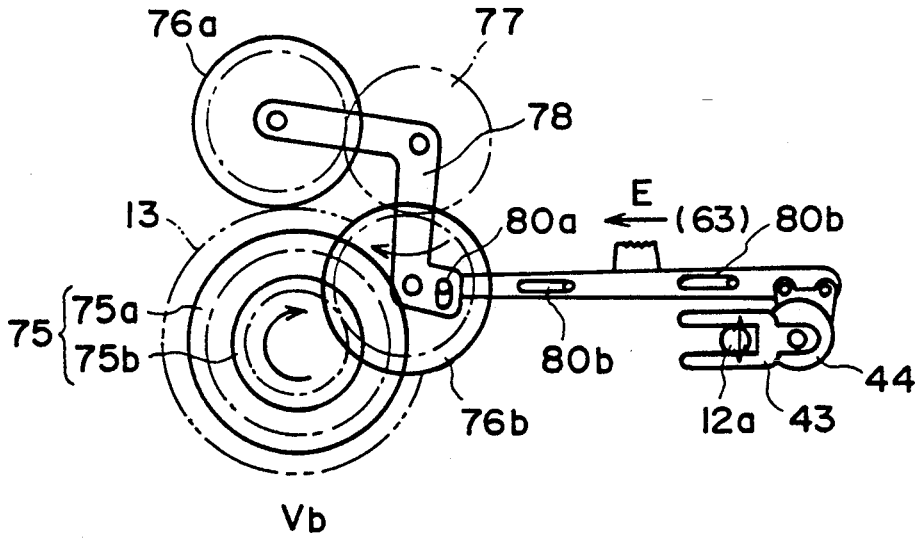

FIG. 69 is a schematic diagram of the structure of the control means for changing the rotation speed at which the film 11 is driven.

At the end section of the film driving roller 13, a driving gear 75 is mounted. This driving gear 75 comprises a first gear 75*a* for a first driving speed Va, and a second gear 75*b* for a second driving speed Vb. The driving force from the main assembly is transmitted via a first idler 76*a* and a second idler 76*b*, respectively. These idlers 76*a* and 76*b* are supported on driving force selection arm 78 which is rotatable about a fulcrum, in other words, the center of the driving force transmission gear 77. FIG. 69(*a*) shows the state in which the driving speed Va is selected, and FIG. 69(*b*) shows the state in which the driving speed Vb is selected, respectively. In this embodiment, the driving speed is set up as follows:

$Va < Vb$

Further, in the driving force selection arm 78*a*, an elongated hole 78*a* is provided, into which a projection 80*a* of a speed selection lever 80 is fitted. On the speed selection lever 80, the stepping motor 44 (FIG. 50) is mounted, which is the driving means for the above mentioned lateral film shift control. The speed selection lever 80 can be slid in its longitudinal direction along the elongated holes 80*b* and 80*b*. If the speed selection lever 80 is slid in the arrow D direction as shown in FIG. 69(*a*), the rockable lever 43 for the lateral film shift control is slid in the arrow D direction; therefore, the amount of displacement can be increased. In FIG. 69(*b*), the slide is in the arrow E direction; therefore, the amount of displacement can be decreased. In other words, if the film driving speed is small, the amount of displacement can be increased, and if the film driving speed is large, the amount of displacement can be decreased.

This embodiment represents the case in which two speeds are available as the film driving speed, but needless to say, more than three speeds, or stepless arrangements, may be prepared. Further, there is no restriction on the relation between the film driving speed range and the displacement amount range. They may be optionally set up according to each device.

Figure 70:
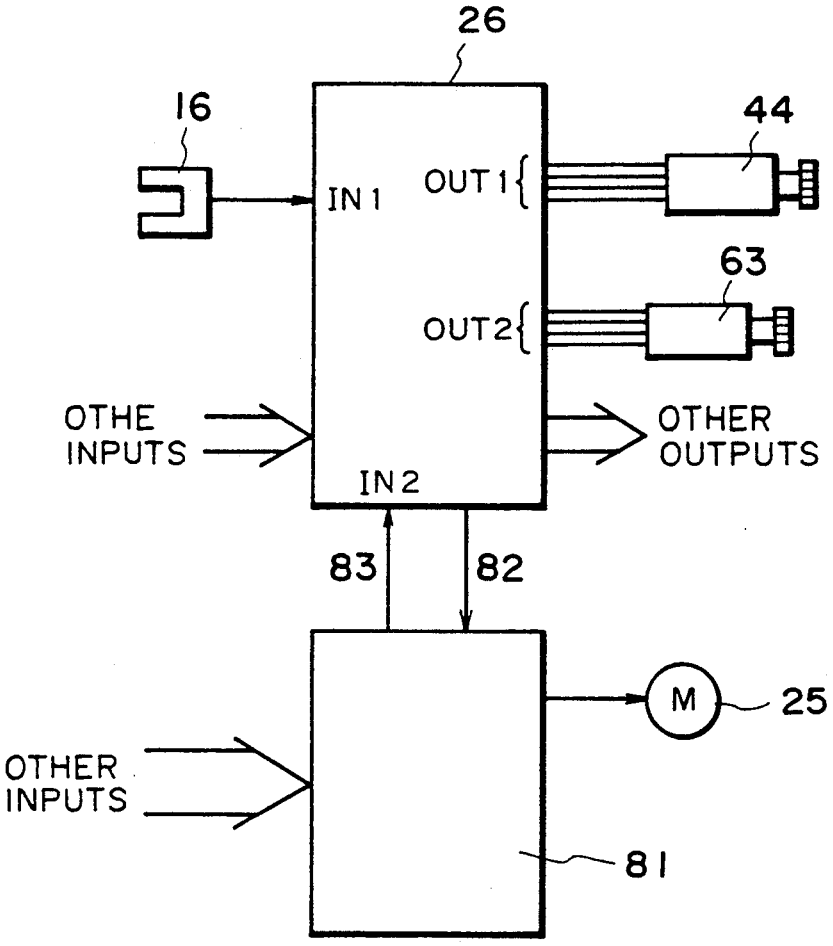
FIG. 70 is a schematic diagram of the control system.

FIG. 70 shows the control circuit of this embodiment.

Reference numeral 26 refers to a microcomputer, to the input port IN 1 of which, the sensor 16 to detect the film position (FIGS. 1, 2, and 5) is connected. To OUT 1, the control signal for stepping motor 44, which rotates the rockable lever 43, is outputted, and the rotational direction is determined by the excitation signal at OUT 1. To OUT 2, the stepping motor 63 is connected, which belongs to the mechanism for sliding the rockable lever 43 in the D–E direction. Further, in order to carry out the copying operation, this microcomputer computer 26 is provided with the terminals for the other input and output signals of this copying machine employing this fixing device.

Reference numeral 81 refers to a control circuit to control the film rotation speed of this fixing device, and it controls the speed of the motor 25 (FIGS. 1 and 2), thereby controlling the film rotation speed. The motor 25 is set up to drive the film, independently from the main motor of the copying machine.

A signal 82 is a film driving signal which is inputted to a control circuit 81 from the microcomputer 26. This signal is used as needed to drive the film during the copying sequence. A signal 83 is a signal to indicate the state of film rotation speed controlled by the control circuit 81.

If the signal 83 indicates "H," it means that the control circuit 81 is executing the control by using the film speed 1, and if it indicates "L," the control is being executed by using the film speed 2, which is faster than the film speed 1. The control circuit 81 switches the film speed, based on the unshown signals indicating conditions, such as toner type.

Also, if the microcomputer 26 determines, based on the signal from the sensor 16, that the film is shifting frontward, it activates the motor 44 to displace the tension roller 12 in the Q direction (FIG. 50). At this time, the motor 44 is activated till it comes in contact with the stopper. If the microcomputer 26 determines, based on the signal from the sensor 16, that the film is shifting rearward, it activates the motor 44 to displace the tension roller in the P direction.

Figure 71:
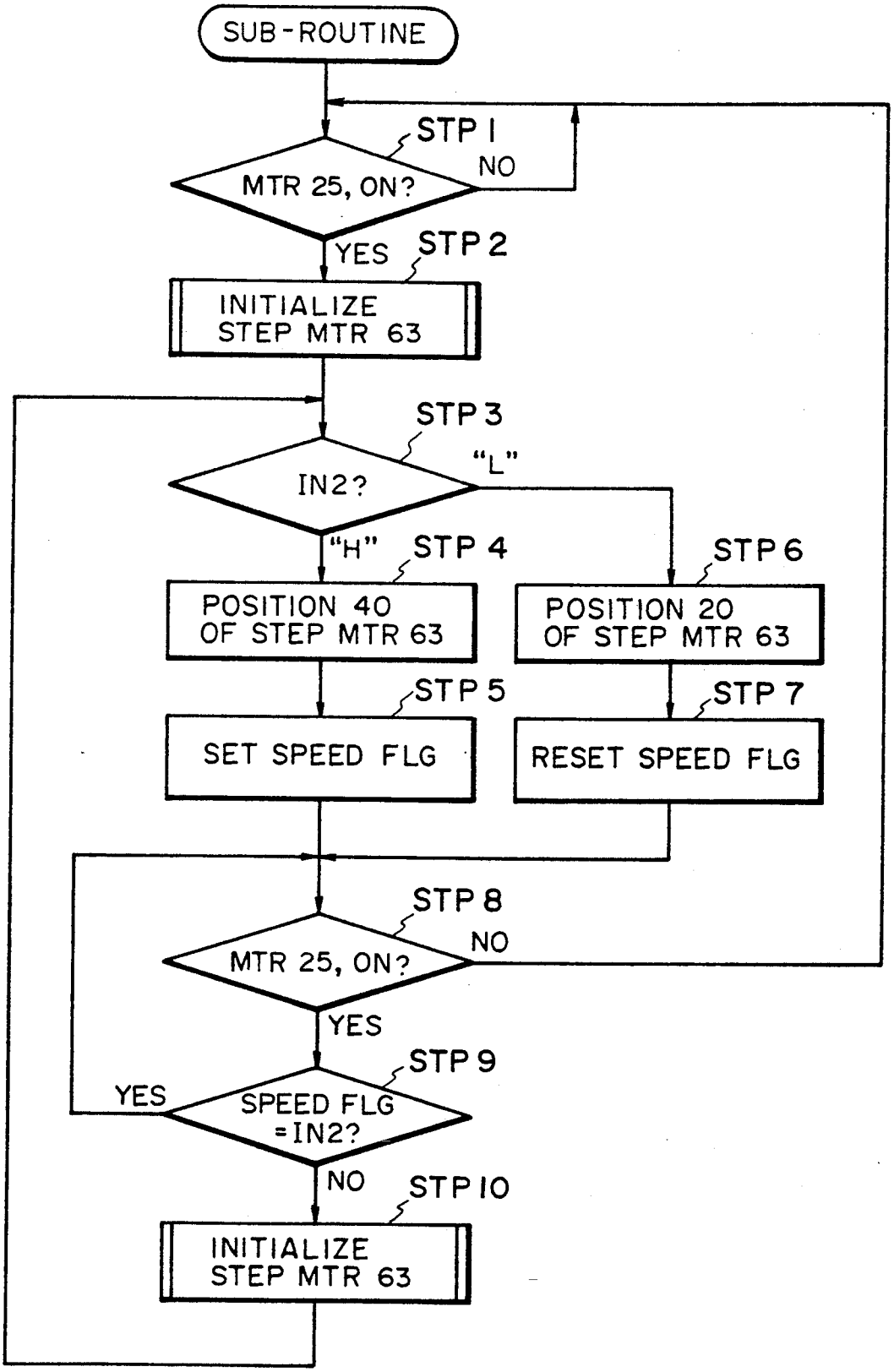
FIG. 71 is a flow chart for the lateral film shift control program.

FIG. 71 shows the control flow chart for this embodiment.

This program is a subroutine which is called by the sequence program of the copying machine, as needed, or at a predetermined interval.

First, in step 1, it is determined whether or not the main motor (not illustrated), which drives the copying machine main assembly and the film, is on. If it is off, the program returns to the step 1. If it is on, step 2 is followed.

The step 2 is a subroutine in which the stepping motor 63 is initialized; the motor 63 is activated to move the rockable lever 43 in the E direction; and the rockable lever 43 is made to come in contact with the stopper, nullifying the control of the motor 63. Then, this position is used as the reference point for controlling the stepping position of the motor 63.

Then, the program proceeds to step 3, where it is determined whether or not the input IN 2 indicates "H." If it indicates "H," it is determined that the control is executed for the target temperature 1; therefore, step 4 is followed.

In the step 4, the motor 63 is activated to reach the stepping position 40, moving the rockable lever 43 in the D direction. Then, after the temperature control flag is set, step 8 is followed. If the IN 2 indicates "L" in the step 3, step 6 is followed. In the step 6, the motor 63 is activated to reach the stepping position 20, and then, after the temperature control flag is reset, the step 8 is followed.

In the step 8, it is determined whether or not the motor 25 is on. If it is off, the program returns to the step 1. At this time, the phase excitation for the stepping motor may be completely turned off. If the motor 25 is on in the step 8, step is followed.

In the step 9, it is determined whether or not the film speed flag and the IN 2 indicate the same direction. If they are the same, the program returns to the step 8, where it is determined whether or not the motor 25 is on. If they are not the same in the step 9, step 10 is followed.

In the step 10, the stepping motor 63 is initialized, and then, the program returns to the step 3, where the stepping position of the motor 63 is freshly adjusted, based on the new target temperature.

The amount of displacement of the tension roller 12 is controlled, based on the film speed, in the above mentioned manner.

In other words, since a control means is provided for adjusting the lateral film shift speed, based on the selected film driving speed, it becomes possible to contain the lateral film shift speed itself within an approximately predetermined range; to arrest the increase in the frequency at which the lateral film shift direction is alternated; and finally, to execute a stable lateral film shift control. Therefore, the film damage is minimized, and also, the change in the film driving speed can be effectively handled.

In this embodiment, only two speeds, the film driving speeds 1 and 2, are adopted, but more than two speeds may be set up, depending on conditions, such as toner type. In such a case, the same effect can be obtained by assigning plural bits to the signal 83.

In this embodiment, the rockable lever 43 is moved in the D–E direction by the stepping motor 63, but since the motor 44 which rotates the rockable lever 43 is also a stepping motor, the stepping position of this motor 44 may be directly controlled.

In the structure shown in FIG. 57, the same result can be obtained if a stepping motor is employed as the motor 44 to control the stepping position. Also, in the structure shown in FIG. 54, the same result can be accomplished if the position of the eccentric cam is controlled by controlling the number of times the solenoid 41 is turned on,- instead of controlling the stepping position of the stepping motor 63.

In this embodiment, the control circuit is described as a microcomputer, but it may comprise a different type of logic circuit.

In this embodiment, the signal to indicate the control status is outputted from the film speed control circuit, but the driving roller 13 may be provided with an encoder, the signal from which is detected by the microcomputer, so as to determine the speed of the driving roller 13.

Further, the same result can be obtained if the film speed is detected using a pattern or an inclination provided at the lateral end of the film, instead of mounting the encoder on the driving roller 13.

The same result can be obtained if the film speed control circuit and the lateral film shift control circuit are part of by the same system (which includes the microcomputer 26).

The same effect can be obtained not only in the copying machine in which only the film speed can be changed but also in the copying machine in which the speed of the copying machine itself is also controlled.

Next, an embodiment is described in which the lateral film shift speed is controlled depending on the size of the recording material.

Figure 72:
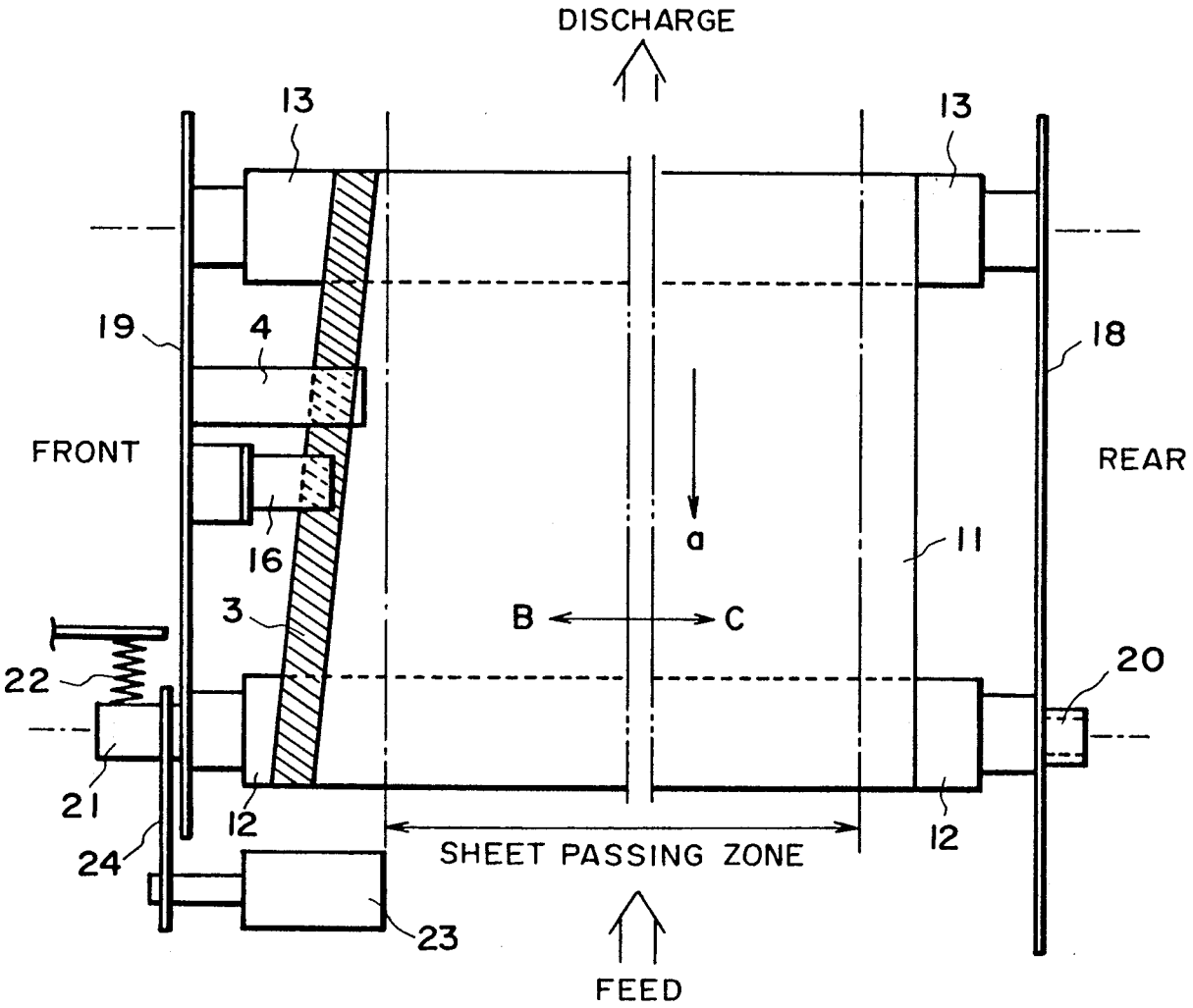
FIG. 72 is a plan view of the image heating device in accordance with yet another alternative embodiment of the present invention.
Figure 73:
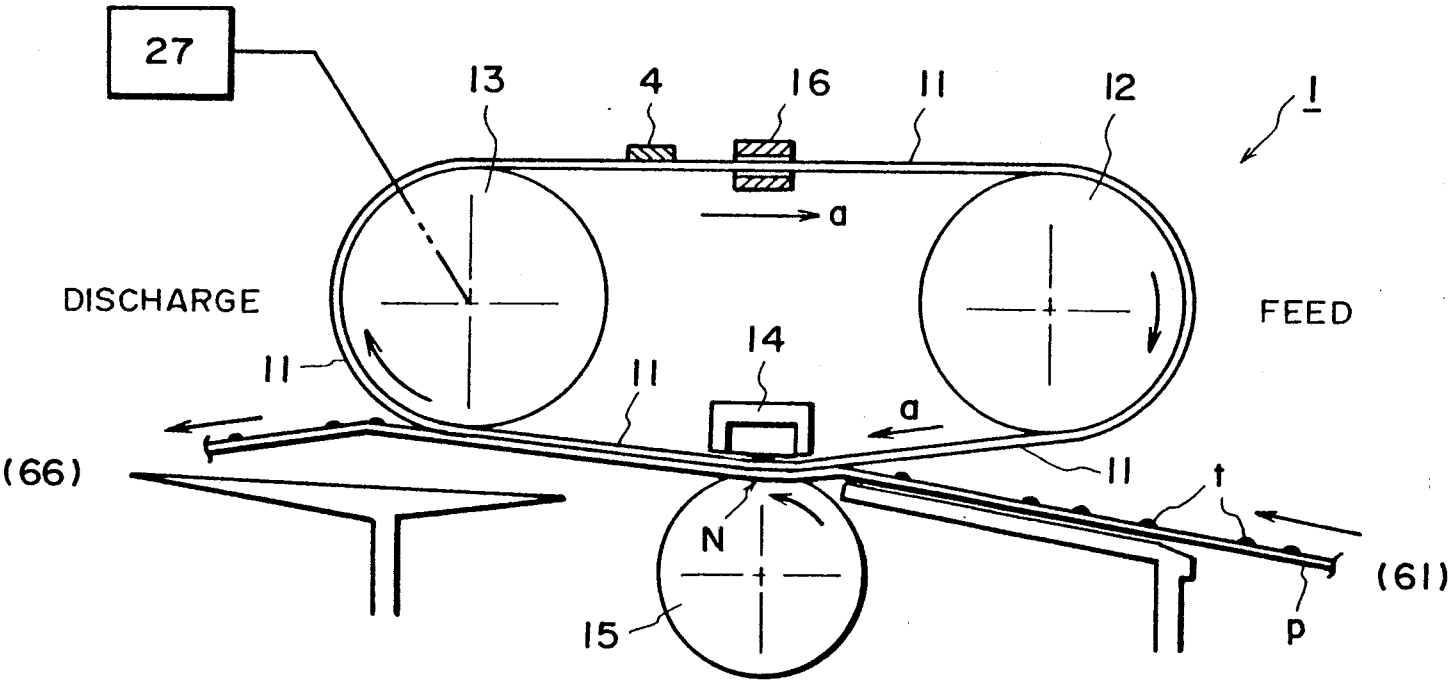
FIG. 73 is a sectional view of the embodiment in FIG. 72.
Figure 74:
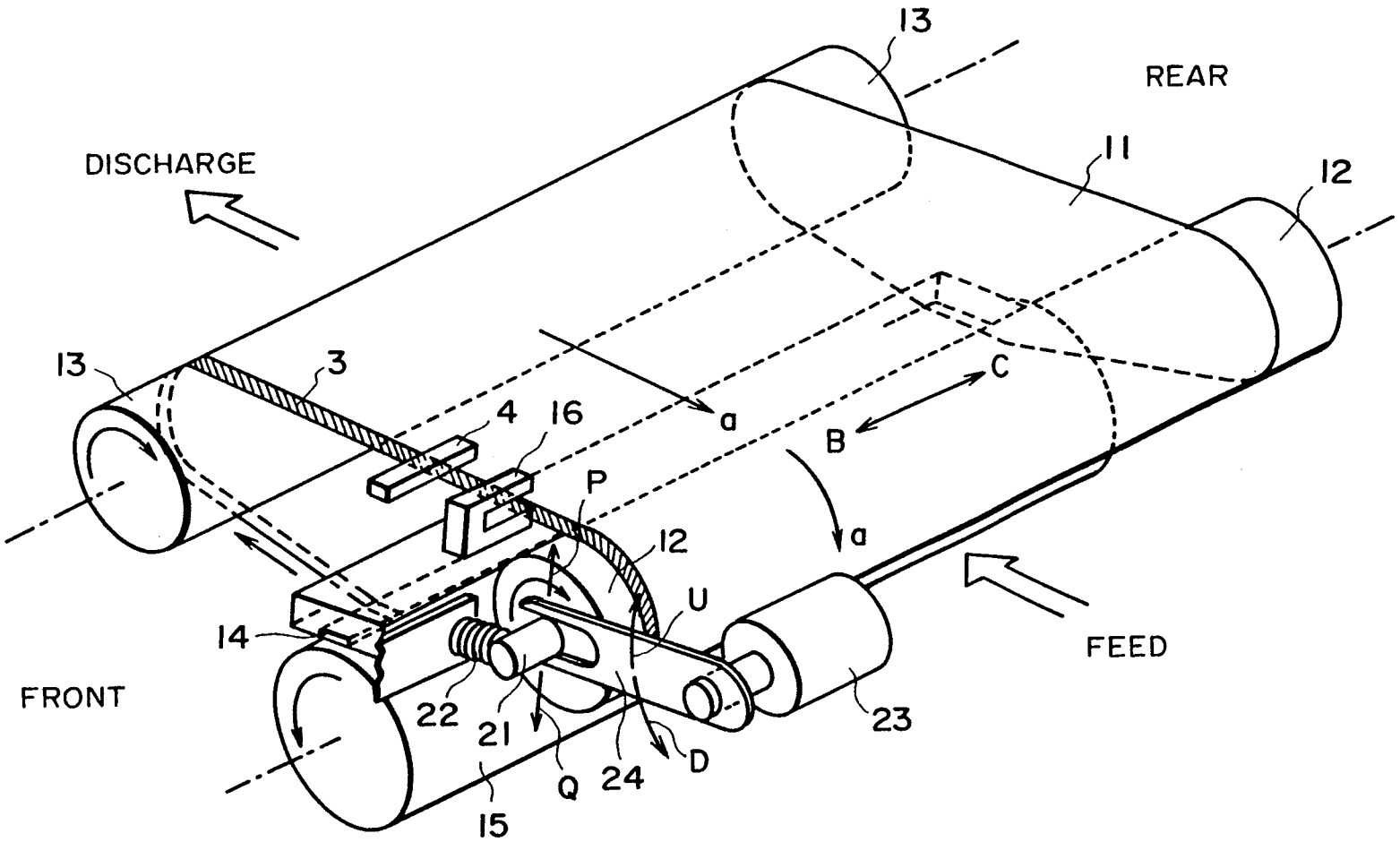
FIG. 74 is a perspective view of the embodiment in FIG. 72.

FIGS. 72 to 74 show the image heating device in accordance with the embodiment of the present invention.

In this embodiment, the driving roller 13 of the endless film 11, and the follower roller 12 are mounted, on the bearings, between the front side plate 19 and the rear side plate 18. Reference numerals 21 and 20 refer to the front side bearing and the rear side bearing, respectively, for the follower roller 12.

As the film 11 is driven by the driving roller 13 to rotate in the direction indicated by the arrow a, the film begins to shift to the right (the rearward direction C of the device) or the left forward direction B of the device), relative to the film width direction, that is, in the longitudinal direction of the rollers 13 and 12, away from its initial location outlined by the solid line in FIG. 72, due to the positional relations (positional variance in each direction of X, Y, and Z axes) among three members: the rollers 13 and 12, about and between which the film 11 is stretched, and the heater 14, unless the accuracy in parallelism (in X, Y and Z axes directions) among the driving roller 13, follower roller 12, heater 14, and pressing roller 15 is high enough to have ±0 error; therefore, the lateral ends of the film are rubbed against the side plate 18 or side plate 19, eventually being damaged.

In this embodiment, the front side bearing 21 of the follower roller 12 is mounted in a manner so that it can be moved in the vertical direction indicated by arrows P and Q in FIG. 74, and this bearing 21 can be moved up or down, that is, in the P or Q direction, by a fork arm 24 which is directly driven by a stepping motor 23 so as to be rocked upward or downward; therefore, the parallelism of the follower roller 12 relative to the driving roller 13 can be varied.

As the stepping motor 23 rotates in the clockwise direction, in other words, as the arm 24 is rotated in the clockwise direction U, the front side end section of the follower roller 12 is displaced in the direction indicated by the arrow mark P. It is set up so that the film 11 laterally shifts in the frontward direction indicated by an arrow mark B when the front side end section of the follower roller 12 is displaced in the arrow mark P direction in the above mentioned manner. Conversely, if the stepping motor 23 rotates in the counterclockwise direction, in other words, if the arm 24 is rocked in the counterclockwise direction D, displacing the front end section of the follower roller 12 downward, that is, in the arrow mark Q direction, the film 11 laterally shifts in the rearward direction indicated by the arrow mark C.

In this embodiment, in order to make the film 11 shift toward the front side of the device in FIG. 72, the stepping motor 23 is rotated in the clockwise direction to lift the follower roller 12, depending on the output of a detection means for detecting the size of the transfer material, that is, the material to be fed into and heated in the device. Conversely, in order to make the film 11 shift toward the rear side of the device, the stepping motor 23 is rotated in the counterclockwise direction to lower the follower roller 12. Therefore, in this arrangement, the lateral shift speed of the endless film 11 can be adjusted by changing the inclination of the follower roller 12, and the inclination of the follower roller 12 is changed by controlling the number of driving pulses sent to the stepping motor 23.

Figure 75:
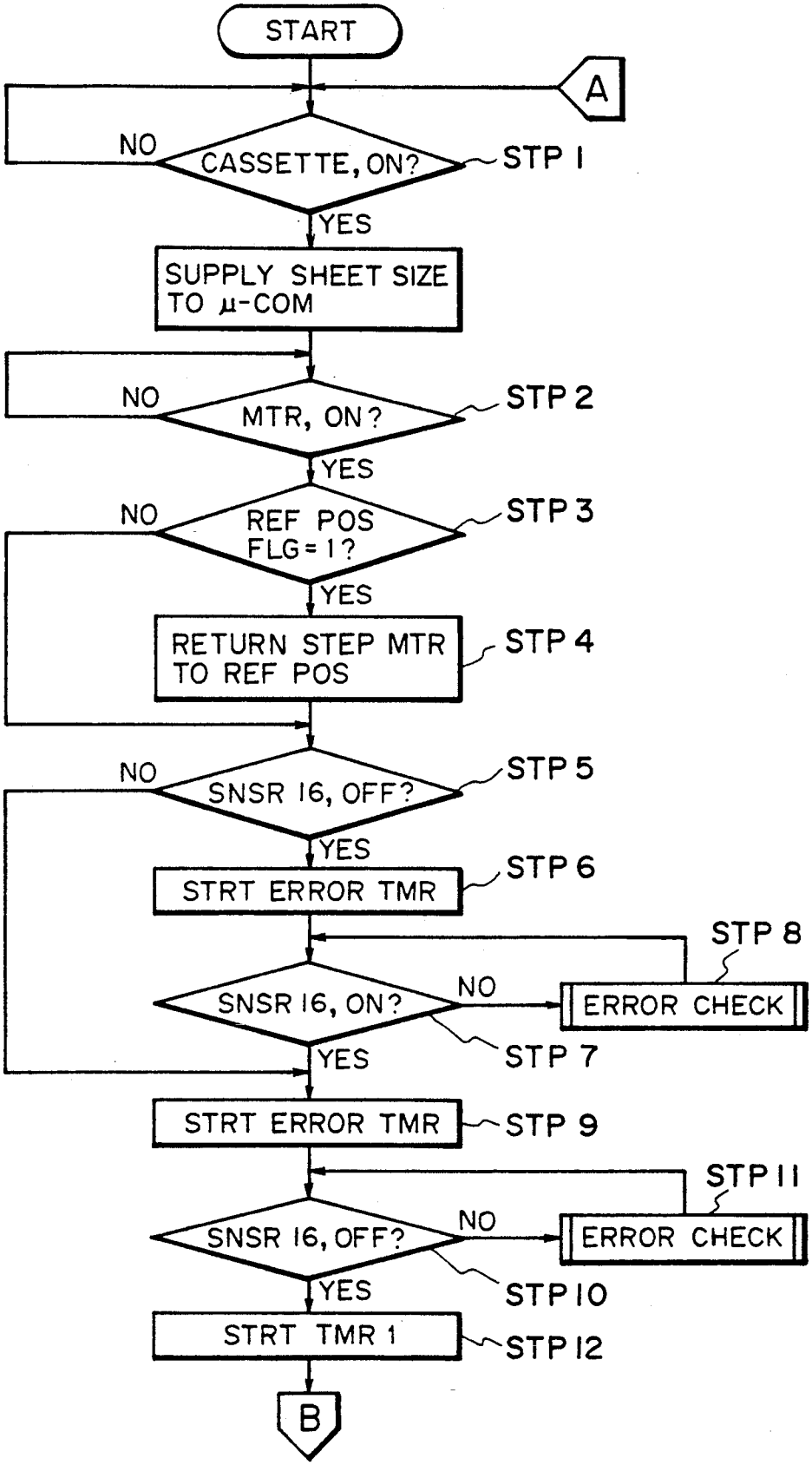
FIGS. 75 and 76 are flow charts for the alternative embodiments of the present invention.
Figure 76:
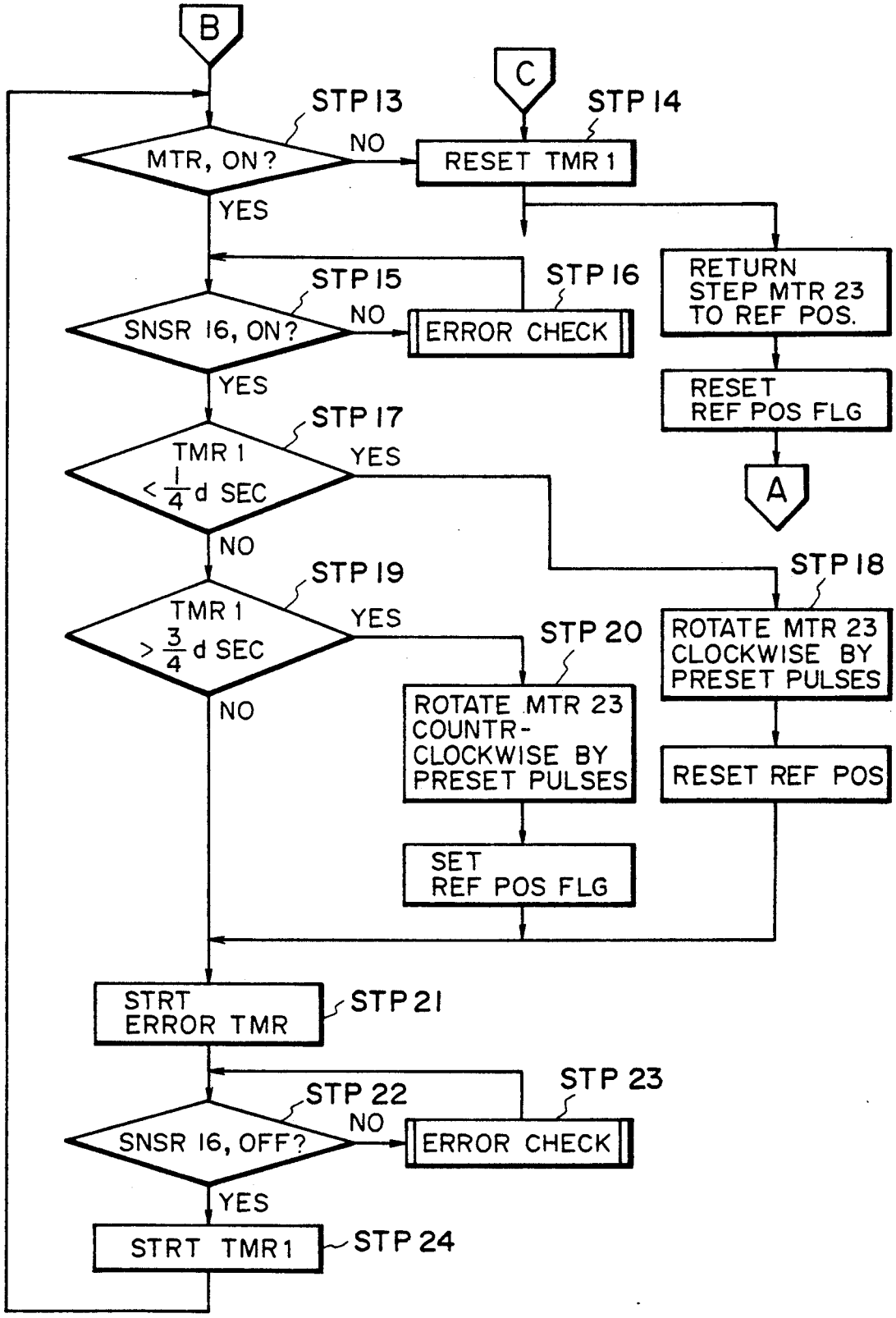

As for the control circuit and the recording material size detector, those shown in FIG. 37 and FIG. 38 are employed, respectively. The lateral shift control flow chart for this embodiment is shown in FIGS. 75 and 76.

First, in step 1 immediately after the start, it is determined whether or not a sheet feed cassette 62 has been loaded in the image forming apparatus main assembly. If it has been loaded, the-sheet size data is transferred to the microcomputer, and the program goes to step 2. If it has not been loaded, the program returns to the step 1, where it waits till the cassette is loaded.

In the step 2, it is determined whether or not the motor 27 is on. If the motor 27 is on, step 3 is followed, and if the motor 27 is off, the program returns to the step 2, where it waits till the motor 27 is turned on.

Next, in the step 3, it is determined whether the film has been controlled to shift frontward or rearward up to this point. The contents of the predetermined address of the non-volatile RAM in the above mentioned microcomputer 26 is set up as reference position flag, and if the status of this memory is "1," in other words, if the film has been controlled to shift frontward or rearward up to this point, step 4 is followed, wherein the stepping motor 23 is rotated back to its reference stepping position, and after the reference position flag is reset, step 5 is followed. If the reference position flag indicates "0" in the step 3, it means that the stepping motor is holding its reference stepping position; therefore, the program skips to step 5.

In the step 5, it is determined whether or not the sensor 16 is off. If the sensor 16 is on, step 9 is followed, and if it is off, step 5 is followed.

In the step 5, the value of the error timer is reset to 0, simultaneously starting measurement, and then, step 6 is followed.

In step 7, it is determined whether or not the sensor 16 is on, and if it is not on, step 8 is followed.

In the step 8, the error check routine shown in FIG. 10 is executed, and then, the program returns to the step 7.

In the step S1, it is determined whether or not the motor 27 is on. If it is on, the step S2 is followed, and if it is not on, step 14 (FIG. 76) is followed.

In the step S2, it is determined whether or not the error timer value is larger than d seconds, and if it is smaller, the program proceeds to the exit of this routine. If the error timer value is larger than d seconds in the step S2, the step S3 is followed. In the step S3, the error flag is set, and the program proceeds to the exit.

In the step 7, if the sensor 16 is on, step 9 is followed, wherein the error timer value is reset to 0, simultaneously starting measurement, and then, the step 10 is followed.

In the step 10, it is determined whether or not the sensor 16 is off, and if it is not off, step 11 is followed, wherein the error check routine is executed, and then, the program returns to the step 10. If the sensor 16 is off in the step 10, step 12 is followed, wherein the value of the timer 1 is reset to 0, simultaneously starting the measurement, and then, step 13 (FIG. 76) is followed.

In the step 13, it is determined whether or not the motor 27 is on, and if it is on, step 15 is followed.

In the step 15, it is determined whether or not the sensor 16 is on. If it is not on, step 16 is followed, wherein the error check routine is executed, and then, the program returns to the step 16, and if it is on, step 17 is followed.

In the step 17, a comparison is made to determine whether or not the value measured by the timer 1 is smaller than 1/4 d seconds. If it is smaller, it can be determined that the film 11 is located on the front side; therefore, step 18 is followed, wherein the stepping motor 23 is rotated from the reference position in the clockwise direction by a predetermined amount which corresponds to the sheet size, whereby the lateral shift direction of the film 11 is switched to the rearward direction, and then, after the reference position flag is set to 1, step 21 is followed.

Also, in the step 17, if the value measured by the timer 1 is not smaller than 1/4 seconds, step 19 is followed.

In the step 19, it is determined whether or not the value measured by the timer 1 is larger than 3/4 seconds. If it is not larger, the step 21 is followed, and if it is larger, it can be determined that the film 11 is on the rear side; therefore, step 20 is followed, wherein the stepping motor 23 is rotated in the counterclockwise direction by a predetermined amount which corresponds to the sheet size, whereby the lateral shift direction of the film 11 is switched in the frontward direction, and after the reference position flag is set to 1, the step 21 is followed.

In the step 21, the error timer value is reset to 0, simultaneously starting the measurement, and then, step 22 is followed.

In the step 22, it is determined whether or not the sensor 16 is off, and if it is not off, step 23 is followed, wherein the error check routine is executed, and then, the program returns to the step 22. Also, in the step 22, if the sensor 16 is off, step 24 is followed, wherein the value of the timer 1 is reset to 0, simultaneously starting the measurement, and then, the program returns to step 13.

In the above mentioned step 13, if the motor 27 is off, step 14 is followed, wherein: first, the measurement by the timer 1 is halted, simultaneously resetting the measured value to 0; the stepping motor is rotated back to its reference stepping position; and the reference position flag is reset to 0, and then, the program returns to the step 1.

As for the film anomaly processing program, the one shown in FIG. 11 is used.

Figure 77:
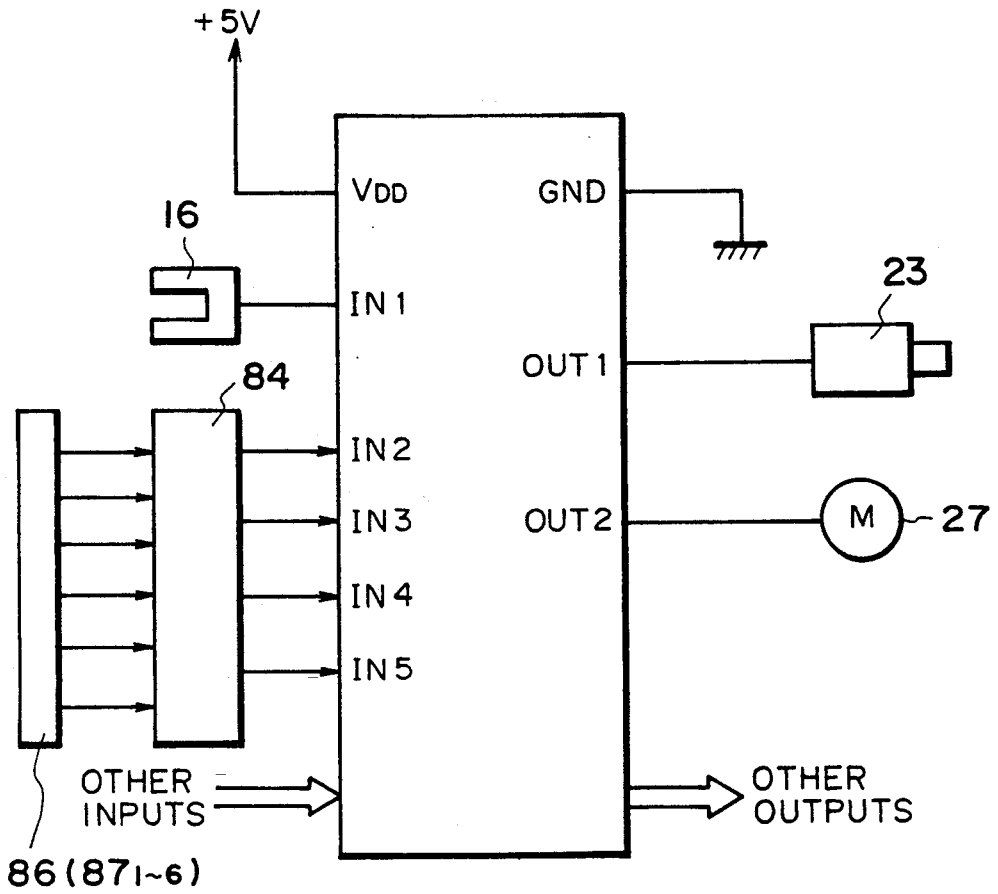
FIGS. 77 and 78 are control circuits of alternative embodiments of the present invention.

FIG. 77 is a schematic diagram of the control circuit of another alternative embodiment of the present invention.

As for the recording size detection means, the one shown in FIG. 42 is employed.

When the transfer material P conveyed from the tray 80 by the feed roller 81 is passed between the tab array 86 and the sheet guide 88, a selected number of the tabs $85_1$ to $85_6$ which stand within the transfer material passage are collapsed corresponding to the width of the transfer material P, whereby the width of the transfer material P is detected by the photointerruptors $87_1$ to $87_6$ which correspond to these collapsed tabs. Then, as is shown in FIG. 77, the signals from these photointerruptors are inputted, through a sheet size detection microcomputer 84, to microcomputer 26, which determines the sheet size.

Next, another alternative embodiment in which the lateral shift speed is controlled based on the device usage count.

Figure 78:
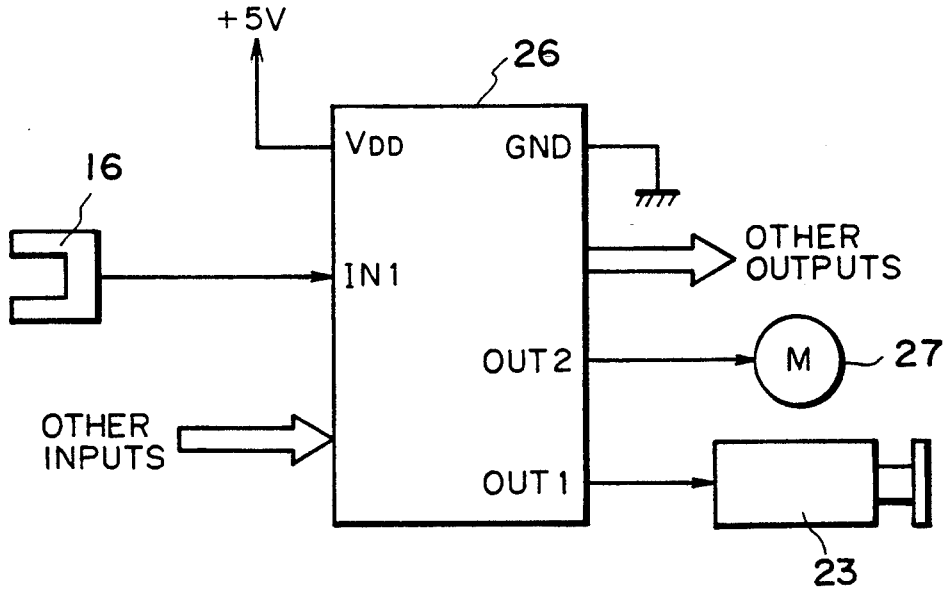

FIG. 78 is a schematic diagram of the control circuit of this embodiment.

Reference numeral 26 refers to a microcomputer, to the input terminal IN 1 of which, the above mentioned photosensor 16 is connected. Also, to the output terminal OUT 1, the stepping motor 23 is connected. To the output terminal OUT 2, the rotation control signal for the motor 27, which drives this fixing device, is outputted.

To the $V_{DD}$ terminal, the power source of +5 V is connected, and the GND terminal is connected to ground.

Thought not illustrated, within this microcomputer 26 provided with the terminals for other input and output signals of this copy machines employing this fixing device, the non-volatile RAM, the memory contents of which is not erased even if the power supply to this microcomputer 26 is interrupted, is contained together with the ROM, RAM, and the like which store the sequence program and such of the copying operation of this copying machine.

Figure 79:
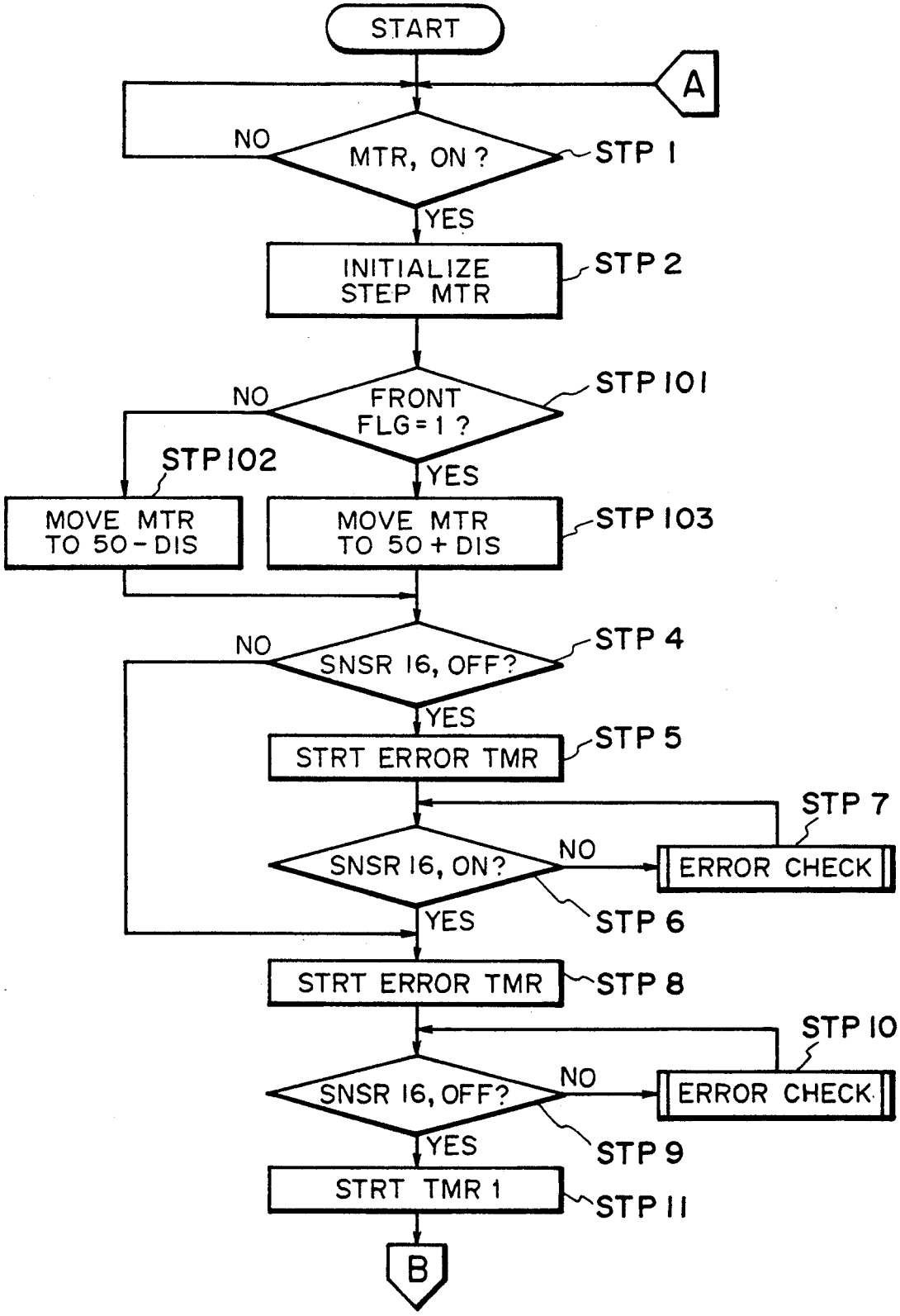
FIGS. 79, 80 and 81 are flow charts for the alternative embodiments of the present invention.
Figure 80:
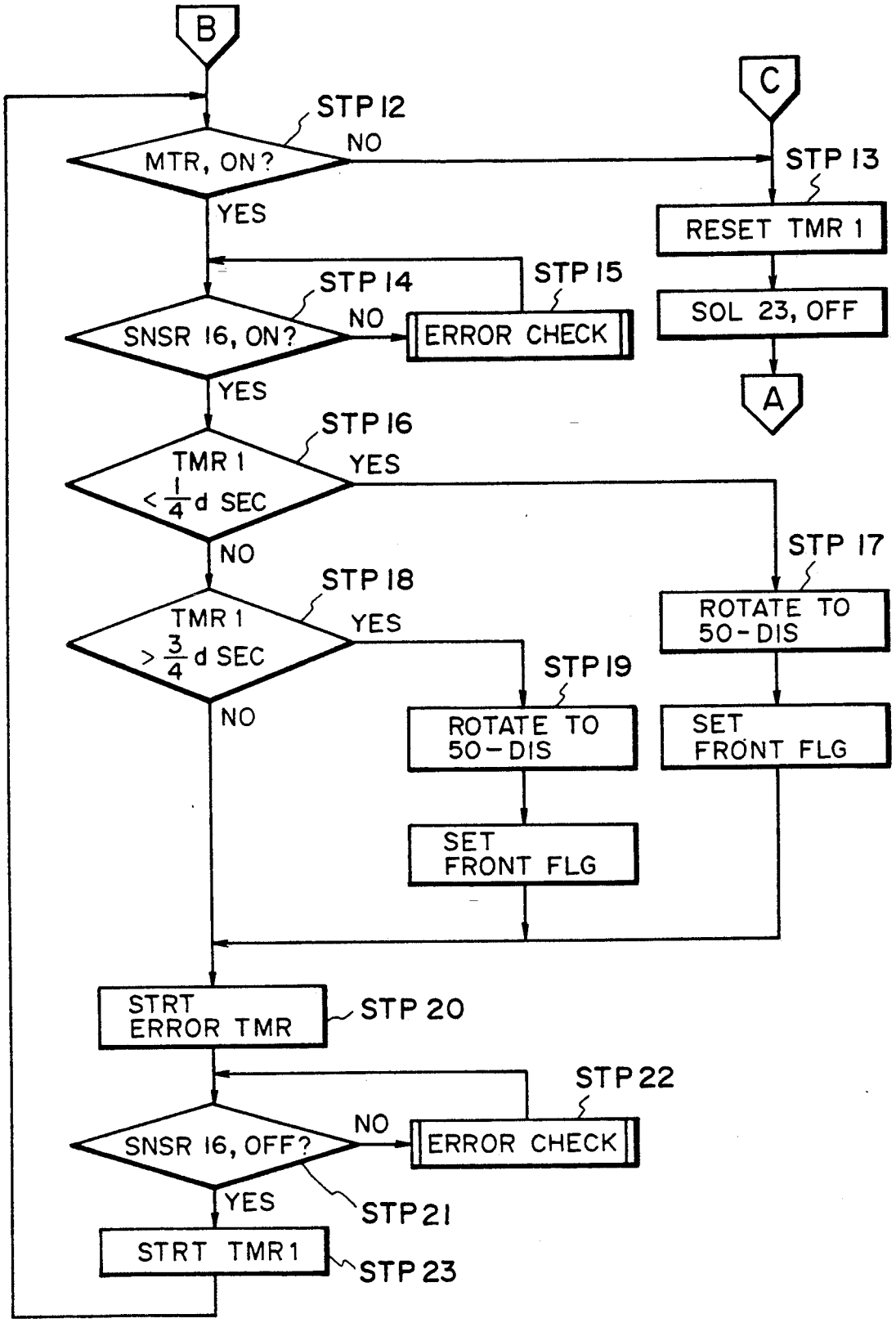

FIGS. 79 and 80 present the flow chart of this embodiment.

First, in step 1 (FIG. 79) immediately after the start, it is determined whether or not the motor 27 is on. If the motor 27 is on, step 2 is followed, and if the motor 27 is off, the program returns to the step 1, where it waits until the motor 27 comes on.

Next, in the step 2, the stepping motor 23 for lateral shift control is initialized; during this initializing operation, the stepping motor 23 is rotated in the counter clockwise direction to make the front side end of the follower roller 12 reach the predetermined lowest position, which hereinafter is referred as the zero point; when a predetermined number of pulses are applied to the stepping motor 23 to control the position of the follower roller 12, the position is determined in reference to this zero point. Next, step 10 is followed.

In the step 101, it is determined whether or not the film has been controlled to shift frontward; wherein the contents of a predetermined address in the non-volatile RAM in the above mentioned microcomputer 26 is set up as the front side flag. If the memory status indicates "1," in other words, if the film has been controlled to shift forward up to this point, step 103 is followed, wherein pulses are sent to the stepping motor so that the follower roller 12 is going to be positioned above the middle point by the amount of displacement.

Figure 81:
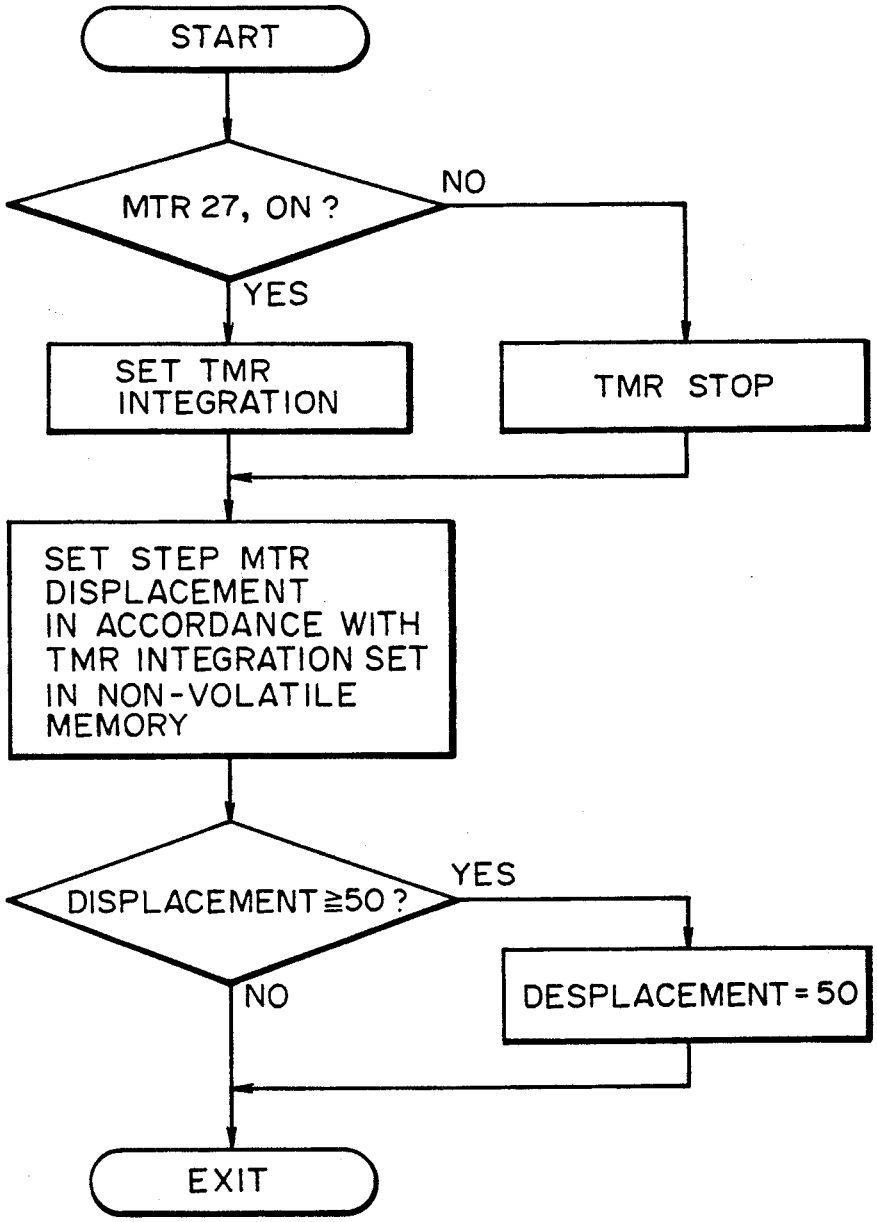

In this embodiment, the middle point of the follower roller 12 is a position which is above the aforementioned zero position by the equivalent of 50 pulses, and the amount of displacement is set up corresponding to the integrated value of the operation time of the driving roller 13, as is shown in FIG. 81. This time integration value is stored in the non-volatile RAM, the contents of which is not going to be lost even if the power supply is interrupted. Also, the position of the follower roller 12 at this time is stored in the RAM.

Conversely, if the front flag indicates 0, the step 102 is executed, in other words, the pulses are sent to the stepping motor so that the follower roller 12 comes down to a position which is below the middle point by the amount of displacement, and at the same time, the position of the follower roller 12 at this time is stored in the RAM.

In the step 4, it is determined whether or not the sensor 16 is off. If the sensor 16 is on, step 8 is followed, and if it is off, step 5 is followed.

In the step 5, the error timer value is reset, simultaneously starting the measurement, and then, step 6 is followed.

In the step 6, it is determined whether or not the sensor 16 is on, and if it is not on, step 7 is followed.

In the step 7, the error check routine is executed, and the program returns to the step 6.

Here, the contents of the error check is described, referring to FIG. 11. First, in the step S1, it is determined whether or not the motor 27 is on. If it is on, the step S2 is followed, and if it is not on, the step 13 (FIG. 80) is followed.

In the step S2, it is determined whether or not the error timer value is larger than d seconds, and if it is smaller, the program proceeds to the exit. Also, in the step S2, if the error timer value is larger than d seconds, the step S3 is followed. In the step S3, the error flag is set, and the program goes to the exit of this routine.

In the step 6, if the sensor 16 is on, the step 8 is followed, where the error timer value is reset to 0, simultaneously starting the measurement, and then, step 9 is followed.

In the step 9, it is determined whether or not the sensor 16 is off. If it is not off, step 10 is followed, where the error check routine is executed, and the program returns to the step 9, if the sensor 16 is off, step 11 is followed, wherein the value of the timer 1 is reset to 0, simultaneously starting the measurement, and then, step 12 is followed (FIG. 80).

In the step 12, it is determined whether or not the motor 27 is on, and if it is on, step 14 is followed.

In the step 17, it is determined whether or not the sensor 16 is on. If it is not on, step 15 is followed, wherein the error check routine is executed, and the program returns to the step 14. If it is on, step 16 is followed.

In the step 16, a comparison is made to determine whether or not the value measured by the timer 1 is smaller than d/4 seconds, and if it is smaller, it can be determined that the film 11 is located on the front side; therefore, step 17 is followed, wherein the pulses are sent to the stepping motor 23 so that it is rotated to a stepping position of [50−the displacement amount]; whereby the direction of the lateral shift of the film 11 is switched in the rearward direction; and the front flag is reset to 0, and then, step 20 is followed.

Also, in the step 16, if the value measured by the timer 1 is not smaller, step 18 is followed.

In the step 18, a comparison is made to determined whether or not the value measured by the timer 1 is larger than 3d/4 seconds. If it is not larger, the step 20 is followed, and if it is larger, it can be determined that the film 11 is located on the rear side; therefore, step 19 is followed, wherein the pulses are sent to the stepping motor 23 so that it is rotated to a stepping position of [50+displacement amount]; whereby the direction of the lateral shift of the film 11 is switched to the frontward direction; and the front flag is set to 1, and then, the step 20 is followed.

In the step 20, the error timer value is reset to 0, simultaneously starting the measurement, and then, step 21 is followed.

In the step 21, it is determined whether or not the sensor 16 is off. If it is not off, step 22 is followed, wherein the error check routine is executed, and the program returns to the step 21.

Also, in the step 21, if the sensor 16 is off, the step 23 is followed, where the value of the timer 1 is reset to 0, simultaneously starting the measurement, and the programs returns to the step 12.

In the step 12, if the motor 27 is off, the step 13 is followed, where first, the measurement by the timer 1 is halted; the measured value is reset to 0; next, the phase excitation of the stepping motor 23 is completely turned off, and then the program returns to the step 1.

As for the operation to drive the stepping motor 23, it is carried out in reference to the current position of the follower roller 12 stored in the RAM. For example, if it is desired to rotate the stepping motor 23 from the current stepping position, which is a point equivalent to 30 pulses, to another point equivalent to 70 pulses, it is rotated rightward by an amount equivalent to 40 pulses; if it is desired to rotate the stepping motor 23 from the current stepping position, which is a point equivalent to 30 pulses, to a point equivalent to 10 pulses, it is rotated leftward by an amount equivalent to 20 pulses.

As was described above, immediately after the motor begins to rotate, the lateral shift control program for the endless film 11 of this fixing device controls the stepping motor 23, based on the contents of the non-volatile RAM storing the previous lateral shift control direction. Meanwhile, if the sensor 16 is on when the motor is rotating, the program waits until the sensor 16 is turned off; if the sensor 16 is off, the program waits until the sensor 16 is turned on and keeps on waiting until it is turned off again; whereby the program detects the switching timing when the output from the film position sensor 16 is switched from ON to OFF, completing the initialization. Next, the OFF period of the sensor 16, that is, the time it takes for the state of the sensor 16 changes from OFF to ON, is measured to detect the position of the film 11 for the first time.

From this point on, the OFF period of the sensor 16, that is, the length of time between the timing when the sensor 16 is turned off and when it is turned on next, is measured; whereby the film position is controlled so as to remain within t-he predetermined control range which corresponds to the length of time the film is driven, and also, the control is executed while the amount of displacement of the follower roller is adjusted, depending on the integrated value of the operation time of the film driving motor.

Figure 82:
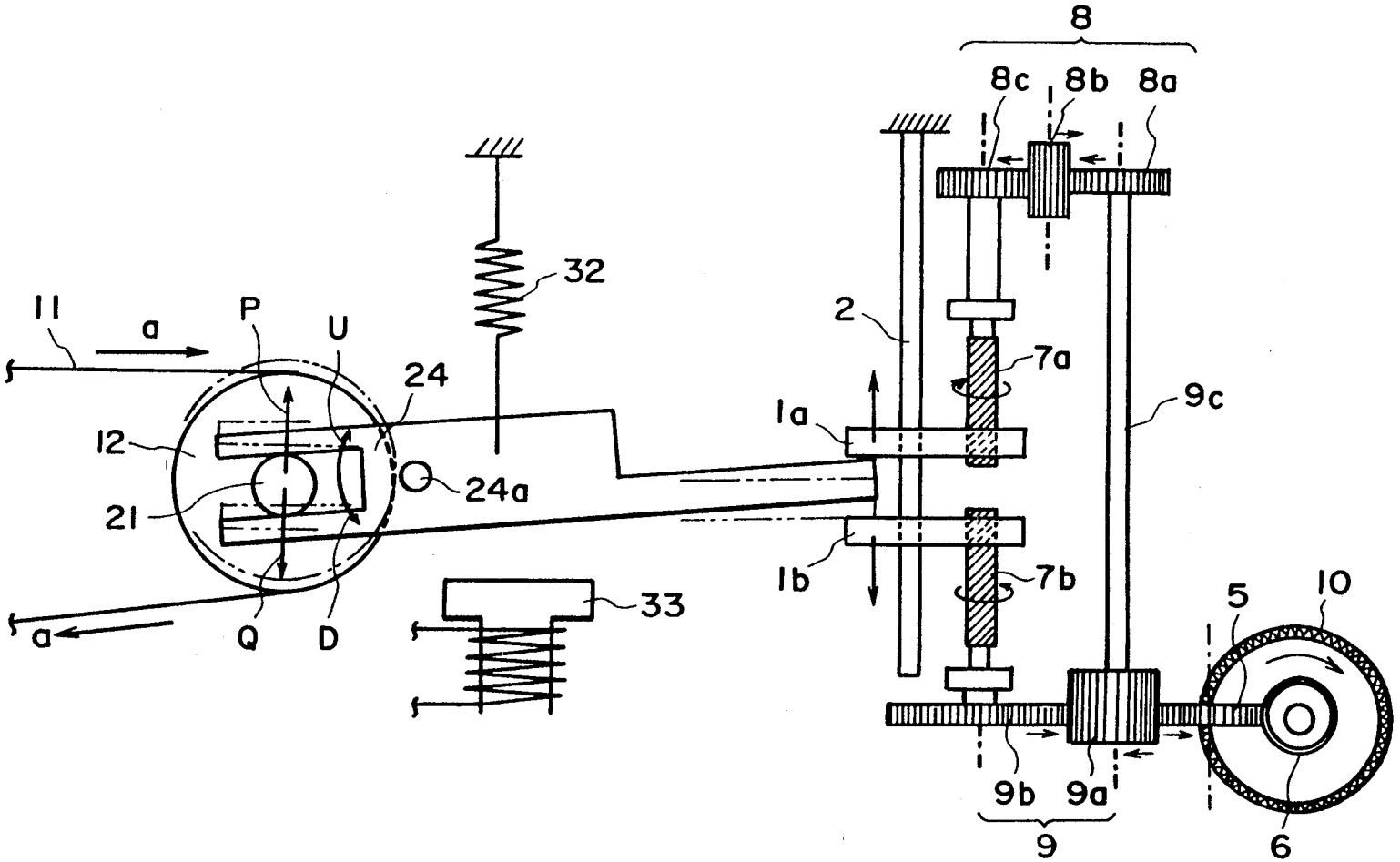
FIG. 82 is an enlarged partial view of yet another alternative embodiment of the present invention.
Figure 83:
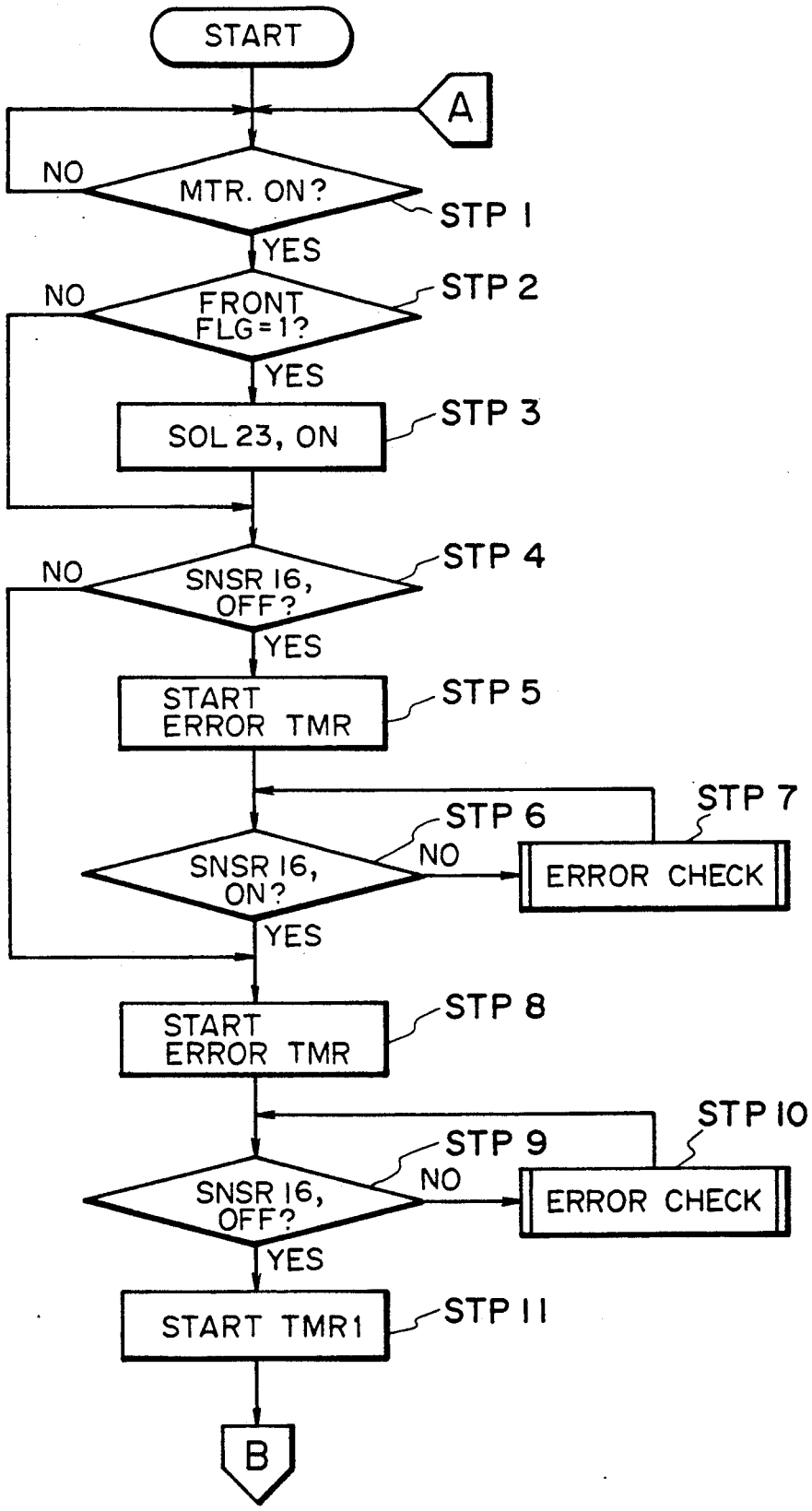
FIGS. 83 and 84 are flow charts for the alternative embodiments of the present invention.
Figure 84:
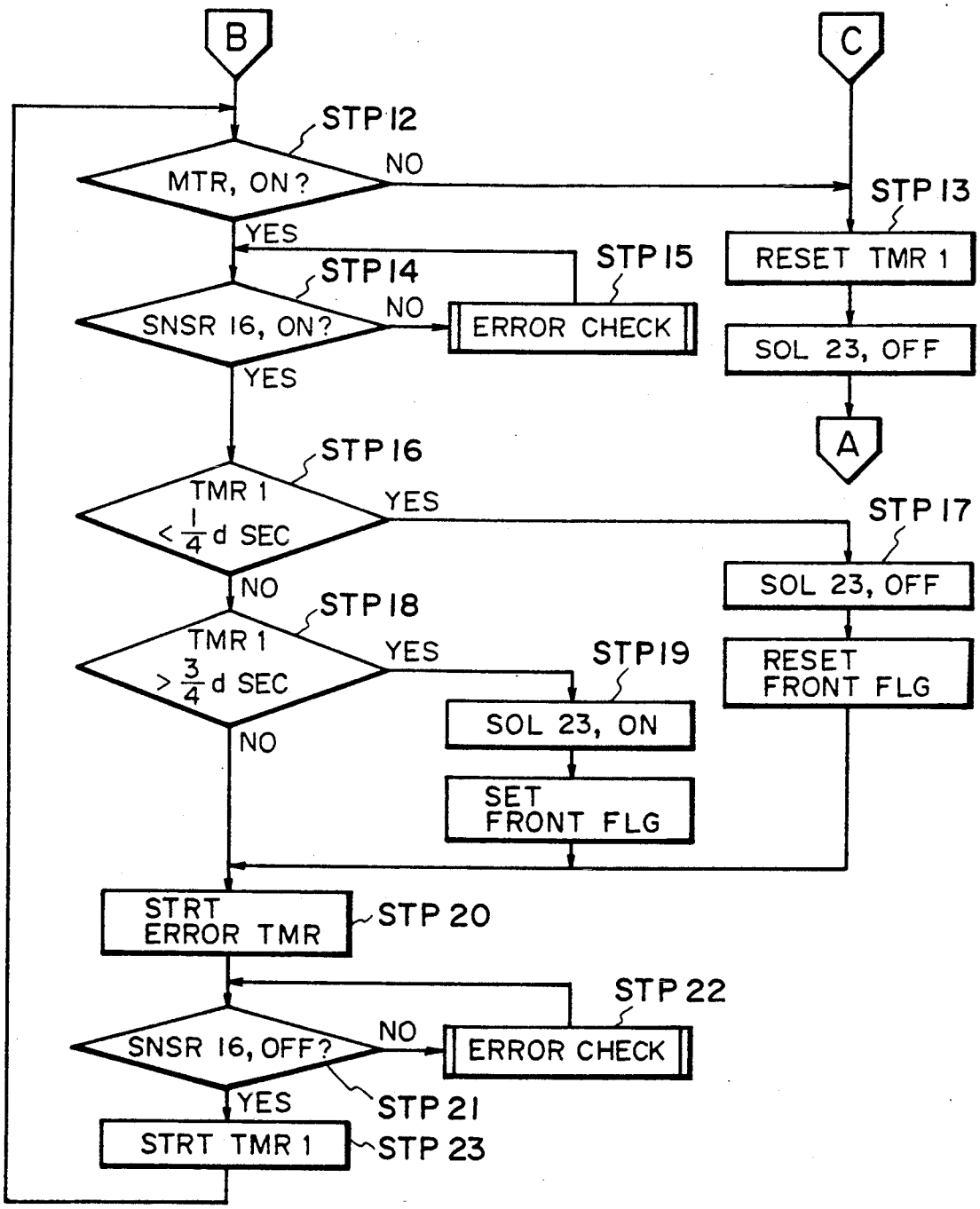

Another alternative embodiment of the present invention is presented referring to FIGS. 82 to 84.

In FIG. 82, a fork lever 24 is rockable in the vertical direction U-D about an axis 24*a*, and its fork section is engaged with the front side bearing 21 of the follower roller 12. As the fork lever 24 is rocked in the vertical direction U-D, the front side end of the follower roller 12 is moved up or down, that is, in the direction P-Q; whereby the lateral shift direction of the film 11 is switched between the lateral shift directions B and C.

The fork lever 24 is urged by the tension spring 32 to rotate in the downward direction D (counterclockwise direction), and the downward rotation limit of this lever 24 is regulated by the upper stopper blade 1*a* which interferes with the rear end of the fork lever 24, that is, the end opposite to the fork side.

Reference numeral 33 refers to a solenoid to rotate the fork lever 24 in the upward direction U (clockwise direction) against the tension spring 32, and the limit of the upward rotation given by this solenoid is regulated by the lower stopper blade 1*b* which interferes with the rear end of the fork lever 24, that is, the end opposite to the fork side. Therefore, the displacement range for the lateral shift control is regulated by the distance between the upper and lower stopper blades 1*a* and 1*b*.

The above mentioned upper and lower stopper blades 1*a* and 1*b* can be moved in the vertical direction along a guide member 2. The upper stopper blade 1*a* is moved upward along the guide member 2 as an upper threaded rod 7*a* is normally turned. The thread of the upper threaded rod 7*a* is ended just before a point beyond which the upper stopper blade 1*a* creates problems by climbing. The lower stopper blade 7*b* is moved downward along the guide member 2 as the lower threaded rod 7*b* is normally rotated. The thread of the lower threaded rod 7*b* is ended just before a point beyond which the stopper blade 7*b* causes problems by descending.

Reference numeral 10 refers to a gear linked with the film driving roller 13 via a transmission means such as gear train and pulley, and rotates, as the film 11 is driven, at a predetermined slow speed in the direction indicated by an arrow mark.

The rotation of this gear 10 is transmitted to the lower threaded rod 7*b* via a worm gear 6, transmission gear 5, and lower gear train 9 (9*a* and 9*b*); therefore, as this lower threaded rod 7*b* is rotated in the normal direction little by little, the lower stopper blade lb is made to move gradually downward along the guide member 2.

Also, the rotation of the gear 10 is transmitted to the upper threaded rod 7*a* via the worm gear 6, transmission gear 5, gear 9*a*, connecting rod 9*c*, and upper gear train 8 (8*a*, 8*b* and 8*c*); therefore, as this upper threaded rod 7*a* is rotated in the normal direction little by little, the upper stopper blade 1*a* is made to move gradually upward along the guide member 2.

Therefore, the distance between the upper and lower stopper blades 1*a* and 1*b* increases in proportion to the driving time of the film 11, that is, the driving time of the device. In other words, the vertical rocking angle of the fork lever 24 increases; whereby the lateral shift displacement control range of the film 11 is varied in correspondence with duration of the device usage.

The gear ratios of the upper and lower gear trains 8 (8*a*, 8*b*, and 8*c*) and 9 (9*a* and 9*b*) are set up so that the directional difference in the lateral film shift speed caused by the years of usage of the endless film and such does not become too large; therefore, it does not happen that the directional difference in the lateral film shift Speed becomes large even though the lateral shift speed may become slightly faster. The range in which the upper and lower stopper blades 1*a* and 1*b* can move is calculated based on the service life of the fixing device and the performance of the solenoid 33, and the number of necessary gears and the number of teeth on each of these gears are determined based on this range.

FIGS. 83 and 84 present the flow chart of this embodiment.

By having the above arrangement, the rotation of the gear 10 becomes proportional to the operation time of the fixing device; therefore, the lateral shift control displacement range can be adjusted in proportion to the accumulated operation time of the device.

Also, in this embodiment, the lateral shift speed adjustment in proportion to the integrated value of the operation time of the machine is not carried out at all by the software and the like, but is carried out only through a mechanical means, such as gears.

Figure 85:
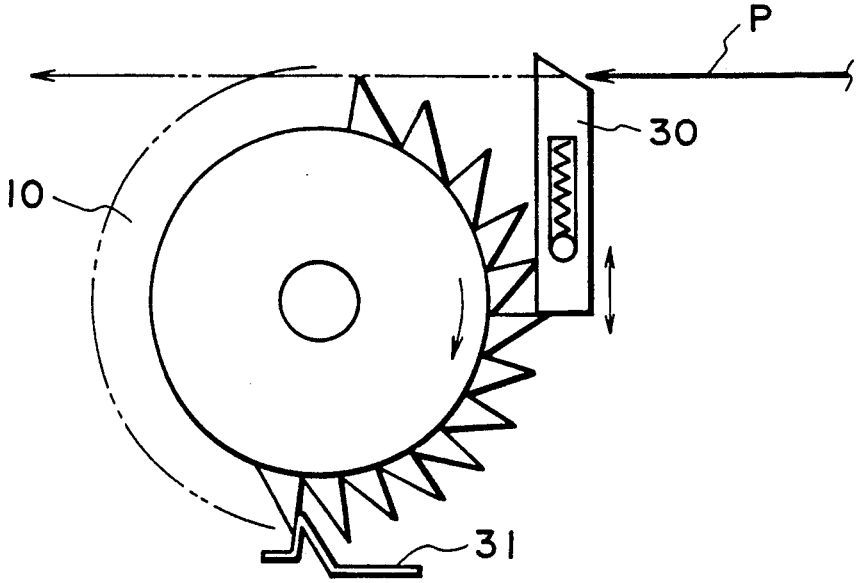
FIG. 85 is an enlarged partial view of yet another alternative embodiments of the present invention.

Another alternative embodiment of the present invention is shown in FIG. 85.

In this embodiment, the gear 10 is rotated by one pitch each time a sheet of paper is fed to the device.

Reference numeral 30 refers to a switch which is turned on and off each time a sheet of paper is fed; as a sheet of paper is fed in, this switch 30 is pushed down, whereby the gear 10 advance by one pitch. Reference 31 refers to a leaf spring, which is provided to prevent the reverse rotation of the gear 10.

By having the above arrangement, the rotation of the gear 10 becomes proportional to the number of times the copying operation is carried out, increasing the distance between the upper and lower stopper blades 1*a* and 1*b* in proportion to the duration of the device usage;

therefore, it become possible to adjust the lateral film shift control range depending on the copy count, that is, the duration of device usage.

Next, another embodiment is described, in which the lateral film shift speed is controlled based on the detected temperature of the device.

As for the sectional structure and the control circuit, those shown in FIG. 24 and FIG. 23 are employed, respectively. As for the lateral shift speed control mechanism, the one shown in FIG. 74 is employed.

Figure 86:
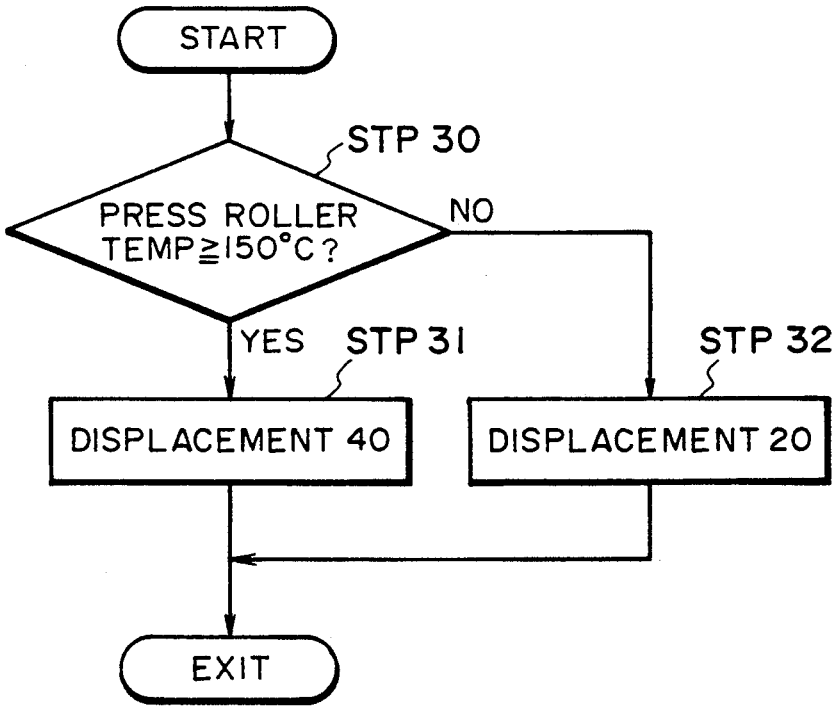
FIGS. 86 and 87 are flow charts for the alternative embodiments of the present invention.

As is shown in FIG. 86, when the temperature of the pressing roller 15 is higher than a predetermined temperature, for example, 150° C., the displacement amount of the follower roller 12 is selected to be equivalent to 40 steps, and when the temperature is lower than 150° C., the displacement is selected to be equivalent to 20 steps; in other words, the follower roller 12 moves 4 mm and 2 mm, respectively, and this information is stored at predetermined addresses in the RAM. In this manner, the amount of displacement of the follower roller 12 is controlled based on the temperature of the pressing roller 15.

In this embodiment, the middle point is a point away from the above mentioned zero point by a distance equivalent to 50 steps, and the amount of displacement is equivalent to the above mentioned number of stops determined based on the temperature of the pressing roller 15. If the temperature of the pressing roller 15 is less than 150° C., the stepping motor is rotated by 70 steps. The position at this time is stored in the RAM. Also, if the front flag indicates 0, the motor 23 is reversely rotated to the position [50+displacement amount], and the stepping position is stored in the RAM.

Figure 87:
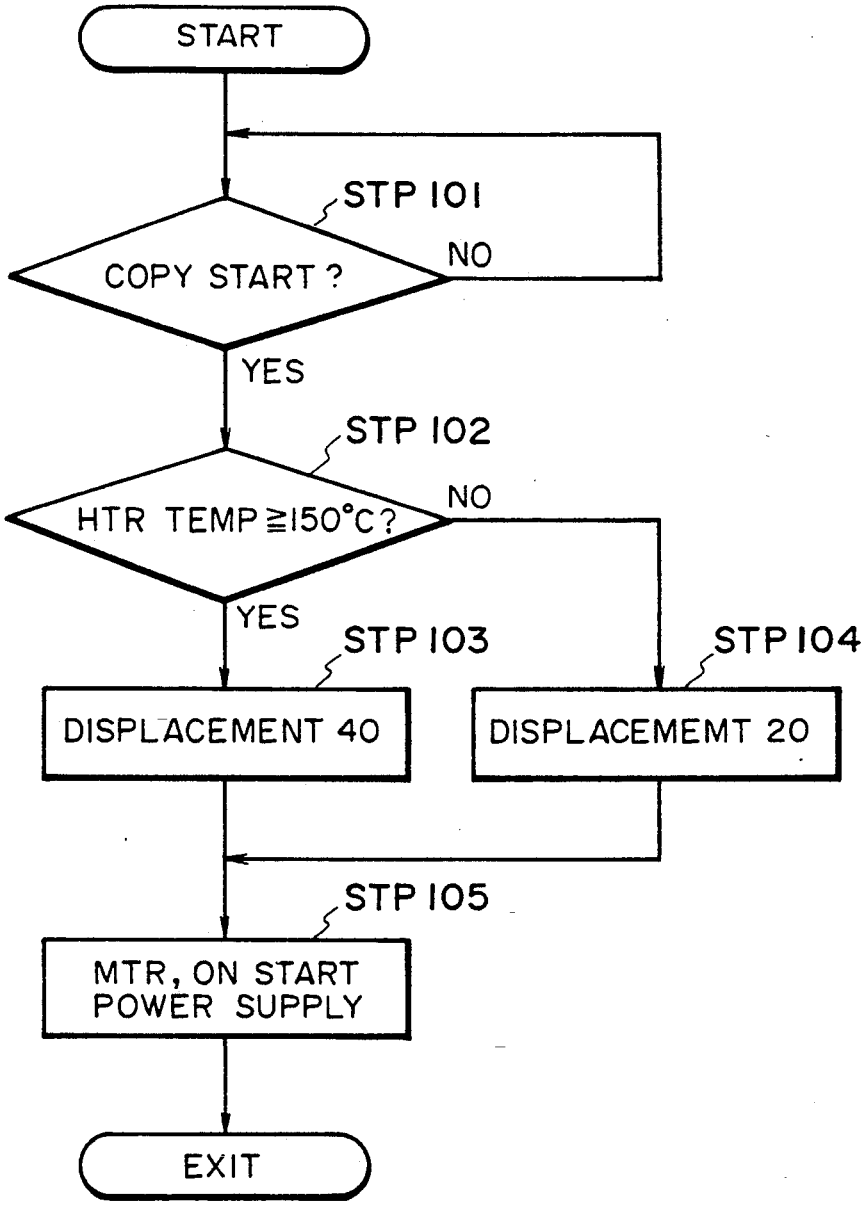

In this embodiment, the amount of lateral shift control displacement is switched with the use of a thermistor RT 1 which detects the temperature of the heater 14, as is shown in FIG. 24. FIG. 87 is the flow chart of this embodiment, and this program is called when the copying operation begins.

In step 101, it is determined whether or not the copying operation has started. If the copying operation has started, step 102 is followed. In the step 102, the temperature of the heater 14 is determined based on the value of the thermistor RT 1, and if it is higher than a predetermined one, for example, 150° C., step 103 is followed, wherein the amount of lateral shift control displacement is set to the equivalent of 40 steps. Also, if the temperature of the heater 14 is lower than 150° C., step 104 is followed, wherein the amount of lateral shift control displacement is set to the equivalent of 20 steps. Then, step 105 is followed, wherein the motor is turned on and the power supply to the heater 14 is started, and then, the program exit this routine. The other lateral shift controls are the same as those in the first embodiment.

In this embodiment, the heat reserve of the fixing device can be determined by detecting the temperature of the heater before the power supply to the heater is started. If this information is used to switch the lateral shift control range, the same effect can be obtained.

Figure 88:
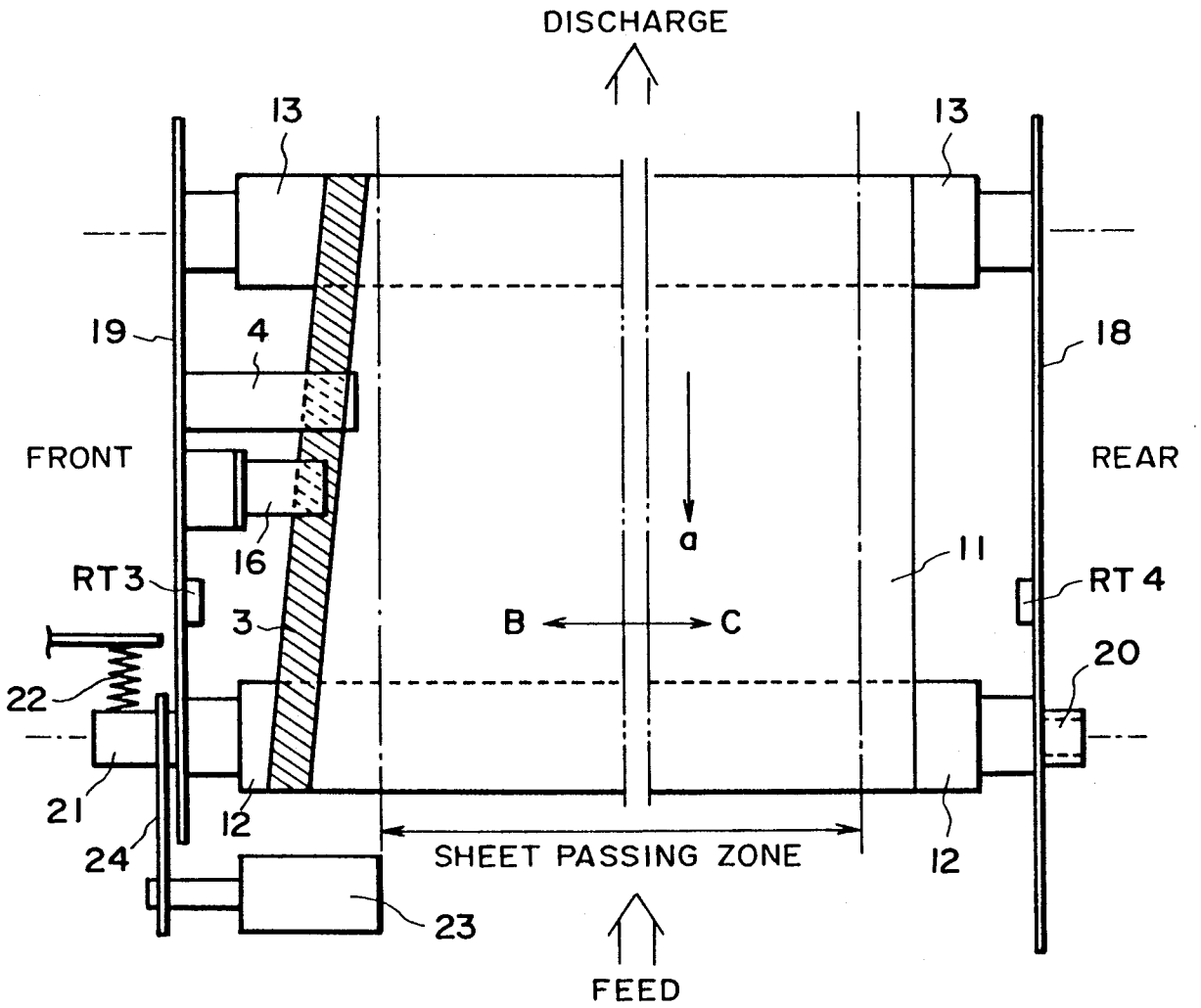
FIG. 88 is a plan view of yet another alternative embodiment of the present invention.
Figure 89:
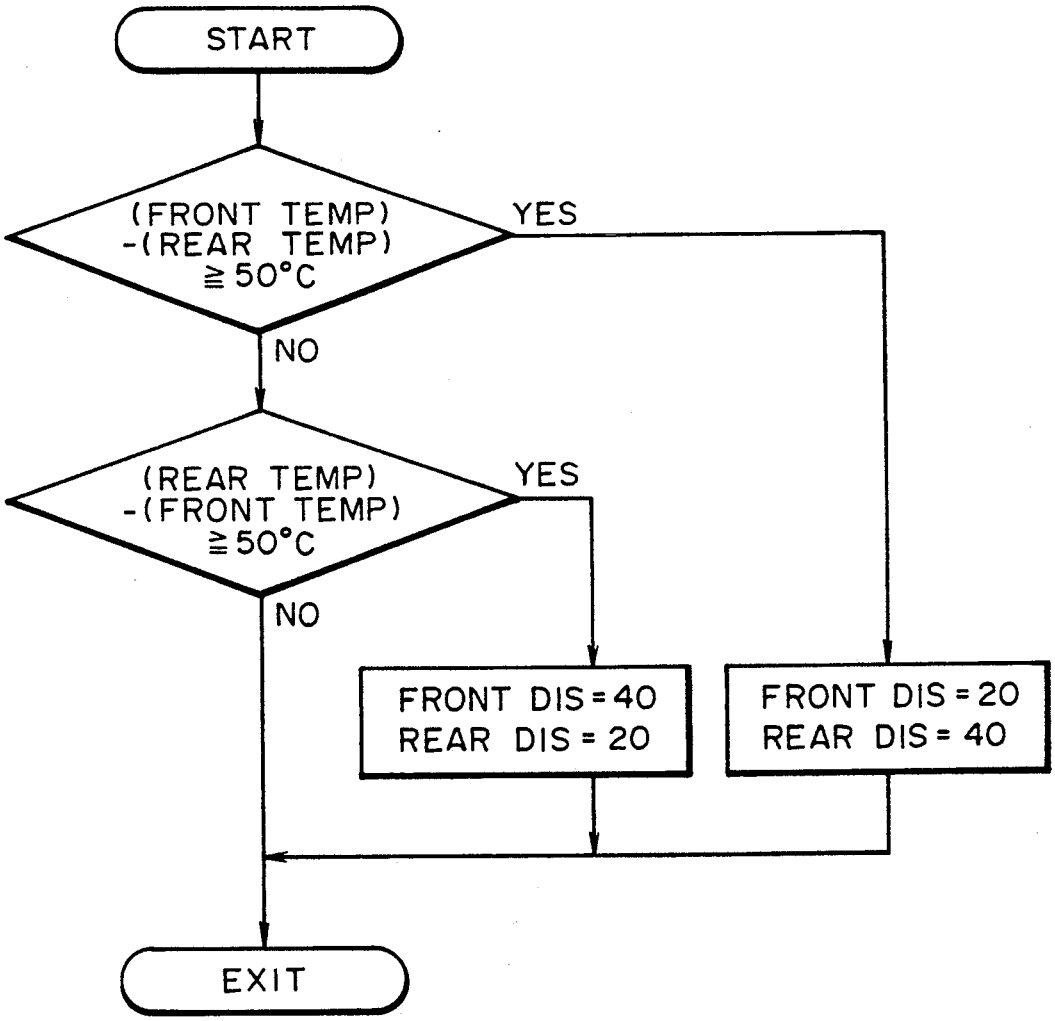
FIG. 89 is a flow chart for the alternative embodiment of the present invention.

Another alternative embodiment is presented in FIGS. 88 and 89.

In this embodiment, both of the front side plate 19 and the rear side plate 18 of the device are provided with a thermistor TR 3 and a thermistor TR 4, respectively, as shown in FIG. 88, to detect the front side temperature and the rear side temperature of the device, respectively. Then, the amount of the front side displacement and the amount of the rear side displacement are adjusted, respectively, depending on the temperature difference between the front and rear sides.

This arrangement makes it possible to balance the lateral film shift speed between the front and rear sides, based on the temperature difference between the two sides.

FIG. 89 shows a routine to determine the amount of displacement. If the temperature of the front side plate 19 is higher than that of the rear side plate 18 by more than 50° C., it becomes difficult for the film to shift forward. Therefore, the amount of displacement to make the lateral film shift rearward is adjusted by 40 steps. If the situation is opposite, the amount of displacement to move the film forward is adjusted by 40 steps.

While the present invention has been described in reference to its preferred embodiments, it is not confined to the details set forth and these applications are intended to cover such modifications or changes as may come within the purposes of the improvements or the scope of the following claims.

What is claimed is:

1. An image heating device comprising:

a heater;

an endless belt movable together with a recording material carrying an image, wherein the image carried upon the recording material is heated through said endless belt by heat from said heater;

position detecting means for detecting a position in a lateral direction of said endless belt;

lateral shift controlling means for controlling a lateral position of said endless belt by reciprocating said endless belt in the lateral direction in a predetermined range by changing a lateral shifting direction of said endless belt; and lateral shifting range controlling means for controlling said predetermined range by changing a position where the lateral shifting direction is changed.

2. An image heating device according to claim 1, wherein said device further comprises a switch for selecting said predetermined range.

3. An image heating device according to claim 1, wherein said image heat device further comprises a temperature detecting member to detect a temperature of said heater, and said lateral shifting range controlling means controls said range depending on the temperature detected by said temperature detecting member.

4. An image heating device according to claim 1, wherein said device further comprises a counter for counting image heating counts, and said lateral shifting range control means controls said predetermined range depending on the counts obtained by said counter.

5. An image heating device according to claim 4, wherein said device further comprises a non-volatile memory to store the counts.

6. An image heating device according to claim 1, wherein said device further comprises a timer for measuring usage time, and said lateral shifting range controlling means controls said predetermined range depending on the time measured by said timer.

7. An image heating device according to claim 1, wherein said device further comprises size detection means to detect the recording material size, and said lateral shifting range controlling means controls said predetermined range depending on the result detected by said size detection means.

8. An image heating device according to claim 7, wherein said lateral shifting range controlling means narrows said predetermined range when the recording material size is small.

9. An image heating device according to claim 1, wherein said device further comprises belt speed switching means to switch the moving speed of said endless belt, and said lateral shifting range controlling means controls said predetermined range depending on the rotating speed of said endless belt.

10. An image heating device according to claim 9, wherein said lateral shifting range controlling means widens said range when the rotating speed of said endless belt increases.

11. An image heating device according to claim 1, further comprising a backup member for forming a nip, together with said heater and said endless belt, and pressure switching means for switching the pressures in said nip, and said lateral shifting range controlling means controls said predetermined range depending on said pressure.

12. An image heating device according to claim 11, wherein said lateral shifting range controlling means narrows said predetermined range when said pressure increases.

13. An image heating device according to claim 1, further comprising a temperature detecting member for detecting the temperature of said heater; temperature controlling means to control power supply to said heater so that the temperature detected by said temperature detecting means is maintained at a predetermined fixing temperature during the fixing process; and fixing temperature changing means for changing said fixing temperature; and wherein said lateral shifting range controlling means controls said predetermined range depending on said fixing temperature.

14. An image heating device according to claim 13, wherein said lateral shifting range controlling means narrows said predetermined range when said fixing temperature rises.

15. An image heating device comprising:

a heater;

an endless belt movable together with recording material carrying an image; wherein the image carried on the recording material is heated through said endless belt by the heat from said heater;

lateral shifting force providing means for providing said endless belt with a lateral shifting force; and lateral shifting speed controlling means for controlling the lateral shifting speed of said endless belt, which is provided by said lateral shifting force providing means, depending on the amount of heat generated by said heater.

16. An image heating device according to claim 15, wherein said lateral shifting force providing means provides said endless belt with a bidirectional lateral shifting force, so that switching the shifting direction makes said endless belt shift laterally in alternating directions within said predetermined range.

17. An image heating device comprising:

a heater;

an endless belt movable together with recording material carrying an image;

a backup member which pairs, through said endless belt, with said heater, for forming a nip; wherein the image carried on the recording material is heated through said endless belt by the heat from said heater;

pressure switching means for switching the pressure in said nip;

lateral shifting force providing means for providing said endless belt with a lateral shifting force; and lateral shifting speed controlling means for controlling the lateral shifting speed of said endless belt, which is provided by said lateral shifting force providing means, depending on said pressure.

18. An image heating device according to claim 17, wherein said lateral shifting force providing means provides said endless belt with a bidirectional lateral shifting force, so that switching the shifting direction makes said endless belt shift laterally in alternating directions within said predetermined range.

19. An image heating device comprising:

a heater;

an endless belt to move along with recording material carrying an image; wherein the image carried on the recording material is heated through said endless belt by the heat from said heater;

belt speed switching means to switch the rotating speed of said endless belt;

lateral shifting force providing means to provide said endless belt with a lateral shifting force; and lateral shifting speed controlling means to control the lateral shifting speed of-said endless belt, which is provided by said lateral shifting force providing means, depending on the rotating speed of said endless belt.

20. An image heating device according to claim 19, wherein said lateral shifting force providing means provides said endless belt with a bidirectional lateral shifting force, so that switching the shifting direction makes said endless belt shift laterally in alternating directions within said predetermined range.

* * * * *

UNITED STATES PATENT AND TRADEMARK OFFICE

CERTIFICATE OF CORRECTION

PATENT NO. : 5,305,066

DATED : April 19, 1994

INVENTOR(S) : Shokyo Koh, et al.

It is certified that error appears in the above-indentified patent and that said Letters Patent is hereby corrected as shown below:

Column 5,
line 15, "numeral 59" should read --numeral 52--.

Column 9,
line 43, "is subroutine" should read --is on. If the motor 27 is on, step 2 is followed, and a subroutine--.

Column 11,
line 55, "wait" should read --waits--; and
line 56, "wait" should read --waits--.

Column 12,
line 54, "on, if" should read --on. If--.

Column 14,
line 15, "step 22" should read --step 122--.

Column 15,
line 6, "likes" should read --like--;
line 13, "104′," should read --104,--;
line 27, "through" should read --though--; and
line 36, "land" should read --and--.

UNITED STATES PATENT AND TRADEMARK OFFICE

CERTIFICATE OF CORRECTION

PATENT NO. : 5,305,066

DATED : April 19, 1994

INVENTOR(S) : Shokyo Koh, et al.

It is certified that error appears in the above-indentified patent and that said Letters Patent is hereby corrected as shown below:

Column 16,
line 4, "is skipped" should read --skips--;
line 13, "is skipped" should read --skips--; and
line 41, "oh," should read --on--.

Column 17,
line 25, "Ill" should read --lll--; and
line 41, "Ill" should read --lll--.

Column 20,
line 40, "control" should read --control range--.

Column 21,
line 30, "FIGS.," should read --FIGS.--; and
line 43, "control-is" should read --control is--.

Column 22,
line 38, "followed, if" should read --followed. If--; and
line 46, "manner;" should read --manner:--.

Column 23,
line 11, "program" should read --sequence--;
line 29, "106-may" should read --106 may--; and
line 36, "absorbed" should read --is absorbed--.

UNITED STATES PATENT AND TRADEMARK OFFICE

CERTIFICATE OF CORRECTION

PATENT NO. : 5,305,066

DATED : April 19, 1994

INVENTOR(S) : Shokyo Koh, et al.

It is certified that error appears in the above-indentified patent and that said Letters Patent is hereby corrected as shown below:

Column 24,
line 13, "mounted" should read --are mounted--; and
line 67, "roller 18" should read --roller 81--.

Column 25,
line 27, "tabs 851" should read --tabs $85_1$--;
line 30, "tabs 851 to 856" should read --tabs $85_1$ to $85_6$--; and
line 31, "Within" should read --within--.

Column 26,
line 27, "signal 28" should read --circuit 28--; and
line 66, "ana" should read --and--.

Column 27,
line 10, "d second," should read --d seconds,--.

Column 28,
line 16, "step 5," should read --step S5,--;
line 62, "frontward;" should read --forward;--; and
line 68, "on, if" should read --on. If--.

Column 29,
line 5, "on, if" should read --on. If--.

UNITED STATES PATENT AND TRADEMARK OFFICE

CERTIFICATE OF CORRECTION

PATENT NO. : 5,305,066

DATED : April 19, 1994

INVENTOR(S) : Shokyo Koh, et al.

It is certified that error appears in the above-indentified patent and that said Letters Patent is hereby corrected as shown below:

Column 30,
line 15, "step 6," should read --step S6,--.

Column 31,
line 16, "i.e." should read --is--; and
line 36, "step 6," should read --step S6,--.

Column 33,
line 32, "are" should read --is--.

Column 35,
line 23, "on, if" should read --on. If--.

Column 37,
line 67, "stopping" should read --stepping--.

COLUMN 39,
line 30, "Arm member 78a" should read —arm member 78--.

Column 40,
line 26, "till" should read --until--; and
line 65, "step is" should read --step 9--.

Column 41,
line 54, "by" should be deleted.

UNITED STATES PATENT AND TRADEMARK OFFICE

CERTIFICATE OF CORRECTION

PATENT NO. : 5,305,066

DATED : April 19, 1994

INVENTOR(S) : Shokyo Koh, et al.

It is certified that error appears in the above-indentified patent and that said Letters Patent is hereby corrected as shown below:

Column 42,
line 7, "forward" should read --(frontward--.

Column 45,
line 1, "Thought" should read --Though--; and
line 22, "referred" should read --referred to--.

Column 47,
line 27, "t-he" should read --the--.

Column 48,
line 35, "Speed" should read --speed--.

Column 49,
line 26, "stops" should read --steps--.

Column 50,
line 43, "heat" should read --heating--.

UNITED STATES PATENT AND TRADEMARK OFFICE

CERTIFICATE OF CORRECTION

PATENT NO. : 5,305,066

DATED : April 19, 1994

INVENTOR(S) : Shokyo Koh, et al.

It is certified that error appears in the above-indentified patent and that said Letters Patent is hereby corrected as shown below:

Column 52,
line 41 "of-said" should read --of said--.

Signed and Sealed this

Twenty-seventh Day of December, 1994

Bruce Lehman

*Attest:*

BRUCE LEHMAN

*Attesting Officer*

*Commissioner of Patents and Trademarks*